US005587782A

United States Patent [19]

Johdai et al.

[11] Patent Number: 5,587,782

[45] Date of Patent: Dec. 24, 1996

[54] COPYING MACHINE FOR COPYING DOCUMENTS IN TWO-IN-ONE MODE

[75] Inventors: Akiyoshi Johdai, Toyokawa; Akira Ohhata, Toyohashi; Hiroki Yamashita, Okazaki; Hirokazu Matsuo, Toyohashi; Yoshihito Hirano, Toyokawa, all of Japan

[73] Assignee: Minolta Co., Ltd., Osaka, Japan

[21] Appl. No.: 394,837

[22] Filed: Feb. 27, 1995

[30] Foreign Application Priority Data

Feb. 28, 1994 [JP] Japan ..... 6-055212

[51] Int. Cl.[6] ..... G03G 15/00

[52] U.S. Cl. ..... 355/309; 271/227; 271/902; 355/313; 355/321; 355/324

[58] Field of Search ..... 355/308, 309, 355/313, 321, 244, 324; 271/4.03, 227, 902, 185; 270/53, 37

[56] References Cited

U.S. PATENT DOCUMENTS

| | | | |
|---|---|---|---|
| 4,912,518 | 3/1990 | Matsuo et al. | 355/321 X |
| 4,914,472 | 4/1990 | Hamakawa | 355/313 X |
| 4,965,629 | 10/1990 | Hiroi et al. | 355/50 |
| 5,044,625 | 9/1991 | Reid | 271/293 |
| 5,079,599 | 1/1992 | Kato et al. | 355/313 |

FOREIGN PATENT DOCUMENTS

| | | |
|---|---|---|
| 5-158303 | 6/1993 | Japan . |
| 5-73095 | 10/1993 | Japan . |

*Primary Examiner*—Matthew S. Smith
*Attorney, Agent, or Firm*—Brinks Hofer Gilson & Lione

[57] ABSTRACT

A copying machine having a two-in-one copying mode has a pickup roller 65, a separating roller 75, a register roller 90, a conveyor belt 95 and a pinch roller 101. The pickup roller 65 and the separating roller 75 feed a document toward a glass platen 29 one by one to stop the document at a first-out position. The register roller 90 conveys the document fed by the pickup roller 65 and the separating roller 75 onto the glass platen. The conveyor belt 95 conveys the document conveyed by the register roller 90 along the glass platen 29 until a rear end of the document reaches a predetermined switch-back position, then conveys the document in the opposite direction to retreat a predetermined distance, and then conveys the document as well as a succeeding document stopped at the first-out position such that a front end of the document situated on a downstream side of the document conveying direction may be aligned with an exposure reference SP, and then discharges the documents to the downstream side of the document conveying direction after exposure. The pinch roller 101 conveys the documents discharged by the conveyor belt 95 from the glass platen 29 to a discharge section 115.

12 Claims, 49 Drawing Sheets

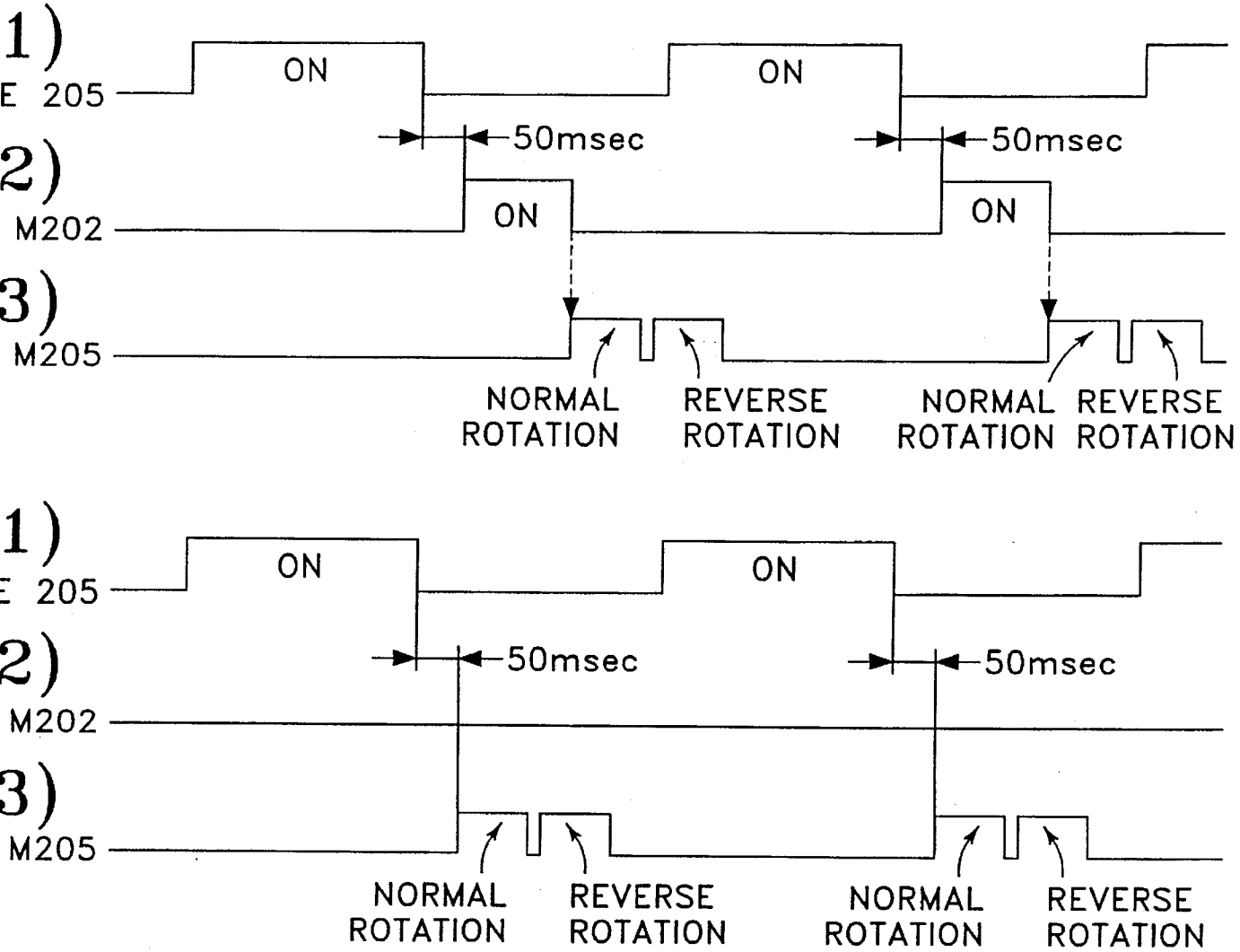
Fig. 73A(1)
Fig. 73A(2)
Fig. 73A(3)
Fig. 73B(1)
Fig. 73B(2)
Fig. 73B(3)

COPYING MACHINE FOR COPYING DOCUMENTS IN TWO-IN-ONE MODE

BACKGROUND OF THE INVENTION

1. Field of the Invention

The present invention relates to a copying machine for copying a document through the steps of feeding out a plurality of stacked document sheets one by one, arranging two document sheets on a glass platen in series with respect to a document conveying direction, and copying images of the two document sheets onto one large-size sheet.

2. Description of the Prior Art

Conventionally, as a copying method using an electrophotographic method, from copy-saving and filing-space-saving points of view, a two-in-one mode copying method (hereinafter, referred to as "two-in-one mode") has been known by a Japanese Patent Laid-Open Publication No. 3-114071, a Japanese Patent Publication No. 5-73095, and the like. In this two-in-one mode, document sheets placed on a document tray of an automatic document feeder (ADF) are fed onto the glass platen one by one. On the glass platen, the document sheets are set in such a way that two sheets at each one time are arranged in series with respect to the document conveying direction and that one end of one document sheet is made coincident with an exposure reference (for example, one side line of a scale provided upstream or downstream of the glass platen in the document conveying direction) while one end of the other sheet is made coincident with the other end of the one document sheet. Then, the two document sheets are exposed to light by a single scanning operation. As a result, the two document sheets are copied onto a copying sheet of the same size as the original document sheet. More specifically, if the document sheets are of A4 size transverse, then the two document sheets are copied onto a sheet of A4 size longitudinal in reduction at a magnification factor of 0.707. After copying, the two document sheets on the glass platen are discharged to the discharge tray one after another. Then, another two document sheets (third and forth pages of the document) are set on the exposure position of the glass platen to be handled in the same manner as described above.

In the two-in-one mode as described above, however, when two document sheets exposed to light at the same time are continuously discharged, the rear end of the first page document sheet occasionally overlaps with the front end of the second page document, which causes the document sheets discharged to the discharge tray to be in reverse order.

Moreover, when prosecuting the two-in-one mode by the conventional copying machine, it is necessary to change the document set direction. More particularly, the document sheet should be set on the document tray in an upside-down condition.

And moreover, even if the copying machine is provided with a sorter having a stapler which staples the copied sheet, the sheet copied in two-in-one mode described above is not stapled on a proper portion, that is, on a left side shoulder of the sheet.

SUMMARY OF THE INVENTION

The present invention has been developed to substantially eliminate the above-described disadvantages.

Accordingly, it is an object of the present invention to provide a copying machine in which two document sheets exposed to light at the same time are continuously discharged with a certain distance therebetween.

It is an another object of the present invention to provide a copying machine which is possible in the two-in-one copy mode to set the document in the same manner as the normal mode without changing the document set direction and to staple the copied sheet on a suitable position by the stapler.

The invention has been developed with a view to the above object.

The invention of the first aspect, therefore, provides a copying machine having a two-in-one copying mode in which mode two sheets of the document are fed on a glass platen in series with respect to a document conveying direction and copied onto one sheet by one-time exposure scanning, the copying machine comprising:

a document feeder means for feeding the document toward the glass platen one by one to stop the document at a first-out position which is situated on a upstream side of the document conveying direction;

a first conveying means for conveying the document fed by the document feeder means onto the glass platen;

a second conveying means for conveying the document conveyed by the first conveying means along the glass platen until the rear end of the document reaches at a predetermined switch-back position, conveying the document to the opposite direction to retreat a predetermined distance, conveying the document as well as a succeeding document stopped at the first-out position such that the front end of the document situated on a downstream side of the document conveying direction may be aligned with a exposure reference, and discharging the documents to the downstream side of the document conveying direction after exposure;

a third conveying means for conveying the documents discharged by the second conveying means from the glass platen to a discharge section; and whereby the document conveying length (d3) from the exposure reference to the third conveying means is longer than the sum (d4+Δdp) of the document conveying length (d4) from the first-out position to the switch-back position and the difference length (Δdp) of the document conveying direction between a document having a longest length and a document having a shortest length among documents to be handled in the two-in-one mode.

In the preferred embodiment of the invention, the second conveying means includes a conveyor belt situated above the glass platen, the document feeder means includes a pickup roller and a separating roller provided on the upstream side of the second conveying means with respect to the document conveying direction, the first conveying means includes a register roller provided between the document feeder means and the second conveying means, and the third conveying means includes a pinch roller and a discharge roller provided on the downstream side of the second conveying means with respect to the document conveying direction.

Preferably, the first-out position may be defined by a nip position of the register roller of the first conveying means. A switch-back amount of the document by the second conveying means may correspond to a length over which the rear end of the document reaches the nip portion of the register roller.

Preferably, the document may be guided by guide means so that the rear end portion of the document does not return to the register roller side. In this case, the guide means may comprise a resin film.

Preferably, the second conveying means may be reduced in speed immediately before the document reaches the exposure reference.

Preferably, the second conveying means may make a space between the first document and the second document exposed at the same time by once switching back the second document as well as the succeeding third document after the first document has discharged and before the second document has not reached at the discharge section. Alternatively, the second conveying means may make a space between the first document and the second document exposed at the same time by turning off the second conveying means when the rear end of the first document has separated from the second conveying means.

In the copying machine having a construction described above, in the case of prosecuting the two-in-one mode, the document sheet is fed one by one by the document feeder means to the first-out position. The first sheet of the document fed by the document feeder means is conveyed by the first conveying means onto the glass platen. The first sheet of the document conveyed by the first conveying means is conveyed by the second conveying means on the glass platen until the rear end of the sheet reaches at the switch-back position, so that the first sheet is retreated to a position spaced a predetermined distance from the switch-back position. Then, the second sheet of the document is fed to the first-out position by the document feeder means. After that, the first sheet and second sheet are conveyed together to the exposure position on the glass document by the first and second conveying means. After completion of the exposure, the two sheets of the document are conveyed toward the discharge side. At first, the first sheet is discharged to the discharge section by the third conveying means. Although the second sheet is conveyed toward the discharge side with the third sheet by the second conveying means, the second sheet does not reach at the third conveying means. After once retreating together with the third sheet of the document, the second sheet is handed to the third conveying means to discharge to the discharge section at the time that the third sheet is conveyed to the exposure position.

According to the above-described invention, two document sheets exposed to light at the same time are continuously discharged with an enough distance therebetween, which ensure that the two sheet on the discharge tray are not in reverse order.

The invention of the second aspect provides a copying machine having a two-in-one copying mode in which mode two sheets of the document are fed on a glass platen in series with respect to a document conveying direction and copied onto one sheet by one-time exposure scanning, the copying machine comprising:

- a document tray on which the document is set such that lower end of the document is directed to an operational side of the copying machine;
- a document conveying means for conveying the document in turn from a last page onto the glass platen from the right side of the copying machine as viewed from the operational side thereof;
- a discharge means for discharging a copied sheet from the left side of the copying machine as viewed from the operational side thereof, the upper surface of the copied sheet being faced upward, the lower end of the copied sheet being directed to a back side of the copying machine; and
- a stapler means for stapling the copied sheet discharged by the discharge means on the rear end and on the operational side.

In the preferred embodiment of the invention, the document tray is provided above the glass platen and wherein the document is set such that lower end of the document is directed to the operational side of the copying machine and the upper surface of the document is faced upward. Alternatively, the document tray is provided on the right side of the glass platen as viewed from the operational side of the copying machine and wherein the document is set such that lower end of the document is directed to the operational side of the copying machine and the upper surface of the document is faced downward.

In the copying machine having a construction described above, the document conveying means conveys the document from the last page, whereby the last page of the document is on the left side of the glass platen; while the previous page of the document is on the right side of the glass platen. Exposing in this condition allows the last page of the document to be copied on the right side of the sheet and allows the previous page of the document to be copied on the left side of the sheet. The copied sheet is discharged by the discharge means with the copied surface faced upside and with the lower end directed to the opposite side to the operational side of the copying machine, that is, in a face-up and a upside-down condition. Aa a result, the image of the last page of the document is on the front end of the copied sheet discharged by the discharged means; while the image of the previous page of the document is on the rear end of the same. Then stapling the rear end and operational side of the copied sheet allows the sheet to be stapled on a proper position, namely, on a left shoulder position.

As described above, according to the present invention, it is possible in the two-in-one copy mode to set the document without changing the document set direction and to staple the copied sheet on a suitable position by the stapler.

BRIEF DESCRIPTION OF THE DRAWINGS

Further objects and advantages of the present invention will become clear from the following description taken in conjunction with the preferred embodiments thereof with reference to the accompanying drawings.

FIG. 8 is a side view of the scale pressing mechanism according to the first embodiment, showing a state that the plunger of the solenoid has been fully pulled in;

FIGS. 73A and 73B are time charts of bin moving and sheet aligning;

DETAILED DESCRIPTION OF THE PREFERRED EMBODIMENTS

1. Copying Machine

<General Construction and Operation of the Copying Machine>

Figure 1:
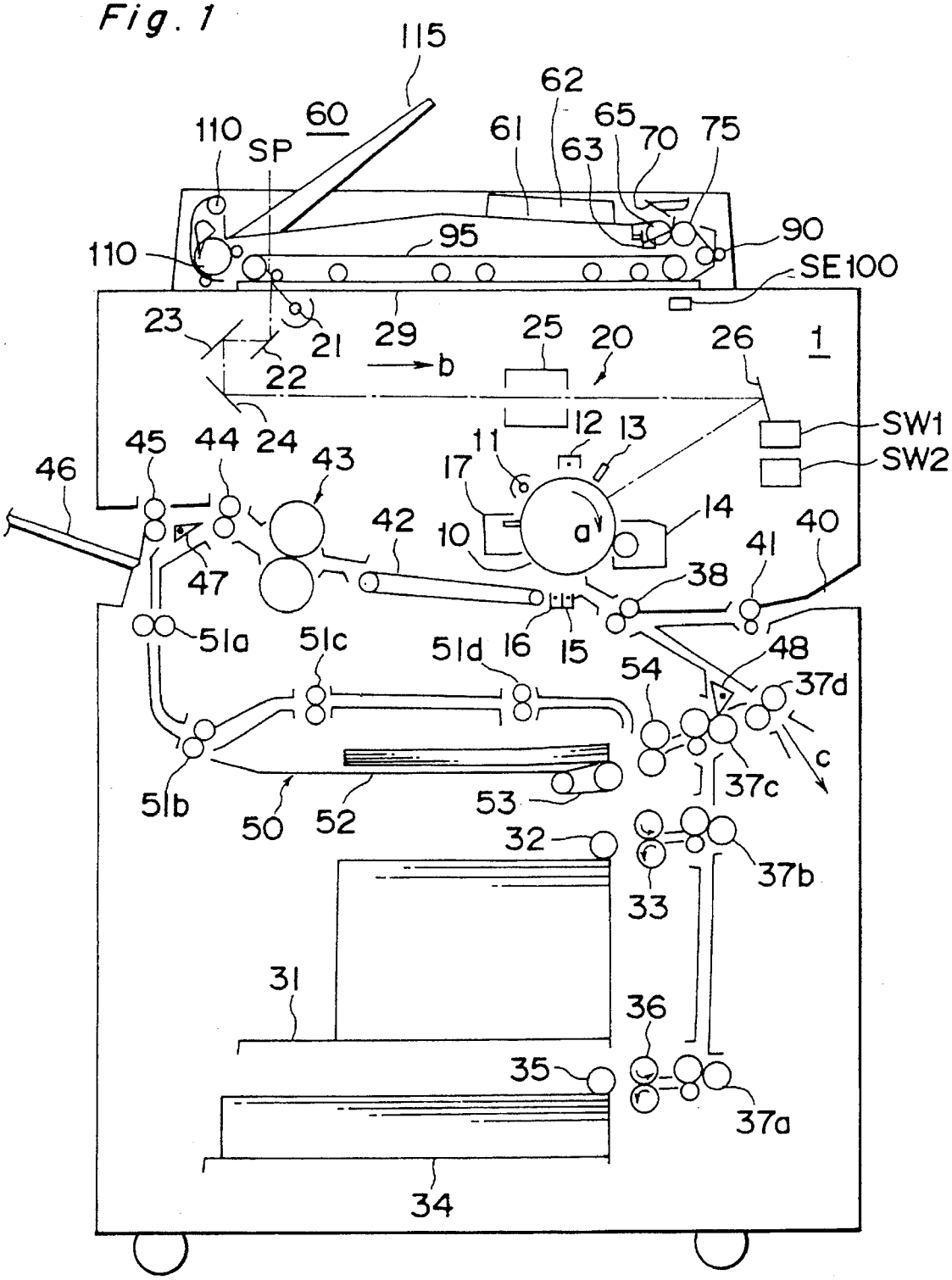
FIG. 1 is a schematic arrangement diagram of an automatic document feeder (ADF) and a copying machine main body, in which an automatic paper feeder according to the present invention is provided.

FIG. 1 shows the general construction of the copying machine, wherein at a generally center portion of a copying machine body generally denoted by numeral 1, a photosensitive drum 10 having a photosensitive layer on its outer circumference is installed so as to be rotatable in a direction of arrow "a" at a constant peripheral speed. Around the photosensitive drum 10, there are provided, in its rotating direction, a main eraser 11, a corona charger 12, a sub-eraser 13, a developing unit 14 of the magnetic brush type, a transfer charger 15, a paper-separating charger 16, and a cleaner 17 of the blade type. Also, an optical system 20 is disposed above the photosensitive drum 10.

The photosensitive drum 10 rotates in the direction of arrow "a", whereupon the main eraser 11, the corona charger 12, and the sub-eraser 13 perform the processes of erasing, charging, and inter-image and end-of-image erasing, respectively, and thereafter the image of a document set on a glass platen 29 is exposed to light by the optical system 20. As a result of this exposure, an electrostatic latent image formed on the photosensitive drum 10 is visualized as a toner image by the developing unit 14.

The optical system 20, disposed just under the glass platen 29, concurrently scans and illuminates the image of the document set with its one end coincident with an exposure reference or standard position SP, so that the photosensitive drum 10 is exposed to the resulting reflected light. During the image scanning operation, an exposure lamp 21 and a first mirror 22 move in a direction of arrow "b" at a speed v/m (m: magnification of copying) with respect to the peripheral speed v of the photosensitive drum 10 (constant whether the magnification is full or varied). Further, at the same time, a second mirror 23 and a third mirror 24 move in the direction of arrow "b" at a speed v/2 m. Also, with a change in the magnification, a projection lens 25 moves on the optical axis, while a fourth mirror 26 swings or rotates so that the optical length is corrected.

Copying sheets, i.e. copying paper, are accommodated in an upper-stage paper feed unit 31 of the elevator type and a lower-stage paper feed unit 34 of the tray type, and fed from either one of them based on the selection by the operator. The paper feed units 31, 34 are provided with feed rollers 32, 35, and separating rollers 33, 36 each composed of a forward roller and a reverse roller. A sheet of paper fed from the upper-stage paper feed unit 31 is fed through conveyor rollers 37*b*, 37*c* to a timing roller 38 provided immediately before an image transfer unit. A sheet of paper fed from the lower-stage paper feed unit 34 is fed through conveyor rollers 37*a*, 37*b*, 37*c* to the timing roller 38.

This copying machine also allows paper feed by manual operation, in which case a sheet of copying paper inserted from a manual feed port 40 is fed through a feed roller 41 to the timing roller 38. The sheet of paper fed to the timing roller 38 temporarily stands by here until it is sent out to a transfer section when the timing roller 38 is turned on in synchronization with an image formed on the photosensitive drum 10. The sheet is brought into close contact with the photosensitive drum 10 in the transfer section, where a toner image is transferred by corona discharge from the transfer charger 15, and then the sheet is separated from the photosensitive drum 10 by the corona discharge from the paper-separating charger 16 and by the sturdiness of the sheet itself. Thereafter, the sheet is fed through a conveyor belt 42 to a fixing unit 43, where toner is fixed, and then the sheet is discharged through a conveyor roller 44 and a discharge roller 45 onto a discharge tray 46. Meanwhile, the photosensitive drum 10 continues rotating in the direction of arrow "a" even after the transfer process, under which the photosensitive drum 10 has residual toner removed therefrom by the cleaner 17 and residual charges erased by the main eraser 11, thus being ready for the next copying process.

Within the copying machine body 1, there are provided a paper re-feed unit 50 and paper-path switching claws 47, 48 for processing both-sides or combined copy. The switching claw 47 is set normally to a solid-line position, and guides the sheet to the discharge tray 46. In the mode of both-sides copy or combined copy, a sheet onto the first surface (front surface) of which the image of an odd-numbered sheet of the document has been transferred is discharged through conveyor rollers 51*a*, 51*b*, 51*c*, 51*d* to an intermediate tray 52, by the switching claw 47 being set to a position which is slightly rotated counterclockwise. Then the sheet is accommodated on the intermediate tray 52 with its image surface upward. After a specified number of sheets have been accommodated on the intermediate tray 52, with a re-feed signal issued, the sheets are fed one by one, beginning to be fed with the lowest-layer of the sheets, by the rotation of a separating roller 54 to the conveyor roller 37*c*.

In the both-sides copy mode, the re-fed sheet is fed to the timing roller 38 while being guided upward by the switching claw 48 set to a solid-line position. Then, the image is transferred onto the second surface (rear surface) of the sheet, fixed, and then discharged to the discharge tray 46. In the combined copy mode, the re-fed sheet is conveyed in a direction of arrow "c" by a conveyor roller 37*d* by the switching claw 48 being set to a position which is slightly rotated clockwise. Immediately before the rear end of the sheet passes a nip portion of the conveyor roller 37*d*, the conveyor roller 37*d* is switched to the reverse rotation, whereby the sheet is reversed upward down and frontward back and sent out as such. Thereafter, the image is overlappingly transferred onto the first surface (front surface), fixed, and discharged onto the discharge tray 46.

In the copying machine body 1, after the start of a copying process, while the first sheet is standing by immediately before the timing roller 38, a first-out paper feeding process that the second and following sheets are also previously fed to the paper feed path. For example, in the paper feed from the lower-stage paper feed unit 34, the second sheet in succession to the first sheet is fed to the paper feed path and moreover even the third sheet is fed to immediately before the conveyor roller 37*a*. Such a first-out paper feed process is performed not only in the multi-copy mode but also in the single copy mode using an ADF 60, which functions to enhance the copying speed.

<Construction and Operation of ADF>

The construction and operation of the ADF 60 is now described in detail. First, the outlined construction and operation of the ADF 60 are described in detail by referring to FIG. 2. The ADF 60 is generally composed of a document feed section 601, a document conveying section 602, and a document discharge section 603. The document feed section 601 comprises a document tray 61, an front-end restricting plate 63, a pickup roller 65, a document pressing plate 70, a separating roller 75, a separating pad 80, and a register roller 90, where the components except the document tray 61 are all covered with an openable/closable cover 604. The document conveying section 602 comprises a driving roller 96 disposed close to the document feed section 601, a subordinate roller 97 disposed close to the document discharge section 603, and a conveyor belt 95. These components are covered with a cover 605 which constitutes the document tray 61. The document discharge section 603 comprises a reverse roller 100, a discharge roller 110, and a discharged-paper tray 115. The components except the discharged-paper tray 115 are all covered with an openable/closable cover 606.

This ADF 60 is installed on the upper surface of the copying machine body 1 so that the conveyor belt 95 is positioned on the glass platen 29. The ADF 60 is arranged to be openable to the upper surface of the glass platen 29 by an unshown hinge fitting provided on a back side or a side opposite to the operational side of the ADF 60.

To set the document manually onto the glass platen 29, the operator lifts the ADF 60 upward to make the upper surface of the glass platen 29 opened. The opening or closing of the ADF 60 is detected by a magnet sensor SE100 as shown in FIG. 1. The ADF 60 will not be operable until the magnet sensor SE100 detects that the ADF 60 is properly closed.

Figure 2:
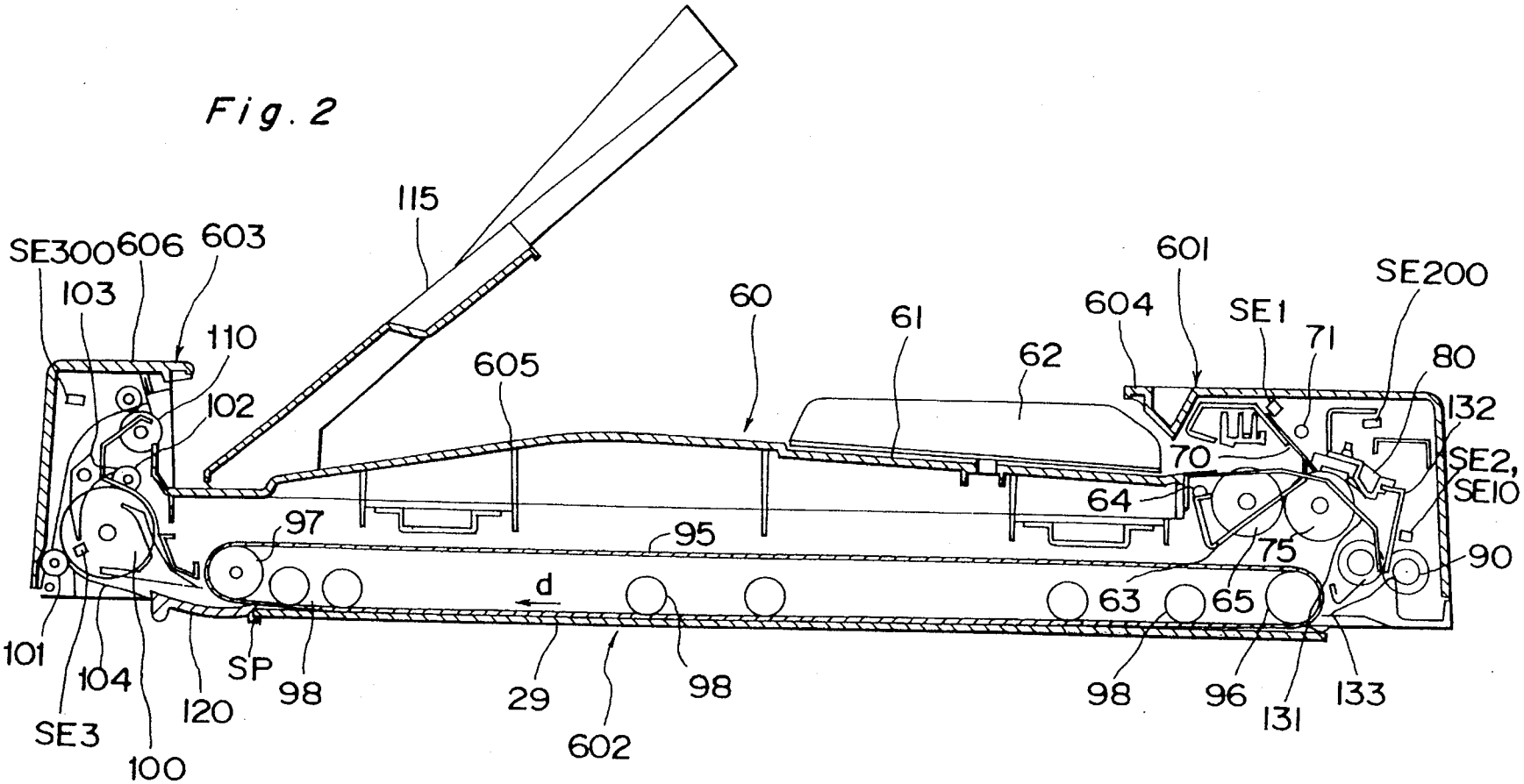
FIG. 2 is a sectional view showing the internal arrangement of the ADF.

A document to be fed is loaded on the document tray 61 with the first page of the document upward. In this state, the document is position-restricted in the widthwise direction by a side restricting plate 62, and position-restricted at its front end by the front-end restricting plate 63. The front-end restricting plate 63 and the pressing plate 70 are arranged to be rotatable on shafts 64, 71, respectively. In the paper feeding process, the front-end restricting plate 63 will have withdrawn downward when the first to last sheets of the document are completely fed. When the first document sheet is fed, the document pressing plate 70 moves downward from its withdrawal position as shown in FIG. 2, so as to press the front-end portion of the sheet against the pickup roller 65, thereby imparting a paper feed pressure to the sheet.

The pickup roller 65 and the separating roller 75 are driven to rotate both clockwise in the paper feeding process. The document sheets pass between the separating roller 75 and the separating pad 80, one by one starting with the lowest-layer one, so as to be fed to the register roller 90. The register roller 90 holds the fed sheet temporarily stood by at its nip portion, and after a certain time duration, is driven to convey the sheet to the entrance of the glass platen 29.

The conveyor belt 95 is stretched endlessly between the driving roller 96 and the subordinate roller 97 so as to cover the entire surface of the glass platen 29. Within the conveyor belt 95, a multiplicity of backup rollers 98 are rotatably provided in order to make the conveyor belt 95 pressed against the glass platen 29. The conveyor belt 95 is driven to rotate in the direction of arrow "d", whereby the document sheet is set with its front end registered with the standard position SP (exposure standard), for starting the exposure, which is a boundary between a scale 120 and the glass platen 29.

In proximity to the reverse roller 100 there are provided pinch rollers 101, 102 and a switching claw 103, the latter being purposed to switch the paper path for reversing the document sheet in the both-sides document mode. Normally, the switching claw 103 is set to the solid-line position and, after completion of the exposure, the document sheet is discharged from on the glass platen 29 based on the rotation of the conveyor belt 95 in the direction of arrow "d" and the clockwise rotation of the reverse roller 100. The discharged sheet is then guided upward by a guide plate 104 and the switching claw 103, and discharged onto the discharged-paper tray 115 by the discharge roller 110. Since the second surface (rear surface) of the document is first processed in the case of the both-sides document mode, the both-sides document, before fed onto the glass platen 29, is rotated clockwise by a specified angle from a state as shown in the figure. In this state, the document is first conveyed around the reverse roller 100 so as to be reversed, and returned onto the glass platen 29 with its second surface downward. In this process, the conveyor belt 95 is driven to rotate in a direction opposite to that of arrow "d". Further, after the second surface has completely been exposed, the both-sides document is again conveyed around the reverse roller 100 so as to be reversed for the process of copying the first surface (front surface).

Figure 65:
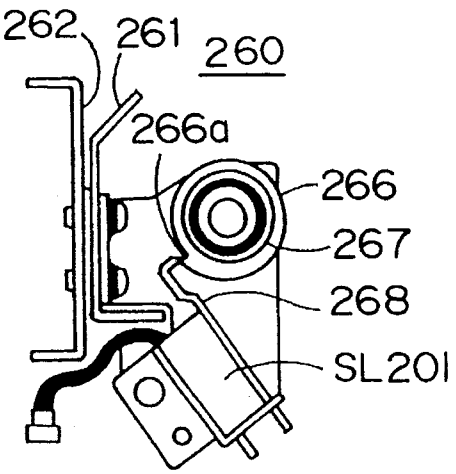

The reverse roller 100 and the discharge roller 110 are driven to rotate by a discharge motor M4 (see FIG. 65). The ADF 60 is provided with various types of sensors SE1, SE2, SE3, and SE10 for detecting the document. The sensor SE1 detects the presence or absence of a document on the tray 61. The sensor SE2, provided immediately before the register roller 90, detects the reaching and passage of the document, and detects the length of the document in cooperation with a timer when the document is sent out from the register roller 90. The sensor SE10, juxtaposed with the sensor SE2, detects the size of the document in its widthwise direction. Based on document detection signals at the sensors SE2 and SE10, the size of the document is decided including whether the document is of longitudinal feed (longer side of the document is parallel to the conveying direction) or of transverse feed (shorter side of the document is parallel to the conveying direction). Further, the sensor SE3, disposed at the entrance of the reverse roller 100, detects a document passing therethrough.

<Explanation of Scale 120 and Others>

The scale 120 is graduated for placing the document with its one end registered with the mark of its size when the document is manually placed on the glass platen 29 with the ADF 60 lifted. The scale 120 has a function of forcedly stopping at the exposure standard position SP the document sheet conveyed on the glass platen 29 by the conveyor belt 95 in the operation of the ADF 60, as well as a function of designating the position of a document when the document is manually replaced with another.

Figure 3:
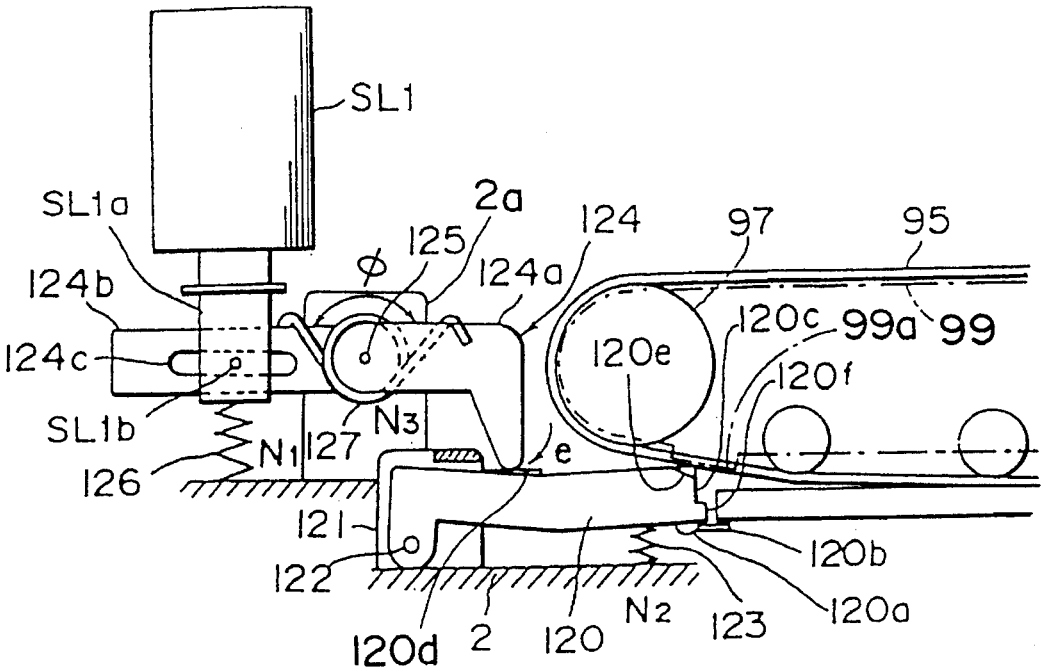
FIG. 3 is a side view of a first embodiment of the scale pressing mechanism, showing a state that the scale has been raised.

The scale 120 is oppositely disposed at an end portion of the glass platen 29 downstream of the document conveying direction. As shown in FIGS. 3, the scale 120 is rotatably mounted to holders 121 provided on both back and front sides of an upper-surface frame 2 of the copying machine body 1, with a pin 122 serving as a fulcrum, in such a state that a front-end portion of the scale 120 or a portion thereof on the glass platen 29 side is biased upward by a spring 123.

This scale 120 has at its bottom a protrusion 120*a* confronting the upper-surface frame 2 and a protrusion 120*b* protruding into a space below the glass platen 29. There are also provided a plurality of portions such as a tangle-preventing portion 120*f*, which is provided below a front-end surface 120*c* so as to protrude toward an end surface of the glass platen 29, a lever-contact portion 120*d*, which is provided above on the back side, and a cut portion 120*e* of a specified length, which is provided at an upper end corner portion on the front-end side.

Thus, the scale 120 is position-restricted in a state that the protrusion 120*b* is engaged with the lower surface of the glass platen 29 based on the biasing force of the spring 123 and that the front-end is protruded from the glass platen 29 by a specified height. In this state, the tangle-prevention part 120*f* is held below the upper surface of the glass platen 29. As a consequence, the document placed on the glass platen 29 is accurately positioned with its one end in contact with the front-end surface 120*c* of the scale.

Moreover, the protruding amount of the scale from the upper surface of the glass platen is specified by the engagement of the protrusion with the glass platen, which allows the protruding amount to be surely constant. Therefore, when the user open the automatic document feeder to set the document sheet on the exposure position, it is possible to certainly position-restrict the one end of the document sheet by bringing it contact with the scale.

With the ADF 60 closed to the copying machine body 1, a protrusion portion 99*a* of a frame 99 that supports the rollers 96, 97 and the conveyor belt 95 is in contact with the scale 120, while the scale 120 is maintained such that its front-end portion is in contact with the conveyor belt 95 and protruded from the upper surface of the glass platen 29 by a specified height. The scale 120 is so set as to descend in the above state to lower than the state of FIG. 3. The frame 99 is kept parallel to the glass platen 29 by an unshown positioning member. Accordingly, when the ADF 60 is mounted on the copying machine body 1, the positional relation between the front-end of the scale 120 and the conveyor belt 95 supported by the frame 99 as well as the contact state between the same can be maintained readily and reliably in proper state. As a result, the scale 120 no longer needs to be controlled for its rotation, whereas the document will no longer pass by without being restricted by the scale 120 based on insufficiency of the pressing force or the pressing amount. Accordingly, the document can be restricted reliably by the scale 120. Further, improved is the accuracy with which the document is stopped when the front-end of the document is brought into contact with the scale 120, so that any skew (tilted feed) can be corrected reliably.

Figure 4:
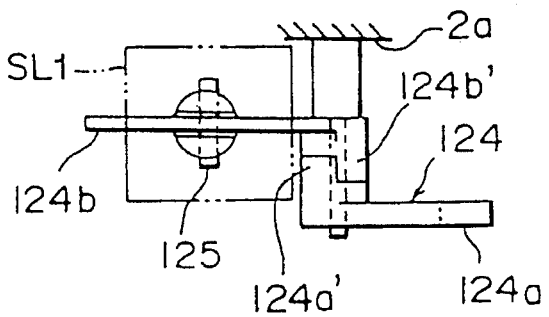
FIG. 4 is a partial plan view of the scale pressing mechanism according to the first embodiment.
Figure 5:
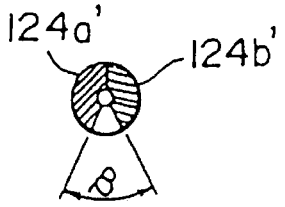
FIG. 5 is a sectional view of the lever member of the scale pressing mechanism according to the first embodiment.
Figure 6:
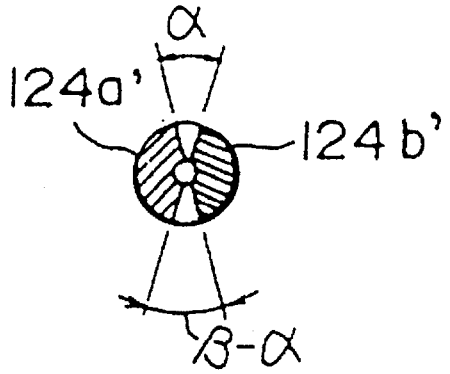
FIG. 6 is a sectional view of the lever member of the scale pressing mechanism according to the first embodiment.

The lever 124 is made up of two lever members 124*a*, 124*b* (refer to FIG. 4). And a coupling portion of these lever members 124*a*, 124*b* is rotatably supported by a pin 125 fixed to an inner frame 2*a* of the ADF 60. At the pin-coupling portion between the lever members 124*a*, 124*b*, there are formed fan-in-section portions 124*a*', 124*b*' about a center of the fixed pin 125, as shown in FIGS. 5 and 6, the fan-in-section portions being arranged so that they are opposed to each other with the fixed pin 125 therebetween and that one lever member 124*a* (124*b*) is rotatable about the fixed pin 125 by a specified angle relative to the other lever member 124*b* (124*a*). Wound around the fan-in-section portions 124*a*', 124*b*' is a stroke-absorbing spring 127 whose two ends are engaged with the lever members 124*a*, 124*b*, respectively. One lever member 124*a* is biased clockwise relative to the other lever member 124*b* so as to be restricted into the state of FIG. 5, whereas in the normal mode the lever members 124*a*, 124*b* form an angle Φ (see FIG. 3) as an intersecting angle of their upper surfaces. Besides, a long hole 124*c* provided in the lever member 124*b* is coupled with the plunger SL1*a* of the solenoid SL1 provided upward. The plunger SL1*a* is biased upward by a spring 126 provided on the inner frame 2*a* of the ADF 60. The biasing force of the spring 126 is so controlled that with the solenoid SL1 is off, the lever member 124*a* is brought into contact with the scale 120 but the scale 120 is not be pressed down. That is, if the biasing forces of the springs 126, 123, and 127 are N1, N2, and N3, respectively, then the biasing forces are controlled so as to meet the relationship that N3>N2>N1. Accordingly, even if there is an error in mounting the ADF 60 onto the copying machine body 1, the lever 124 can be positively brought into contact with the scale 120. Thus, even when the solenoid SL1 is switched to the on state so that the scale 120 is pressed down by the lever 124, there will occur no collision noise of the lever 124 and the scale 120. Furthermore, it is also possible to absorb any possible noise of the scale 120 colliding with an ascend-restricting member (such as the conveyor belt 95 or the protrusion portion 99*a*) when the solenoid SL1 is switched to the off state.

Figure 7:
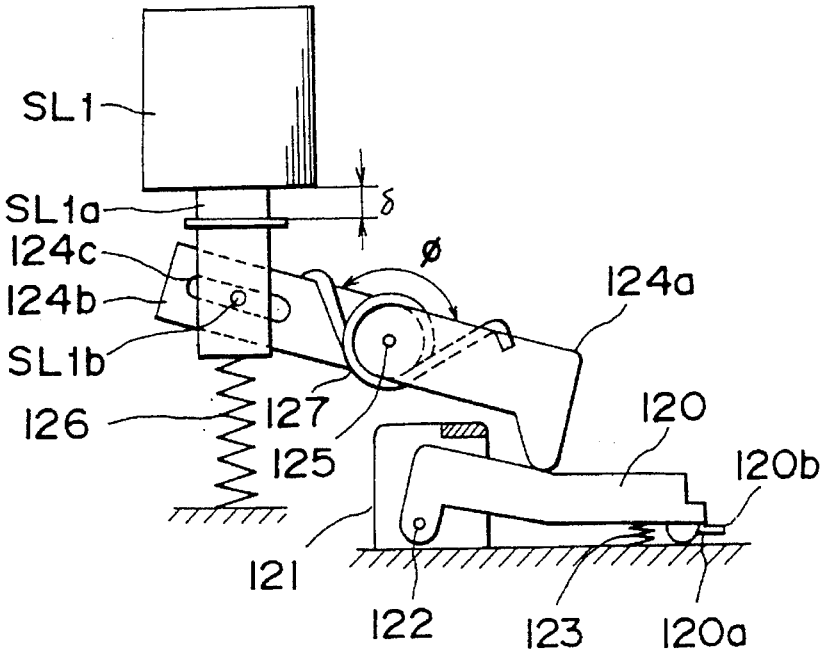
FIG. 7 is a side view of the scale pressing mechanism according to the first embodiment, showing a state that the moving solenoid is pressing the scale.

In the scale pressing mechanism having the above arrangement, when the solenoid SL1 is switched to the on state, the lever 124 rotates clockwise so that the front end of the lever member 124*a* presses the scale 120 as shown in FIG. 7. The scale 120 rotates on the shaft 122 while the protrusion 120*a* for use of scale descent positioning comes into contact with the upper-surface frame 2 of the copying machine body, where the front end portion of the scale 120 stops at a position slightly below the glass platen 29. At this time point, the drive stroke of the solenoid SL1 has an unreached portion left; that is, the plunger SL1*a* has not been absorbed completely. The resultant remainder δ is determined by taking into account the combining accuracy of the copying machine body 1 and the ADF 60 and the like, and should be larger than zero. Until this time point, since the biasing force of the spring 127 is larger than the biasing force of the spring 123, N2, the intersecting angle of the levers 124*a* and 124*b* is maintained at Φ.

Figure 8:
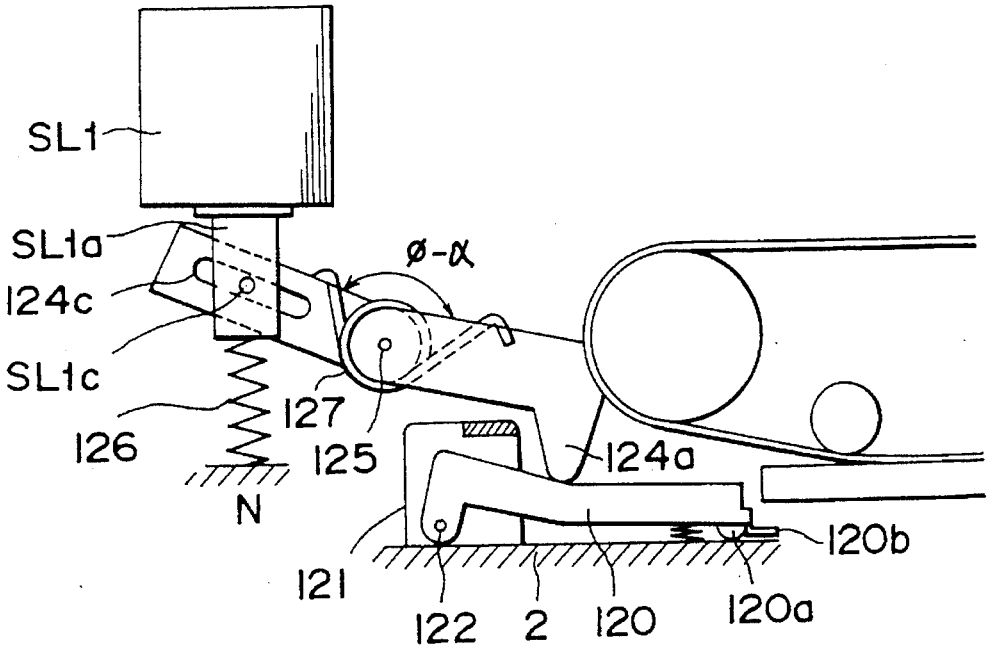
Figure 10:
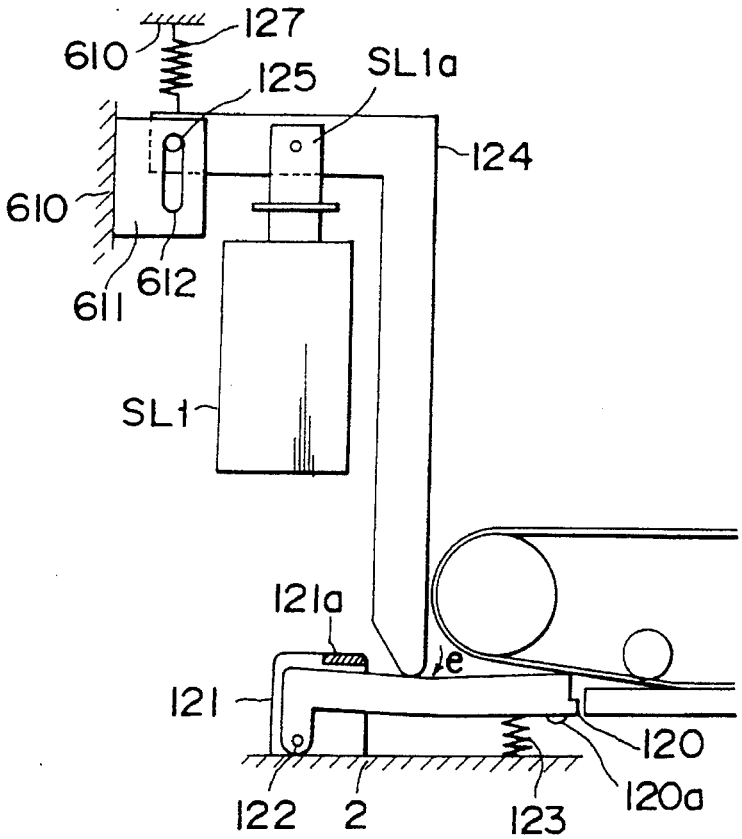
FIG. 10 is a side view showing a third embodiment of the scale pressing mechanism.
Figure 11:
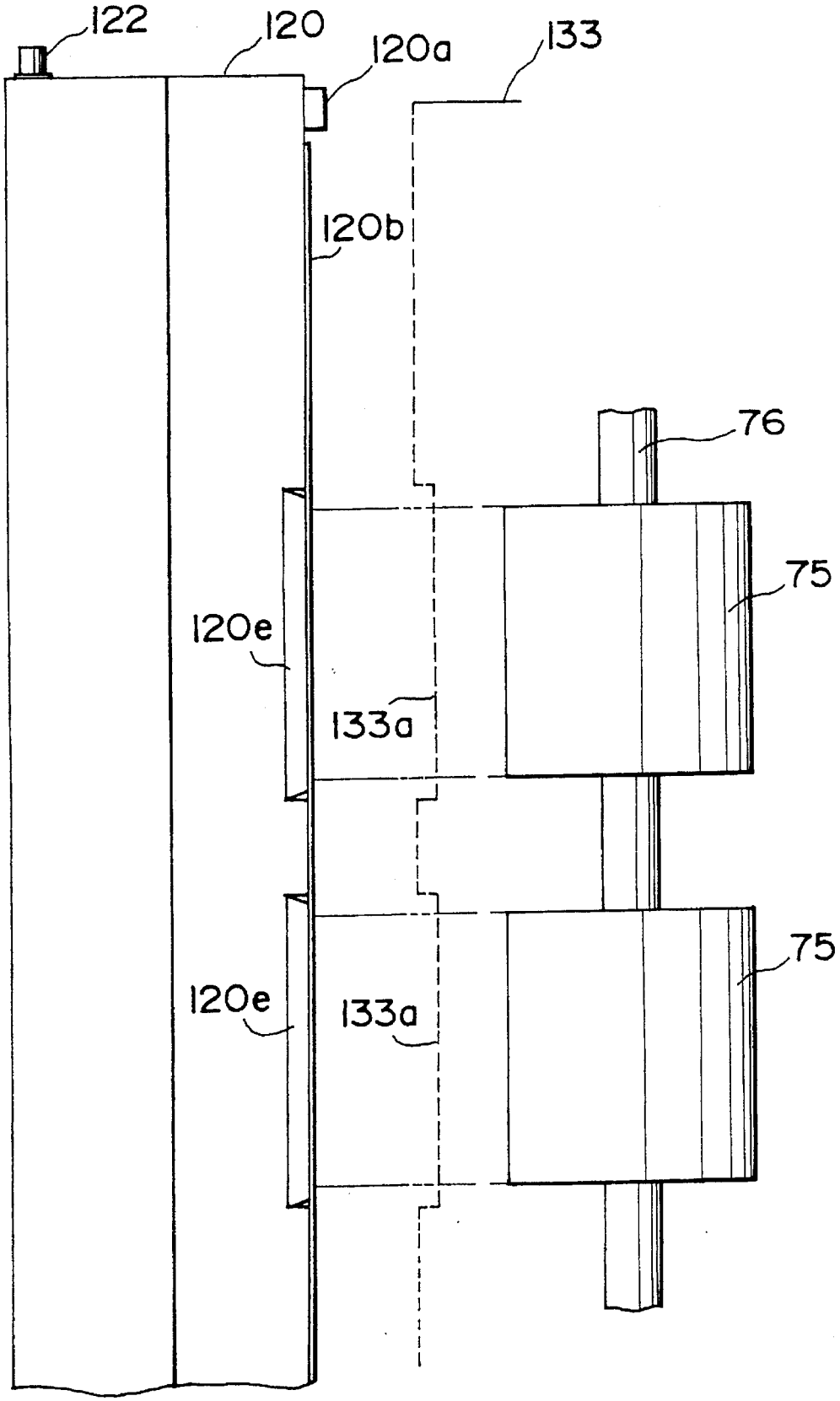
FIG. 11 is an explanatory view of the planar positional relation among the front end portion of the scale, the cut portion of the film, and the separating roller.

If the plunger SL1*a* is absorbed further than in the above state, the absorbing force of the solenoid SL1 at this time point is larger than the biasing force of the spring 127 so that, relative to the lever member 124*a* position-restricted by contact with the scale 120, the other lever member 124*b* rotates clockwise so as to absorb the stroke remainder δ of the plunger SL1*a*, as shown in FIG. 8, with the result that the upper-surface intersecting angle of the lever members 124*a* and 124*b* is Φ−α (α<β) and the relative angle of the lever 124*a* and the lever 124*b* is in a state as shown in FIG. 10, as the plunger SL1*a* is in the final absorption state. Accordingly, the plunger SL1*a* is completely absorbed in its on state, that is, the plunger SL1*a* will never be held in an incomplete absorption state. As a result, the load in the on state is low so that current consumption can be reduced to a minimum.

<Second Embodiment of Scale Pressing Mechanism>

Figure 9:
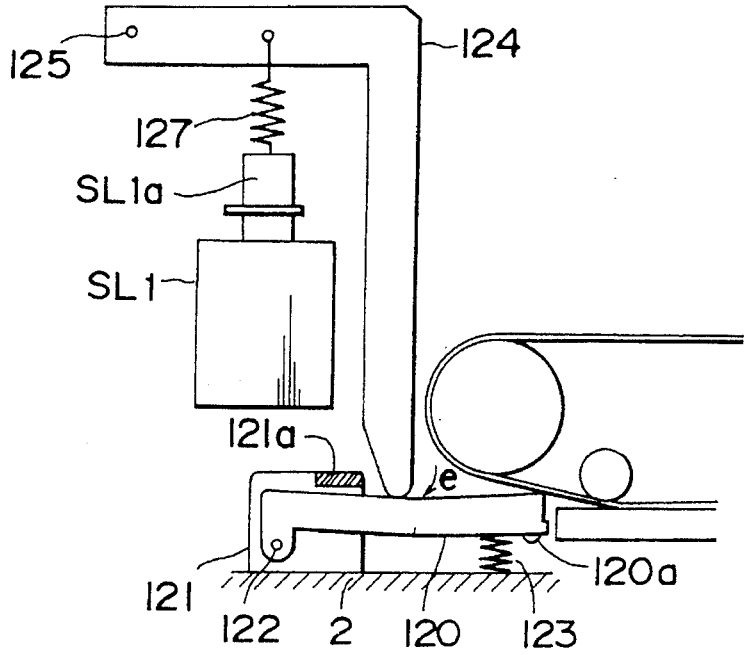
FIG. 9 is a side view showing a second embodiment of the scale pressing mechanism.

FIG. 9 illustrates another embodiment of the mechanism for pressing the scale 120. In this embodiment, the scale 120 is biased upward by the spring 123 into contact with the belt 95, and position-restricted with its front-end surface protruded from the upper surface of the glass platen 29. The lever 124 is disposed inside the ADF 60, and held rotatably on the shaft 125, with its generally center portion coupled with the plunger SL1*a* of the solenoid SL1 via the stroke-absorbing spring 127. With the solenoid SL1 off, the front end of the lever 124 is brought into contact with the scale 120 by the moment due to the dead weight of the lever 124 and the plunger SL1*a*; where it is arranged that the scale 120 will not be pressed down. In this mechanism, with the solenoid SL1 switched to the on state, the plunger SL1*a* descends so that the lever 124 rotates clockwise about the shaft 125 and is positioned as the scale descent positioning protrusion 120*a* is brought into contact with the upper-surface frame 2 and the front end portion of the scale is lowered slightly below the glass platen 29. At this time point, the plunger SL1*a* has not been attracted completely. However, the amount of subsequent travel of the plunger SL1*a* is absorbed into the extension and deformation of the stroke-absorbing spring 127.

<Third Embodiment of Scale Pressing Mechanism>

FIG. 10 illustrates another embodiment of the scale pressing mechanism. In this embodiment, the scale 120 is biased upward by the spring 123 into contact with the belt 95, with its front-end surface is protruded from the upper surface of the glass platen 29. The lever 124 has at its one end a shaft 125, which is engaged with a long hole 612 extending vertically of a rib 611 fixed to an inner frame 610 of the ADF 60. The lever 124 is also biased upward by being coupled with the stroke-absorbing spring 127 whose one end is fixed to the inner frame 610. The plunger SL1*a* of the solenoid SL1 is coupled with the generally center portion of the lever 124, and it is arranged that with the solenoid SL1 off, the free end of the lever 124 is brought into contact with the scale 120, where the scale 120 will not be pressed down. In this mechanism, when the solenoid SL1 is switched to the on state, the lever 124 rotates clockwise with the plunger SL1*a* descending, thereby pressing down the scale 120. The scale stops with the scale descent positioning protrusion 120*a* in contact with the upper-surface frame 2. At this time point, the stroke of the solenoid SL1 has an unreached portion left, the subsequent movement of the plunger SL1*a* being absorbed by the stroke-absorbing spring 127 and the downward movement of the long hole 612 of the shaft 125.

In addition, regardless of the above-described embodiment, the driving source may alternatively be a rotary solenoid or a motor. The driving force transfer means may be composed of a material and shape having flexibility itself, and may have a torque limiter type absorbing mechanism using frictional force or magnetic force may be employed.

Now explained the function of the cut portion 120*e* provided at the front end portion of the scale 120. In the ADF 60, as described before, a plurality of document sheets fed to between the separating roller 75 and the separating pad 80 based on the feeding function of the pickup roller 65 are separated one by one by the separating function of the separating roller 75 and the separating pad 80. In this process, there occurs a slip between the document sheet under feed toward the glass platen 29 and the separating pad 80 and yet the separating pad 80 is composed of a material having a relatively high coefficient of friction. As a result, there is generated paper dust or powder of chipped document images (images with poorly fixed prints or images particularly such as of copied document or hand-written document) at portions of the document which make contact with the separating pad 80. The resultant powder adheres to the document or temporarily adheres to the separating pad 80 to then adhere subsequent document sheets. Similarly, when the separated document sheet passes the separating pad 80 based on the drive by the register roller 90, paper dust adheres to it as well. When the paper dust or the like adhering to the document is brought into contact with portions of high contact pressure or large contact angles to the document, such as the front end portions of a resin film 133 (see FIG. 2) and the scale 120, the paper dust adhering onto the document is scraped off such that the glass platen 29 may be dirtied or that the powder may fall inside the copying machine body 1 through the gap between the glass platen 29 and the upper-surface frame 2, causing the optical system or the chargers to be dirtied with the result of deterioration in the image quality. Thus, on the front end portions of the scale 120 and the resin film 133, cut portions 120*e* and 133*a*, respectively, are provided so as to be positioned on a line of the separating roller 75 extended in the document conveying direction. Therefore, the paper dust on the document adhering onto the contact portion with the separating pad 80 will never be scraped off by the resin film 133 or the scale 120, whereby the above problems are solved.

In addition, although a movable scale has been employed for the ADF of the present embodiment, the case is the same also with a stationary scale. As the paper separating system, although a separating pad has been employed, yet the case is the same also with other various types of systems such as a reverse roller system. Furthermore, if paper dust or the like is generated at the register roller and the reverse roller, a cut portion may be provided at its corresponding site.

Meanwhile, the ADF may also be arranged so that the conveying unit of the glass platen is implemented by components other than the belt, such as rollers. Also, similar advantages can be obtained by such an arrangement that copying is done while the document is being passed on a fixed image reader at a constant speed.

<Document Feed Section>

Figure 12:
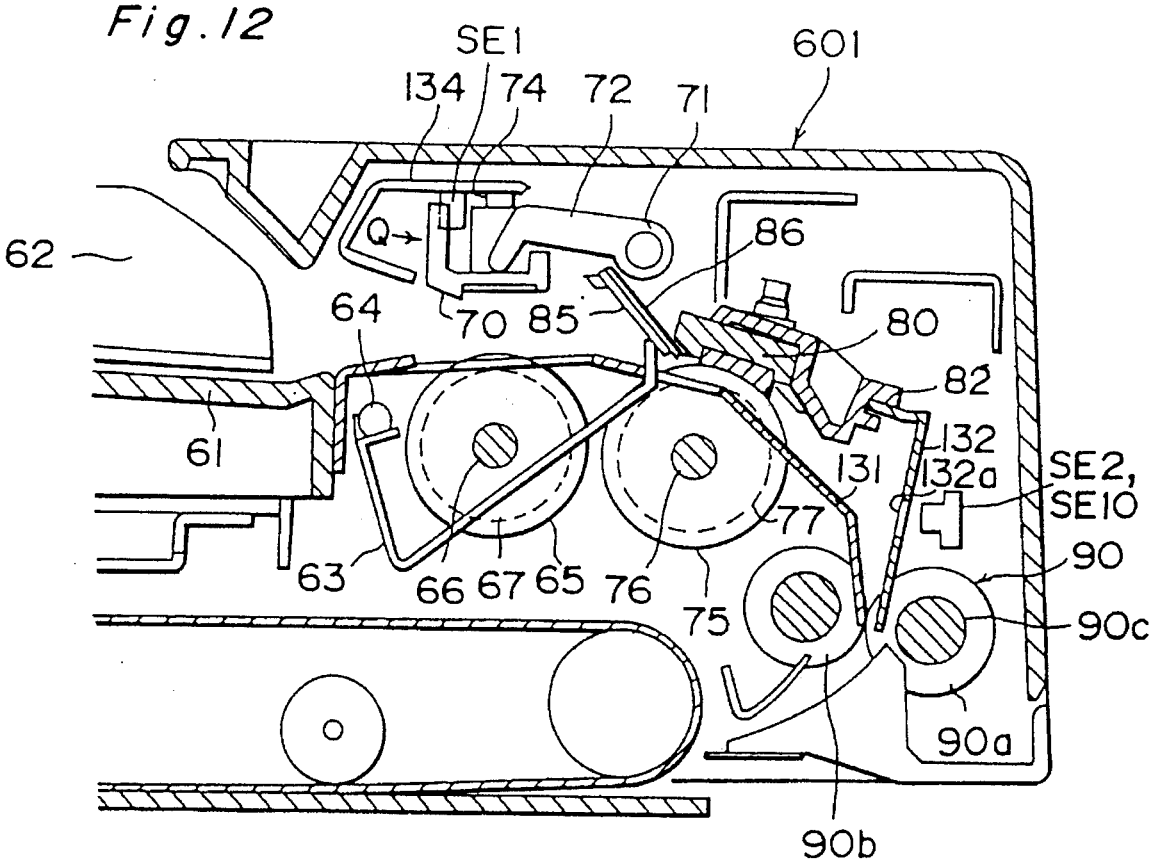
FIG. 12 is a sectional view of the document feed section in the ADF.

The document feed section 601 is now explained. Referring to FIG. 12, a document guide plate 131 is provided so as to extend from a front end of the tray 61 at a level slightly lower than the upper portions of the pickup roller 65 and the separating roller 75, with the front end extended to the register roller 90. Another document guide plate 132 is provided so as to extend from above the separating roller 75 to downstream of the register roller 90. The front-end restricting plate 63 is provided below the document guide plate 131 as it is fixed to the shaft 64, and is movable between a restricting position (shown in the figure) where the front end is protruded from the document guide plate 131 and a withdrawal position where the front end is withdrawn below the guide plate 131. Normally, the front-end restricting plate 63 is set to the restricting position, where the front-end restricting plate 63 receives the front end of the document set to the tray 61 so as to give the operator a setup feeling, while the front-end restricting plate 63 also functions to properly align the front end of the document. This front-end restricting plate 63 withdraws below the guide plate 131 when a document feed start signal is issued, and will be held in this withdrawal position until the last document sheet is fed.

Figure 13:
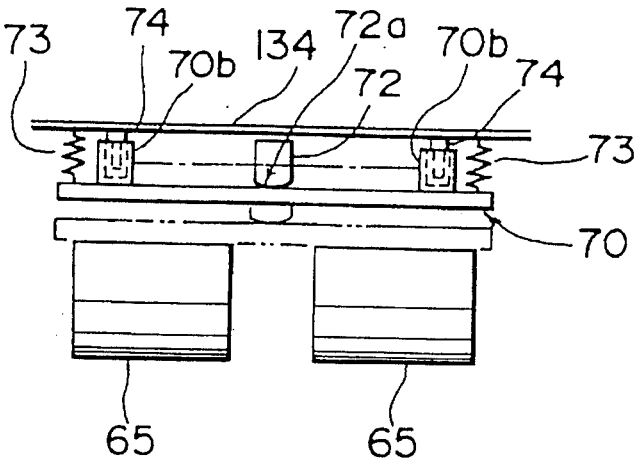
FIG. 13 is a front view showing a state that the pressing plate is pressed in the document feed section.
Figure 14:
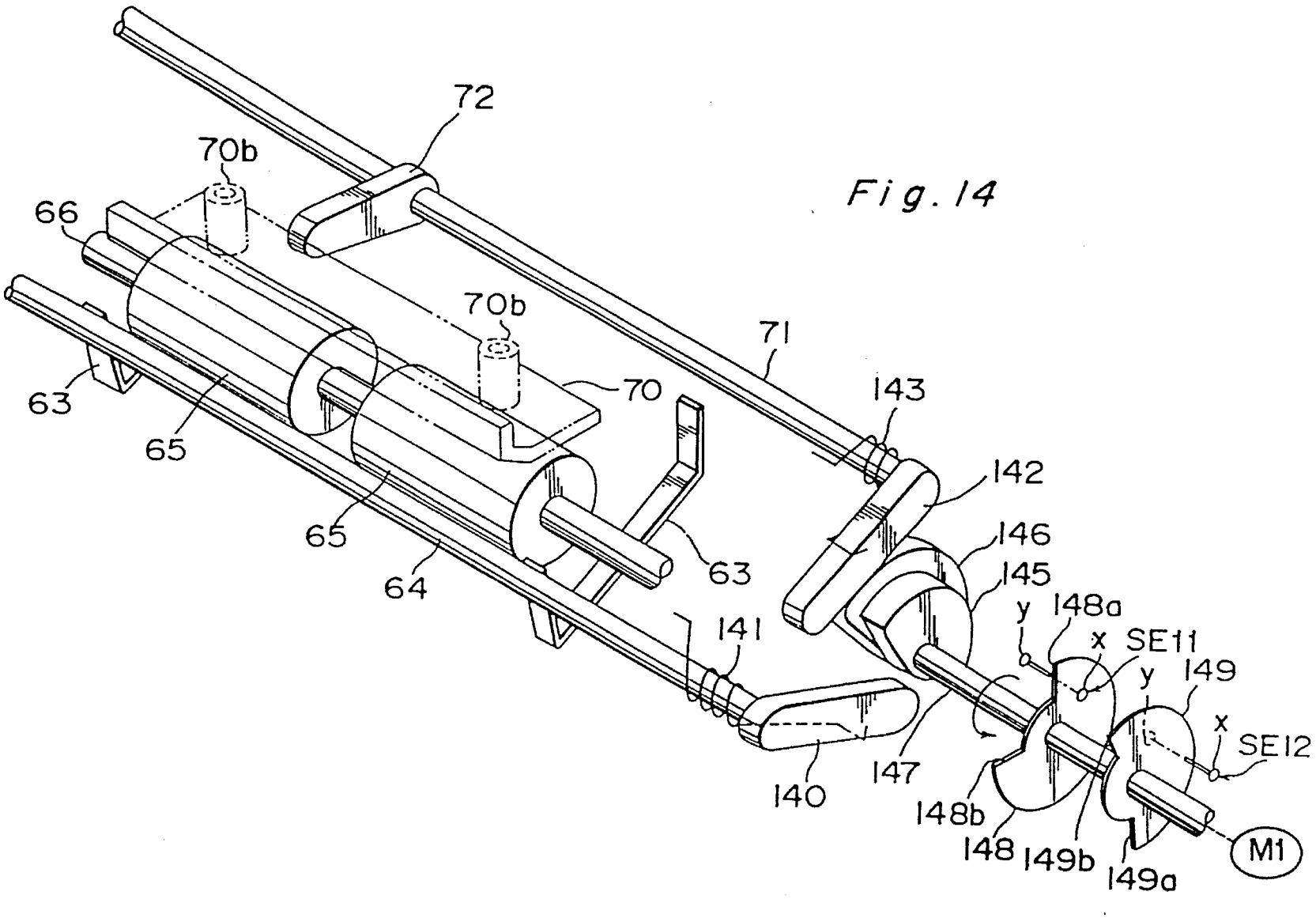
FIG. 14 is a perspective view showing the driving mechanism for the front-end restricting plate and the pressing plate in the document feed section.

The document pressing plate 70 is provided above the pickup roller 65, and is arranged as shown in FIG. 13 so that a plurality of guide sleeves 70*b* provided to the document pressing plate 70 can be inserted into guide pins 74 fixed to a guide plate 134, whereby the plate is capable of moving up and down, and coming into and out of contact with the pickup roller 65. The document pressing plate 70 also has tensile coil springs 73 each one end of which is coupled with a corresponding one of both ends of the document pressing plate 70, and the other end of which is coupled with the guide plate 134, in which arrangement the document pressing plate 70 is normally biased upward. A lever 72 is fixed to the shaft 71 as shown in FIG. 14, rotatable on the shaft 71. The shaft 71, reciprocatable by a rotation driving means shown in FIG. 14, normally holds the lever 72 positioned in a solid-line position, whereas the shaft 71 is urged to rotate counter-clockwise in the paper feed operation, thereby biasing the document pressing plate 70 toward the pickup roller 65, so that the fed document is pressed against the pickup roller 65 with a specified pressure. The document pressing plate 70 is moved in parallel with and vertically to the pickup roller 65 in order to implement a reliable paper-separating function by attaining a constant angle at which the document rushes in between a pre-separating plate 85 and a separating roller 75, regardless of the number of document sheets as well as the thickness thereof. Also, as shown in FIG. 13, the document pressing plate 70 is so arranged that the guide sleeves **70*b* and the guide pins 74 are engaged with each other with a clearance therebetween, and that a pressing surface 72*a* of the lever 72 is formed of a spherical surface, which spherical surface is in contact with a rear surface of the document pressing plate 70. This arrangement allows the document pressing plate 70 to come into parallel contact with the two feed rollers 65** and to apply pressure evenly thereto, whereby the document can be prevented from any skew.

A frictional force $\mu 1$ between the separating roller 75 and the document, a frictional force $\mu 2$ between the separating pad 80 and the document, and a frictional force $\mu 3$ between to document are so set that $\mu 1 > \mu 2 > \mu 3$. By this setting, out of a few document sheets fed together by the pickup roller 65, only the lowest-layer one sheet is allowed to pass through between the separating roller 75 and the separating pad 80.

Furthermore, as shown in FIG. 12, the pre-separating plate 85 and an elastic sheet 86 stuck thereonto are provided immediately before the separating pad 80. The pre-separating plate 85 is provided on a down slope which descends from upward of the front-end restricting plate 63 in the paper feed direction, the lower end of the pre-separating plate 85 being in close proximity to the surface of the separating roller 75 with a slight clearance immediately before the separating pad 80. The lower end of the elastic sheet 86 is in close proximity to the surface of the separating roller 75 with an even slighter clearance therebetween. A plurality of document sheets fed together by the pickup roller 65 are brought, at their front ends, into contact with the pre-separating plate 85, where the lower-layer the document sheet is, the more forward it goes on, so that only one or two document sheets will pass by the lower end of the pre-separating plate 85. The elastic sheet 86 serves as an aid for the pre-separating function of the pre-separating plate 85. In FIG. 12, reference numeral **132*a* denotes a detection hole for detecting the document sheet under conveyance between the guide plates 131 and 132 by the sensors SE2 and SE10**.

<Drive Mechanism for Front-End Restricting Plate 63 and Pressing Plate 70>

The drive mechanism for the front-end restricting plate 63 and the pressing plate 70 is now described. Referring to FIG. 14, the shaft 64 to which the front-end restricting plate 63 is fixedly secured has a lever 140 integrally fixed to its one end and normally biased counter-clockwise by a torsion spring 141. The front-end restricting plate 63 is set by this biasing force to a restricting position where it is protruded from the guide plate 131. The shaft 71 to which the lever 72 of the pressing plate 70 has a lever 142 integrally fixed to its one end and normally biased counterclockwise. By this biasing force, the pressing plate 70 elastically presses the document onto the pickup roller 65.

Fan-shaped cam plates 145, 146 are disposed between the levers 140, 142 and a shaft 147 for the cam plates 145, 146 is coupled with a pickup motor M1 which is rotatable forward and reverse. The lever 140 is opposed to the outer circumferential surface of the cam plate 145, while the lever 142 is opposed to the outer circumferential surface of the cam plate 146. The levers 140, 142 are rotated based on the forward/reverse rotation of the cam plates 145, 146, whereby the positions of the front-end restricting plate 63 and the document pressing plate 70 are set. Discs 148, 149 are fixed to the cam shaft 147 and cutout edges **148*a*, 148*b*, 149*a*, 149*b* of these discs 148, 149 pass optical axes of photosensors SE11, SE12 (light-emitting element x, light-emitting element y) of transmission type. By on/off operations of the photosensors SE11, SE12 based on the above arrangement, the rotation of the cam plates 145, 146** is controlled.

Figure 15:
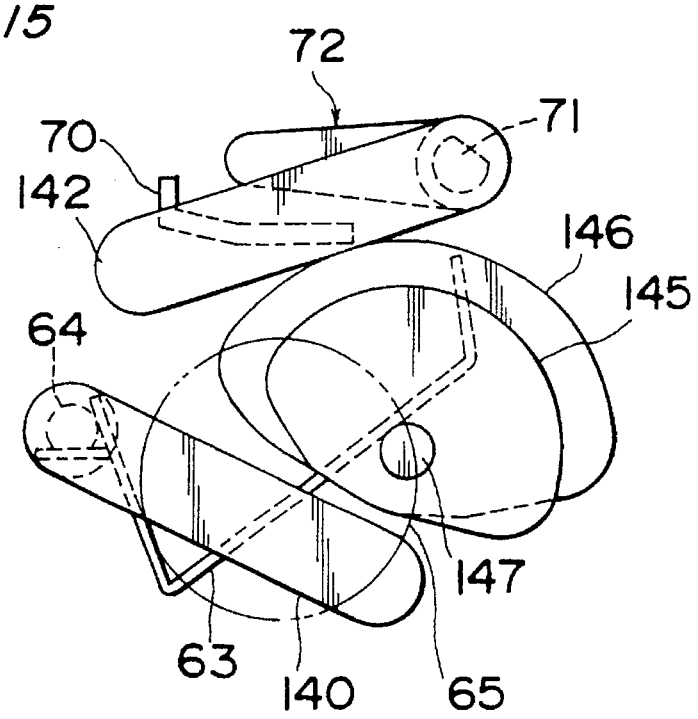
FIG. 15 is an explanatory view of a state in which the front-end restricting plate as shown in FIG. 14 is in the. restricting position and the pressing plate is in a non-pressing position.
Figure 17:
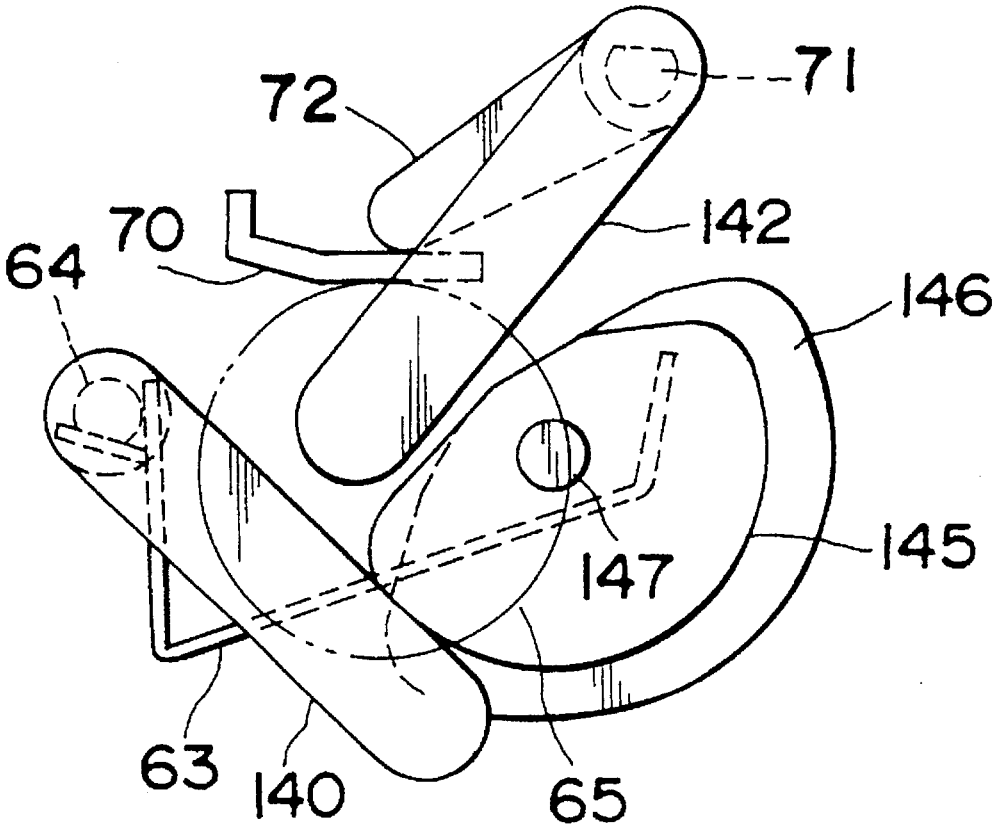
FIG. 17 is an explanatory view of a state in which the front-end restricting plate as shown in FIG. 14 is in a non-restricting position and the pressing plate is in the pressing position.

More specifically, with the ADF 60 in the standby state, the levers 140, 142 and the cam plates 145, 146 are in a position as shown in FIG. 15 (home position), where the front-end restricting plate 63 is set at the restricting position and the pressing plate 70 is set at the withdrawn position. After the power is turned on, the pickup motor M1 is driven to rotate reverse, so that the cam plates 145, 146 and the discs 148, 149 rotate reverse, in the clockwise direction, along with the shaft 147. Immediately after the reverse rotation, the sensor SE11 detects the edge **148*a* of the disc 148, turning off, whereby the home positions of the cam plates 145, 146 are verified and the pickup motor M1 is temporarily turned off. When a document replacement signal is issued thereafter, the pickup motor M1 is rotated reverse so that the cam plates 145, 146 are rotated clockwise, where the sensor SE12 detects the edge 149*b* of the disc 149, turning off. As a result of this, the pickup motor M1 is turned off but stops at a more or less overrun position as shown in FIG. 17. At this point, the lever 142 is separated from the larger diameter portion of the cam plate 146, rotating downward by a spring force of a torsion spring 143. Meanwhile, the lever 72 rotates so that the pressing plate 70 vertically moves downward to press the front end portion of the document against the pickup roller 65, imparting a paper feed pressure. Also, the lever 140 comes into contact with the larger diameter portion of the cam plate 145 so that the front-end restricting plate 63 rotates downward, withdrawing below the guide plate 131**.

Figure 16:
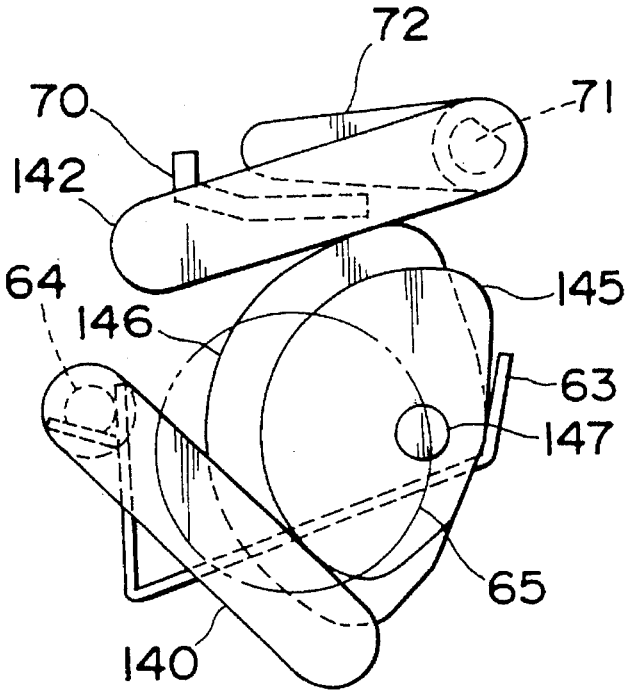
FIG. 16 is an explanatory view of a state in which the front-end restricting plate as shown in FIG. 14 is in a non-restricting position and the pressing plate is in a non-pressing position.

In this state, the pickup roller 65 and the separating roller 75 are driven to rotate, whereby the first-sheet document is fed. When the front end of the document fed has reached the register roller 90, the pickup motor M1 is driven to rotate reverse. As a result, the cam plates 145, 146 rotate reverse, in the clockwise direction, so that the sensor SE12 is turned on by the edge **149*a* of the disc 149, whereby the pickup motor M1 is turned off. At this point, the levers 140, 142 are such that the front-end restricting plate 63 is held in the standby position and the pressing plate 70 withdraws upward, releasing the press against the document, as shown in FIG. 16**.

For the second and following document sheets, the pickup motor M1 is driven to rotate forward so that the cam plates 145, 146 rotate forward, in the counterclockwise direction. Then the sensor SE11 detects the edge **148*b* of the disc 148, whereby the pickup motor M1 is turned off but stops at a more or less overrun position as shown in FIG. 17. Thereafter, as in the foregoing case, the pickup roller 65 and the separating roller 75 are driven to rotate, whereby the second and following document sheets are fed. When the front end of the document fed has reached the register roller 90, the pickup motor M1 is driven to rotate reverse, returning to the press-releasing position as shown in FIG. 16**.

Figure 18:
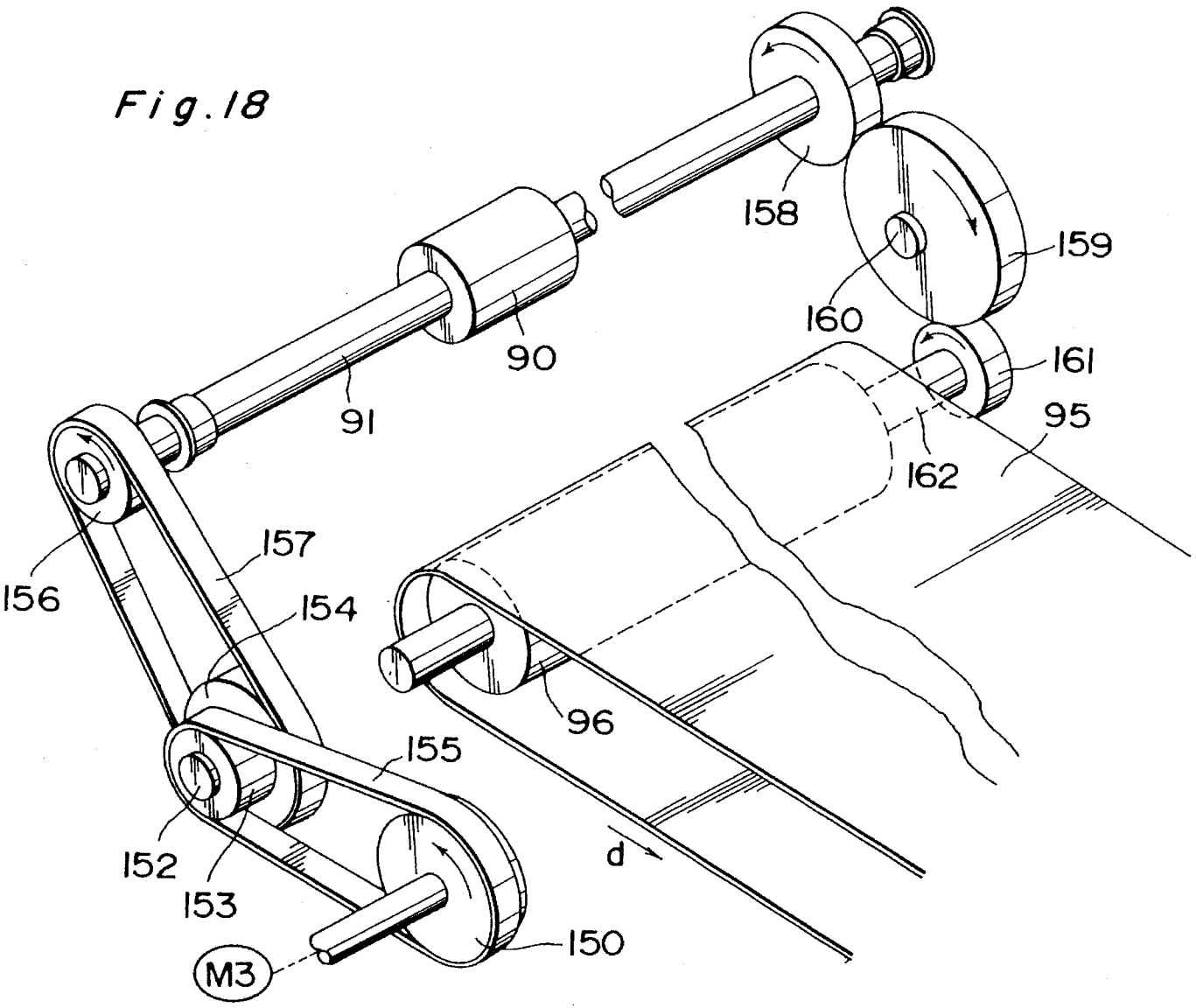
FIG. 18 is a perspective view showing the drive mechanism for the register roller and the conveyor belt.

As described above, by the pickup motor M1 being operated, the rotational angle can be minimized whether the document is pressed from the home position (FIGS. 15 to 17) or from the press-releasing position (FIGS. 17 and 18). Also, in order that the cam plates 145, 146 will not shift due to the overrun of the pickup motor M1, the sensor position and the disc are so designed that when the pickup motor M1 is driven to rotate reverse, the edge 149*b* of the disc 149 will be detected by the sensor SE12 slightly earlier than the edge 148*b* of the disc 148 will be detected by the sensor SE11, and that when the pickup motor M1 is driven conversely to rotate forward, the edge 148*b* of the disc 148 will be detected by the sensor SE11 slightly earlier than the edge 149*b* of the disc 149 will be detected by the sensor SE12.

Consequently, in the present embodiment, the drive mechanism for the front-end restricting plate 63 and the pressing plate 70 is simplified with a single system, and yet there will occur no noise at the time of drive because the cam plates 145, 146 are used for the drive. Besides, the front-end restricting plate 63 will be held in the withdrawal position for a full duration from start to end of the paper feed operation, thus the document being free from any damage or skew. Furthermore, the pressing plate 70 will press the document only while the front end portion of the document is passing the separating roller 75, and thereafter will withdraw upward. As a result, the possibility that misfeed such as double-sheet feed may occur is eliminated.

<Register Roller>

Now the register roller 90 is explained. Referring to FIG. 12, the register roller 90 temporarily receives at its nip portion the front end of the document fed by the rotation of the pickup roller 65 and the separating roller 75, thereby correcting any skew of the document by making its front end aligned. In a specified time after the front end of the document fed is detected by the sensor SE2, a feed motor M2 is turned off, causing the pickup roller 65 and the separating roller 75 to be stopped rotating. At this time point, the front end portion of the document comes into contact with the nip portion of the register roller 90, forming a slight loop.

After that, the register roller 90 is driven to rotate by a main motor M3 being turned on at a timing coincident with the copying operation of the copying machine main body 1, feeding out the document to the entrance of the glass platen 29. Like this, in the present embodiment, the pickup roller 65 and the separating roller 75 are driven by the feed motor M2 while the register roller 90 as well as the conveyor belt 95 are driven by the main motor M3, independently of each other. Besides, one-way clutches 67, 77 are provided between the pickup roller 65 and its drive shaft 66 and between the separating roller 75 and its drive shaft 76, respectively. Thus, it is arranged that even when the feed motor M2 is in the off state, the pickup roller 65 and the separating roller 75 can idly rotate clockwise when the document is fed out by the register roller 90.

Now the register roller 90 and the conveyor belt 95 are explained. As shown in FIG. 18, a timing belt 155 is stretched between an output pulley 150 provided on the output shaft of the main motor M3 and a pulley 153 rotatably supported on a shaft fixed to an unshown frame. A timing belt 157 is stretched between a pulley 154 integrated with the pulley 153 and a pulley 156 fixed to a shaft 91 of the register roller 90. A gear 158 is fixed to the other end of the shaft 91 of the register roller 90. The gear 158 is engaged with a gear 159 rotatably supported by a shaft 160 fixed to an unshown frame, and further the gear 159 is engaged with a gear 161 fixed to a shaft 162 of the driving roller 96. With this arrangement, when the main motor M3 rotates in an arrow direction, the register roller 90 and the driving roller 96 rotate in the same direction while the conveyor belt 95 moves in a direction "d" Also, the main motor M3, which is rotatable both forward and reverse, can convey the document temporarily in a direction reverse to the direction "d" in the two-in-one mode or both-sides mode.

<Arrangement of Register Roller 90, Feed Roller 65, and Separating Roller 75>

Figure 19:
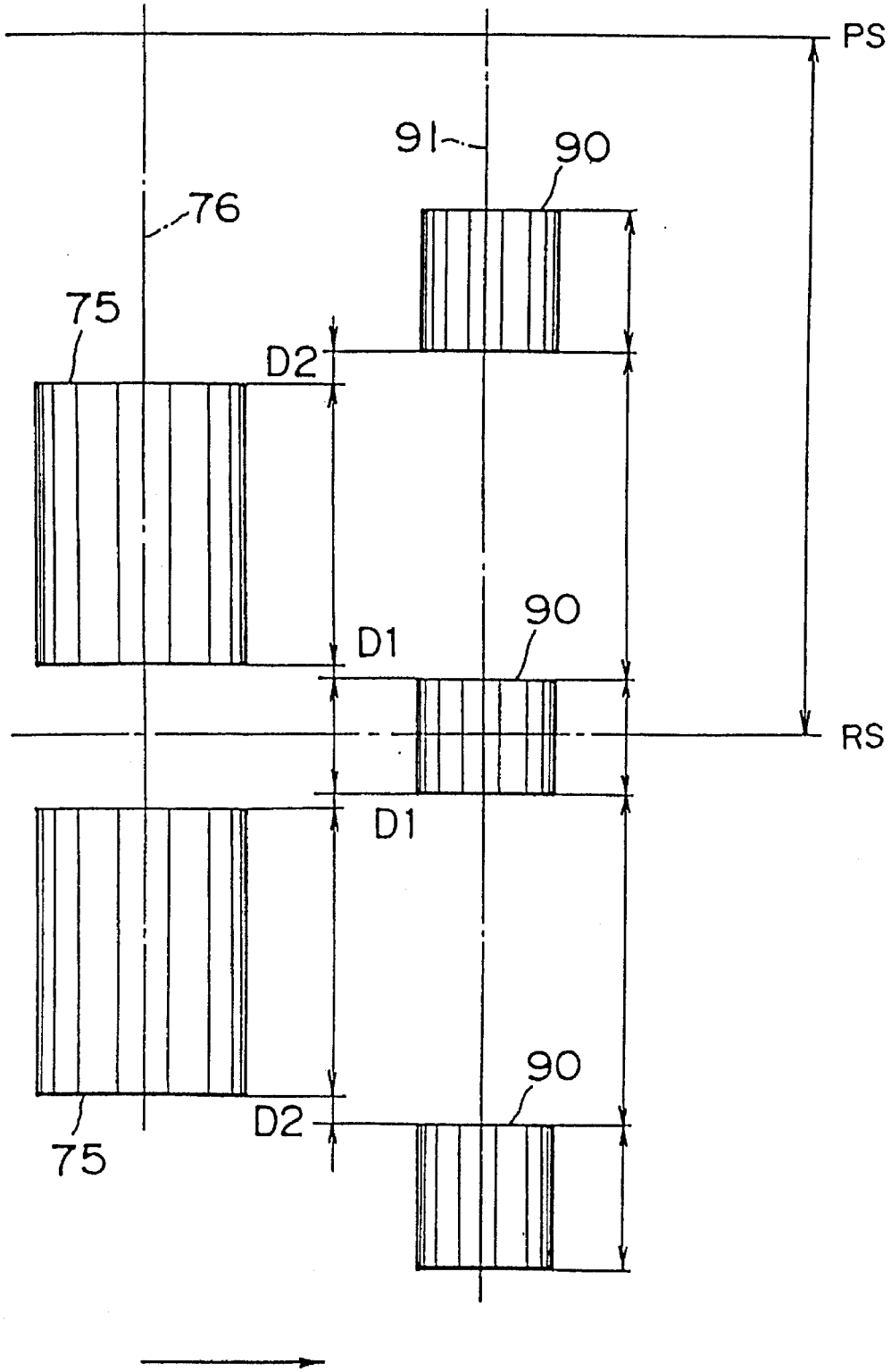
FIG. 19 is an explanatory view of the planar positional relation between the register roller and the separating roller.

The arrangement relation among the register roller 90, the feed roller 65, and the separating roller 75 is described with reference to FIG. 19. The ADF 60 of the present embodiment is provided with a paper standard PS on a back side of the copying machine, i.e., a side opposite to the operational side. The register roller 90 and the separating roller 75 are arranged symmetrically with respect to a roller arrangement standard RS. This is intended to prevent the document from skewing due to the moment that may act when the document nipped between the separating roller 75 and the separating pad 80 is pulled out by the register roller 90. Also, the conveying force of the register roller 90, which is set substantially larger than that of the separating roller 75, prevents the document from slipping in the conveyance by the register roller 90. Furthermore, the separating roller 75 and the register roller 90 in the center are spaced from each other by a distance D1 while the separating rollers 75, 90 and the register roller 90 on both side are spaced from each other by a distance D2, with respect to a direction perpendicular to the document conveying direction. Accordingly, paper dust or the like generated at the pickup portion and the separating portion will never be transferred to the register roller 90, so that the conveying force of the register roller 90 is maintained constant. Moreover, the register roller 90 will never have adhesion of dirties, so that the document will never have dirties transferred from the register roller 90 thereonto.

<Mechanism for Opening and Closing the Document Feed Path of the Document Feed Section>

Figure 20:
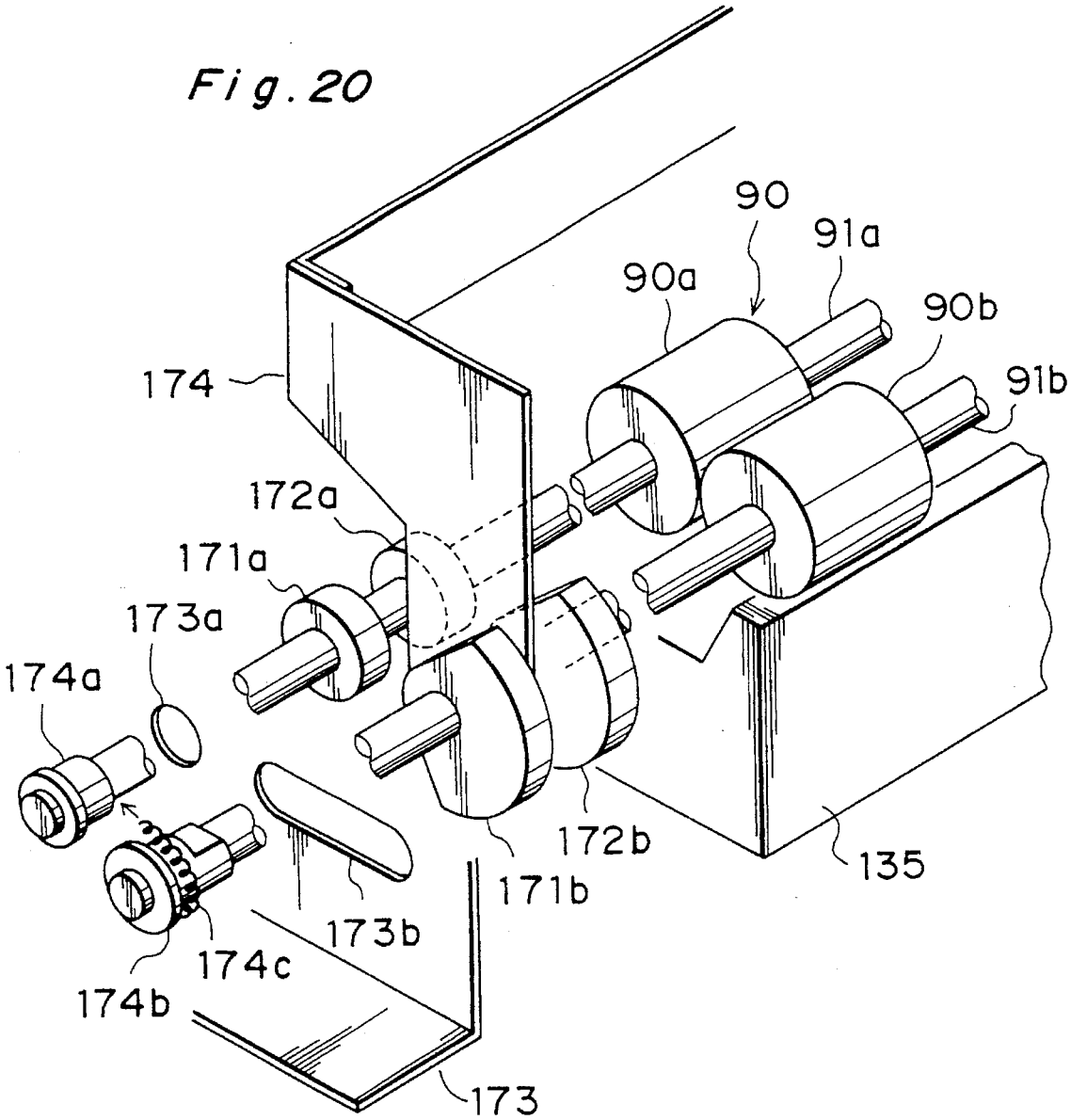
FIG. 20 is a perspective view of the support mechanism of the register roller and the paper-path opening/closing mechanism.

Referring to FIG. 20, a register driving roller 90*a*, which is one component of the register roller 90, is fixed to a shaft 91*a*. The shaft 91*a* is rotatably supported via bearings 174*a*, 174*a* by bearing holes 173*a*, 173*a* provided on a main frame 173 of the ADF 60, and coupled to the main motor M3 so as to be driven. Cams 171*a*, 172*a* are further provided to the shaft 91*a*. A register subordinate roller 90*b*, which is the other component of the register roller 90, is fixed to a shaft 91*b*. The shaft 91*b* is arranged in parallel with the shaft 91*a*, and supported via bearings 174*b*, 174*b* by long-hole shaped bearing holes 173*b*, 173*b* provided to the main frame 173 in such a way that the shaft 91*b* is rotatable and movable forward and backward. An eccentric cam 171*b* is rotatably provided on the eccentric cam 171*b*, a frame 174 for holding the opening/closing cover 604 for the document feed section 601 is fixed to the eccentric cam 171*b*, and a guide plate 135 for guiding the document that passed the register roller 90 onto the glass platen 29 is fixed to the eccentric cam 172*b*. Further, the shaft 91*b* is biased toward the shaft 91*a* by a biasing means such as springs 174*c*, 174*c* or the like.

Figure 21:
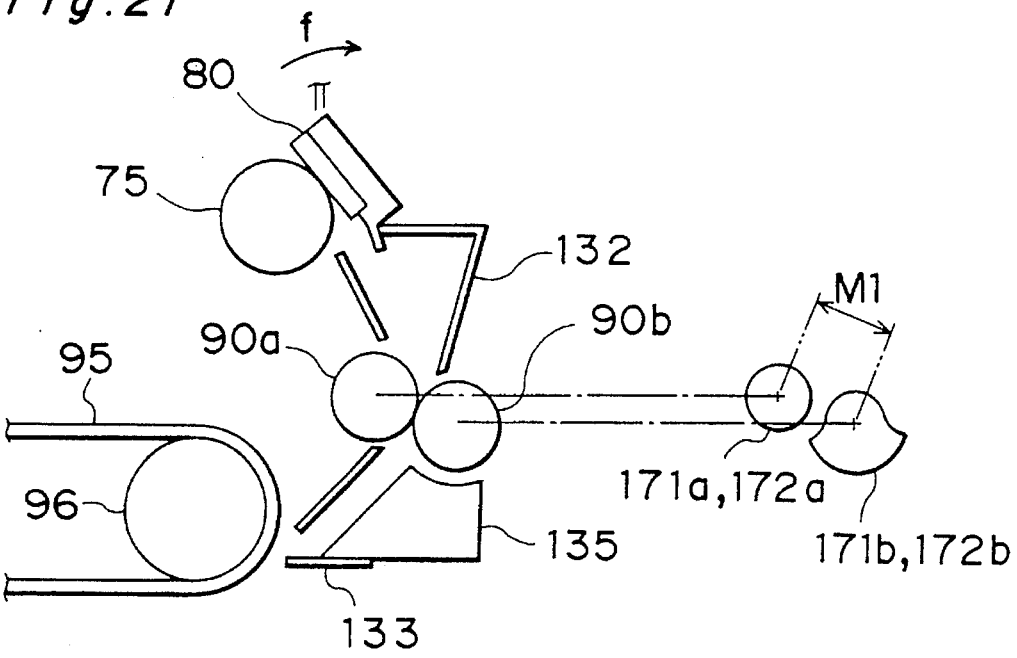
FIG. 21 is an explanatory view of the relation between the register roller and the cams in the paper-path opening/closing mechanism of FIG. 20.
Figure 22:
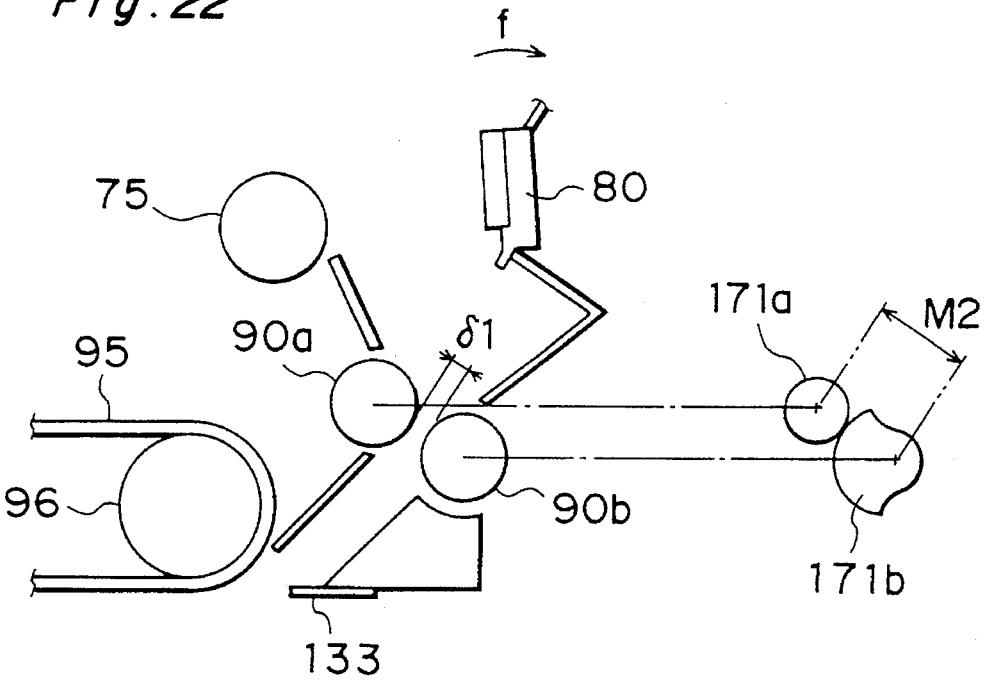
FIG. 22 is an operation explanatory view of the paper-path opening/closing mechanism of FIG. 20.
Figure 23:
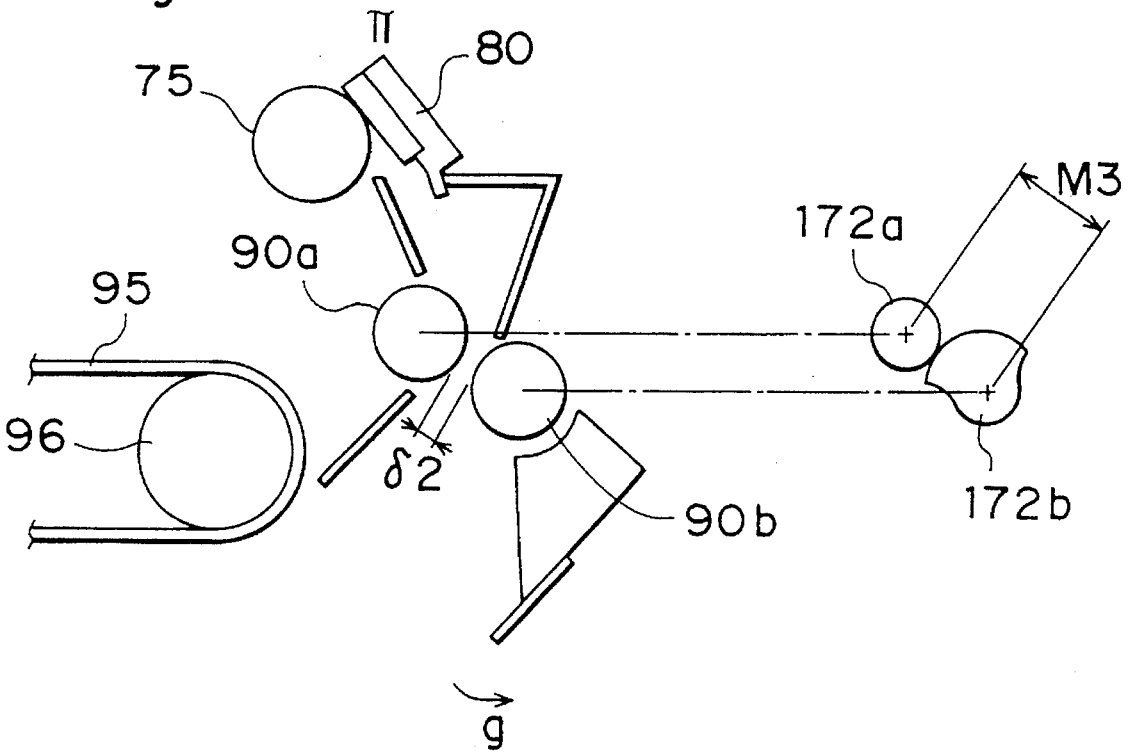
FIG. 23 is an operation explanatory view of the paper-path opening/closing mechanism of FIG. 20.

In the document feed section 601 having the above-described arrangement, in the normal state in which the cover 604 and the guide plate 135 are closed to the ADF 60, the register driving roller 90*a* and the register subordinate roller 90*b* are in press contact with each other as shown in FIG. 21. Meanwhile, the cams 171*a*, 172*a* are spaced away from the eccentric cams 171*b*, 172*b*, respectively, where their center spacing is set to M1. In this state, if the cover 604 is rotated in the direction of arrow "f", for example, in order to remove the document that has jammed in the paper feed path on the way from the separating section to the register section, the eccentric cam 171*b* rotates so that its outer circumferential portion is brought into contact with the cam 171*a*. Then, in this contact state, if the cover 604 is further rotated against the biasing force of the spring 174*c*, the center distance between the shaft 91*a* and the shaft 91*b* expands to M2 (>M1) such that the register subordinate roller 90*b* is, by distance δ1, separated away from the register driving roller 90*a* as shown in FIG. 22. Likewise, if the guide plate 135 is rotated in the direction of arrow "g" in order to remove the document that has jammed downstream of the register section as shown in FIG. 23, the eccentric cam 172*b* rotates so that its outer circumferential portion is brought into contact with the cam 172*a*. As a result, the center spacing between the shafts 91*a* and 91*b* expands to M3 (>M1), whereby the register subordinate roller 90*b* is, by distance δ2, separated away from the register driving roller 90*a*. In addition, the rollers 90*a*, 90*b* in many cases have their outer circumferential portions made of an elastic member such as rubber or sponge. With the use of such rollers, the rollers 90*a*, 90*b* do not need to be completely separated away from each other, but it is sufficient if the press contact force between them can be weakened so that the document nipped by them can be pulled out without being damaged. In this way, the document feed section 601 is so arranged that the register subordinate roller 90*b* is biased against the register driving roller 90*a* by the springs 174*c*, 174*c* while the cams 171*a*, 172*a* provided on the shaft 91*a* and the eccentric cams 171*b*, 172*b* fixed to the shaft 91*b* are engaged with each other based on the opening operation of the cover 604 and the guide plate 35, thereby releasing the register roller 90 from releasing. Accordingly, the press contact force between the rollers 90*a* and 90*b* can be set to be accurate uniformly over the axial direction and moreover maintained at proper level irrespectively of the mounting accuracy and locking force of the cover 604 and the like. Although the present embodiment has been so arranged that the register subordinate roller is withdrawn, yet the register driving roller may be withdrawn instead. Besides, another arrangement in which the rollers are reversed in the driving-and-subordinate relation is also applicable.

<Support Mechanism for the Cover>

Figure 24:
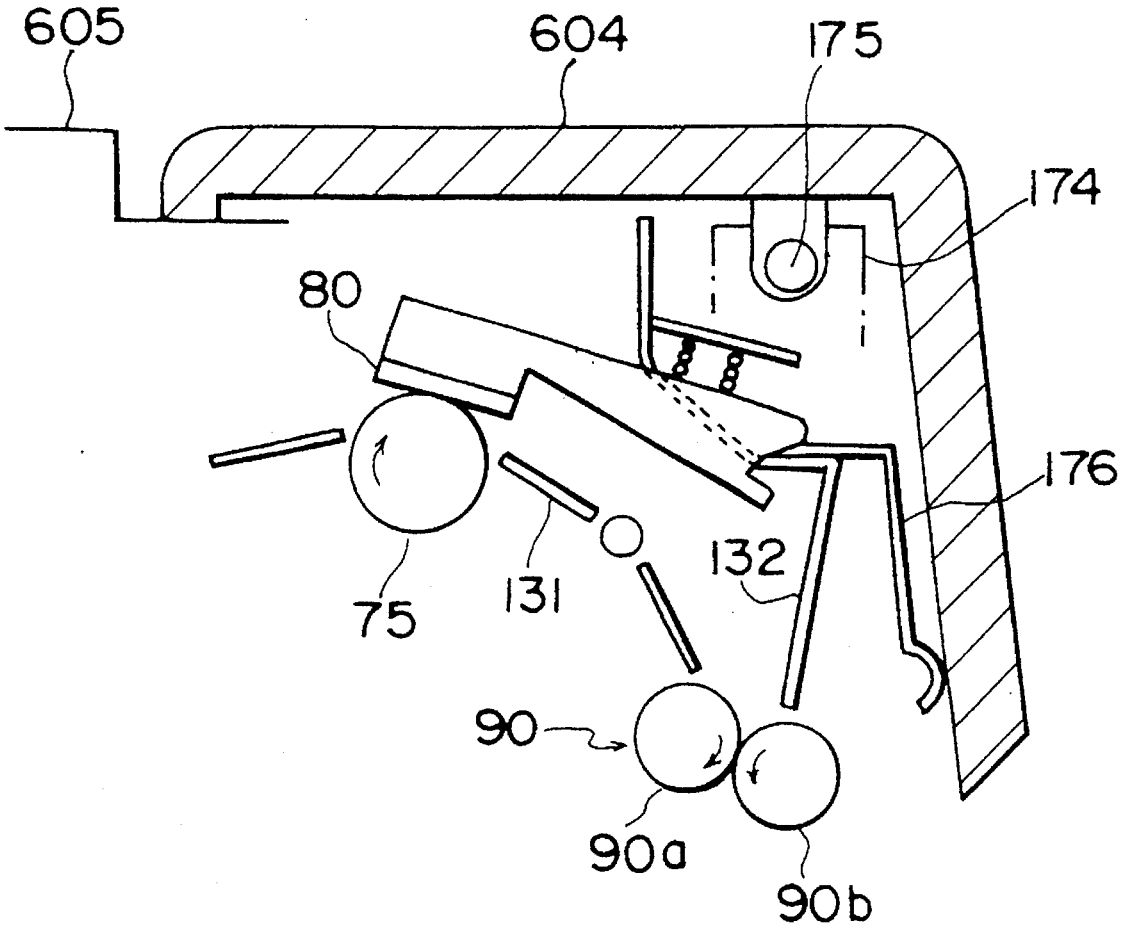
FIG. 24 is a schematic explanatory view of the mechanism that supports the cover of the document feed section.

The cover 604 is rotatably supported by the frame 174 via a shaft 175, as shown in FIG. 24. The frame 174 has the guide plate 132 fixed thereto, and the cover 604 is biased counterclockwise by a spring 176 provided to the document guide plate 132 or an elastic member such as sponge. Thus, with the cover 604 closed, the cover 604 is biased against the spring 176 so as to be positioned in contact with the document conveying section 605. Therefore, the separating pressure of the separating roller 75 and the separating pad 80 will never be affected by the action of external force, if any, due to the document or the like placed on the cover 604. Also, the separating pressure will never be affected by any force acting sideways onto the cover 604, because the movement of the cover 604 is absorbed by the spring 176. As a result, a stable separating pressure can be ensured at all times. Besides, the drive motor for the separating roller 75 will never be subject to excessive load.

<Document Conveying Modes of the ADF>

The document conveying modes of the ADF 60 are now explained. In the present embodiment, the document conveying modes include four modes of the prestep mode, the two-in-one mode, and the count mode in addition to the both-sides mode, which is a conventional practice, and further includes the scale mode suited for ordinary paper and the pulse control mode suited for thin paper, for the purpose of stopping the document conveyed by the ADF 60 at the exposure standard position SP. The selection between the scale mode and the pulse control mode is executed with a document selection key 105 provided on the control panel. Referring to the conveyance of the document, a position where the document is set with its front end registered at the exposure standard position SP is referred to as an exposure position, a position where the document is set with its front end registered at an intermediate position IP is referred to as a prestep position, and a position where the document is set with its front end registered at the nip position of the register roller 90 is referred to as a first-out position. In addition, the size of the document is here assumed so that the small size is A4 transverse, and the large size is A3 longitudinal, unless otherwise specified.

The scale mode is a mode in which the document that has been conveyed up by the conveyor belt 95 is forcedly stopped with its front end brought into contact with the scale 120. In this case, the solenoid SL1 is turned off. As a result, the front end of the scale 120 is protruded on the glass platen 29. The document D that has been conveyed up in the direction of arrow "d" by the conveyor belt 95 has its front end brought into contact with the scale 120. Then, a slip occurs between the document and the belt due to the arrangement that the conveying force of the conveyor belt 95 is set weaker than the buckling strength of the document, such that the document is stopped accurately at the standard position SP.

The pulse control mode is a mode in which, as will be described below, the register roller 90 and the conveyor belt 95 are driven by the single main motor (stepping motor) M3 so as to become equal to each other in the conveying speed, so that a document conveying length L (see FIG. 26) is accurately controlled. The document conveying length with respect to the number of drive pulses of the main motor M3 is previously known. Therefore, the position where the document is to be stopped is determined by driving the main motor M3 with a number of pulses corresponding to the length L over which the document on standby immediately before the register roller 90 is conveyed up to the standard position SP. For execution of this pulse control mode, the solenoid SL1 holds in the on state, while the scale 120 holds in the position where it has withdrawn downward from the upper surface of the glass platen 29.

In comparison between these scale mode and pulse control mode, the scale mode has an advantage of high stop-position accuracy based on the arrangement that the document is stopped by contact with the scale 120. However, when the document is a thin sheet, the buckling strength of the document is so small that a fold at its front end or a paper jam tends to occur, as a problem of the scale mode. The pulse control mode, although having an advantage of being free from any trouble in the stopping of the document even if the document is a thin one, yet is problematic in that the stop-position accuracy is not always as high as that in the scale mode, on account of a slippage of the document or some response shift of the drive mechanism.

Figure 25:
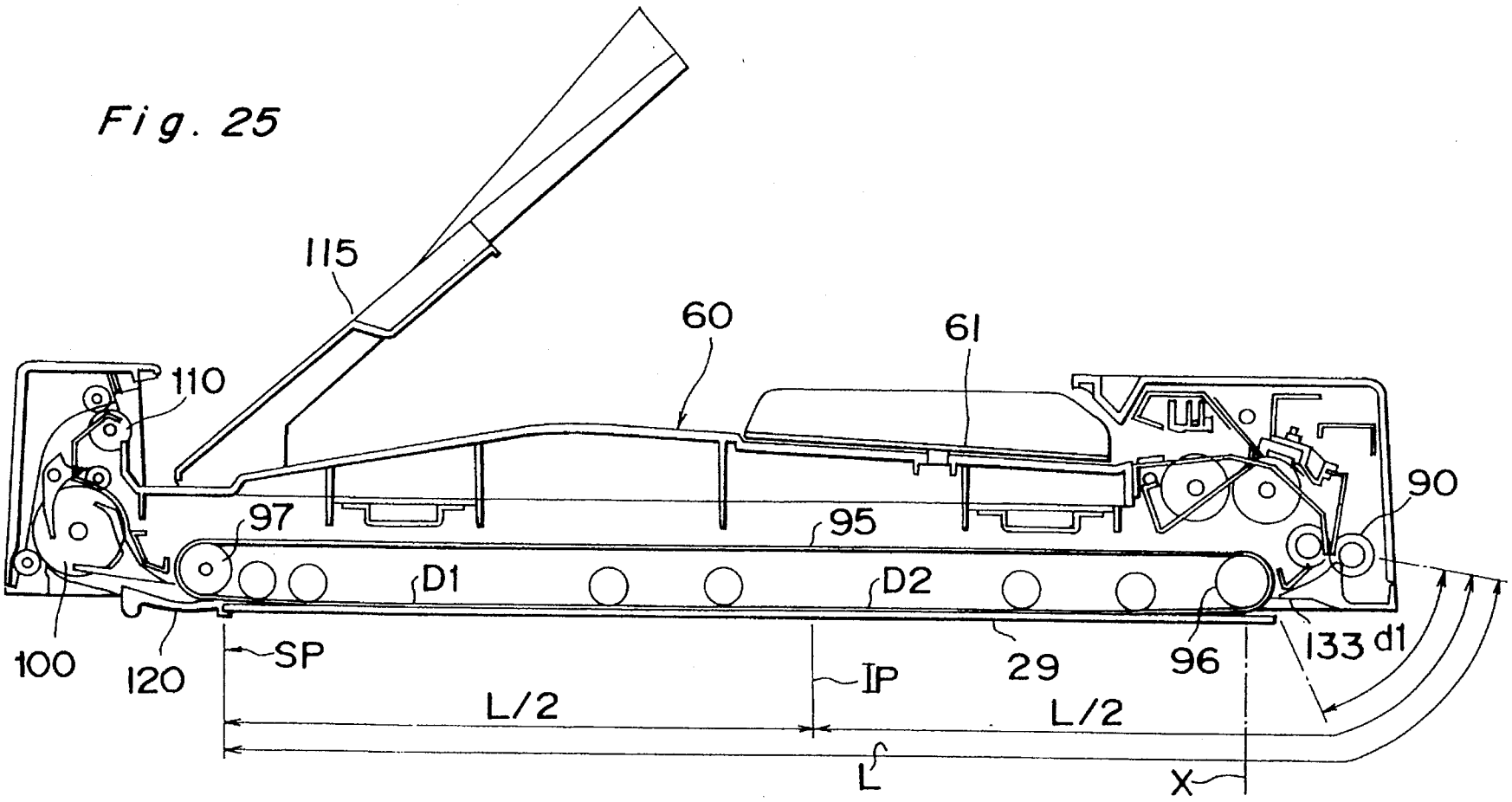
FIG. 25 is an explanatory view of document conveyance by the stepping motor, showing a case where the document is stopped in the pulse control mode.

The prestep mode is a mode in which when the document size is one half the length from the exposure standard position SP to the document first-out position (a position where the front end of the document is in contact with the register roller 90), a preceding document D1 is stopped with its front end registered with the exposure standard position SP and a succeeding document D2 is conveyed to a position where its front end is registered with the intermediate position IP, a succeeding (third-sheet) document sheet is first-out fed until its front end comes into contact with the register roller 90, as shown in FIG. 25. In this prestep mode, when it is combined with the pulse control mode, at replacement of the document, the main motor M3 is driven to rotate forward to an extent of pulse P02 so that the document is conveyed by a distance corresponding to ½ of the distance L from the register roller 90 to the standard position SP. That is, each time the first-sheet document D1 set at the exposure standard position SP has been finished in exposure, the main motor M3 is driven to rotate forward to an extent of pulse P02, so that the second-sheet document D2 is conveyed to the exposure standard position SP and that the third-sheet document having stood by at the register roller 90 is conveyed to the intermediate position IP.

Figure 26:
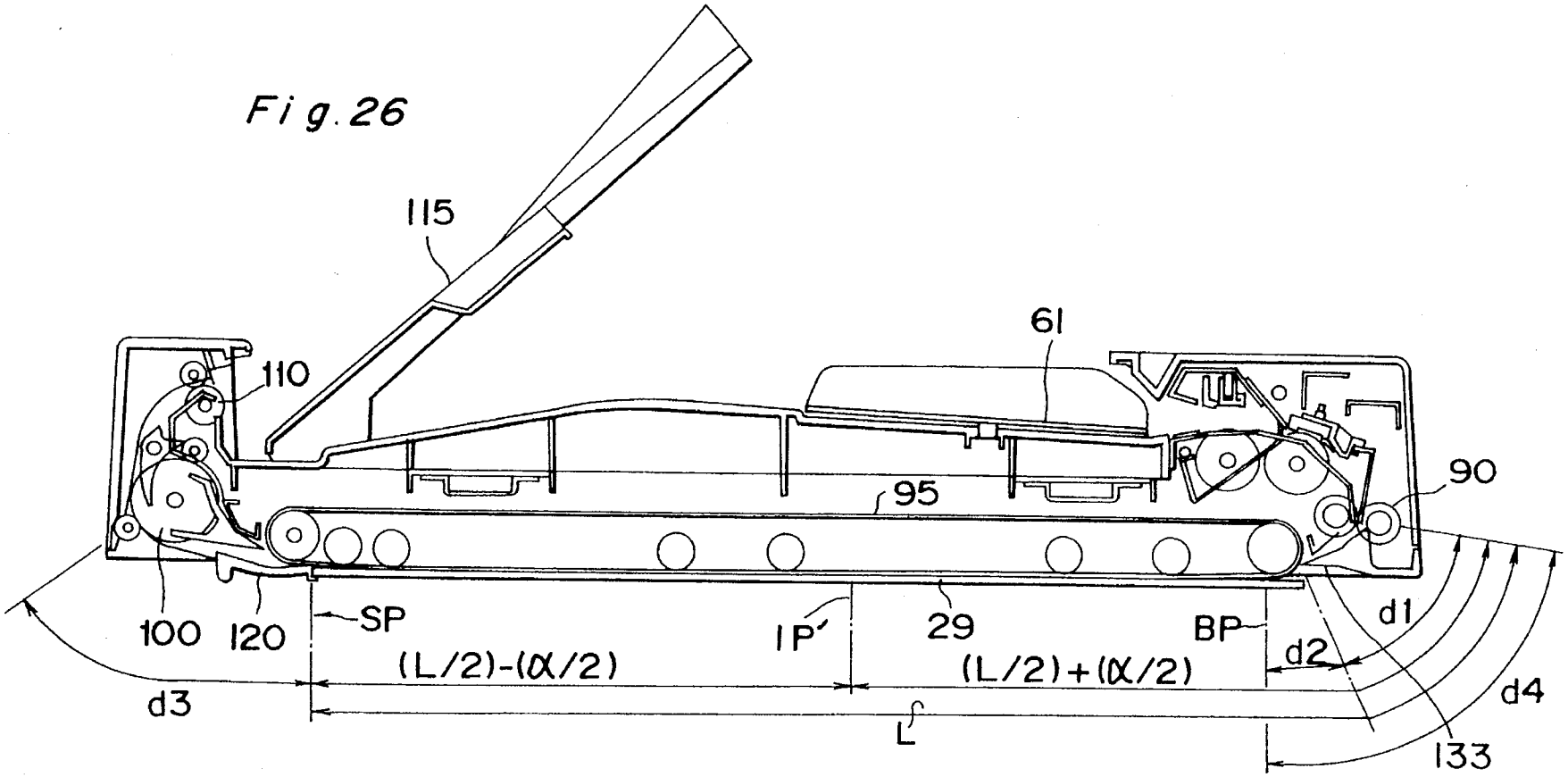
FIG. 26 is an explanatory view of document conveyance by the stepping motor, showing a case where the document is stopped in the scale mode.

Meanwhile, when the prestep mode is combined with the scale mode, at replacement of the document, the main motor M3 is driven to rotate forward to an extent of pulse P02' so that the document is conveyed by a distance corresponding to $(L/2)+(\alpha/2)$, as shown in FIG. 26, where $\alpha$ represents such an extent of overrun that the front end of the document is securely put into contact with the scale 120. Accordingly, the second-sheet document D2 stands by at an intermediate position IP' where the document has been conveyed to an extent of $(L/2)+(\alpha/2)$ from the register roller 90. This second-sheet document D2, which is to be conveyed by the conveyor belt 95 to an extent of $(L/2)+(\alpha/2)$ from the intermediate position IP', is stopped at the exposure standard position SP with its front end coming into contact with the scale 120 at a time point when the document has been conveyed by an extent of $(L/2)-(\alpha/2)$. This means that the conveyor belt 95 has slipped by the distance $\alpha$ with respect to the document.

In the scale mode as described above, normally, the solenoid SL1 is kept off and the scale 120 is protruding upward from the upper surface of the glass platen 29. The solenoid SL1 is turned on immediately before the document passes the exposure standard position SP, whereby the scale 120 is withdrawn to below the platen glass 29.

<Prestep Mode>

Figure 27:
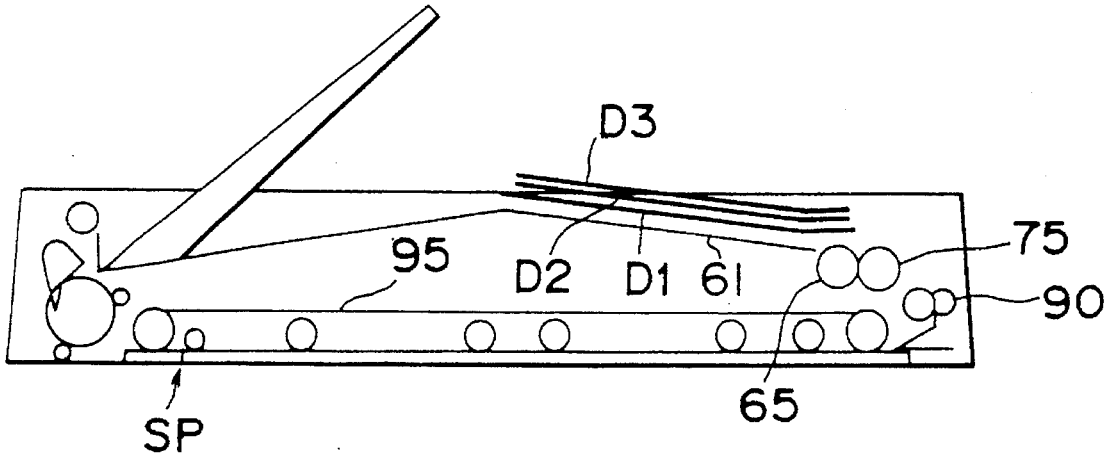
FIG. 27 is an explanatory view of document conveyance in the prestep mode.
Figure 28:
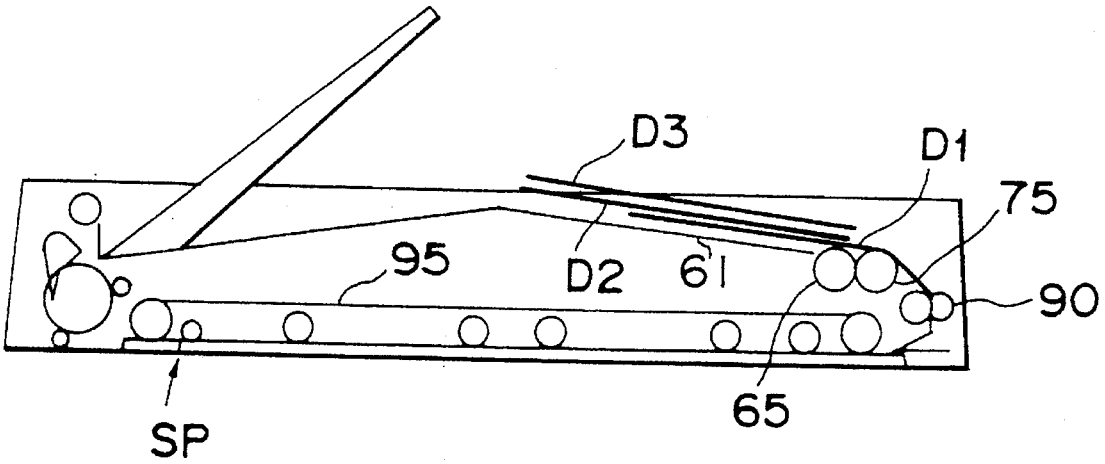
FIG. 28 is an explanatory view of document conveyance in the prestep mode subsequent to FIG. 27.
Figure 29:
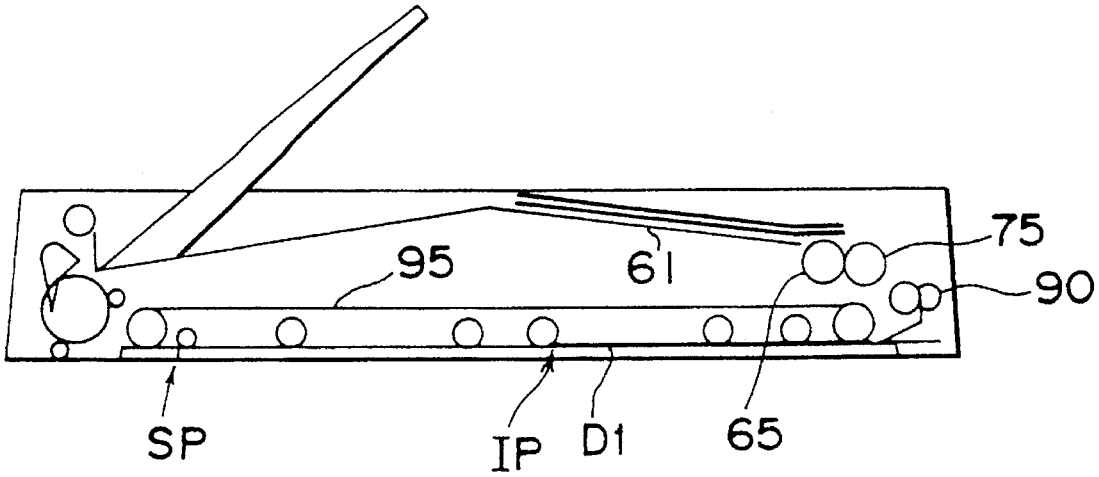
FIG. 29 is an explanatory view of document conveyance in the prestep mode subsequent to FIG. 28.
Figure 30:
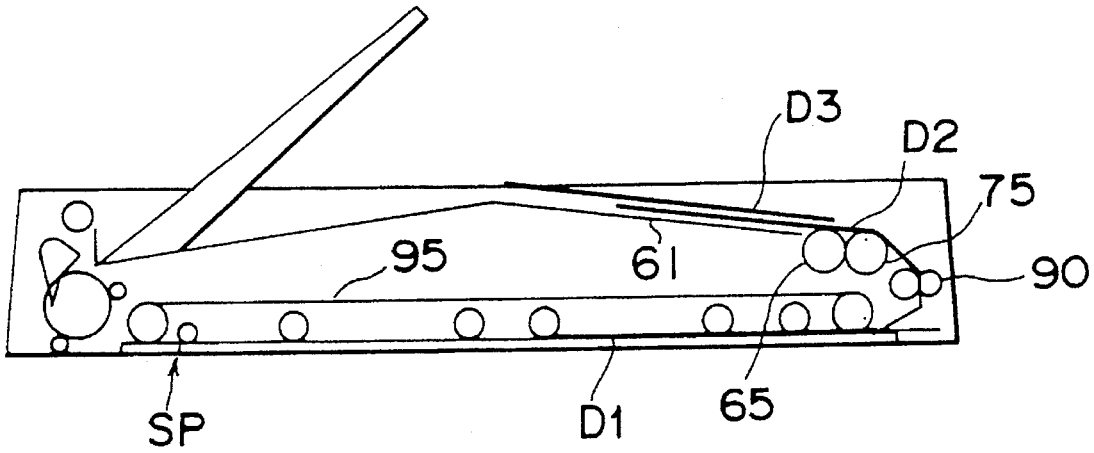
FIG. 30 is an explanatory view of document conveyance in the prestep mode subsequent to FIG. 29.
Figure 31:
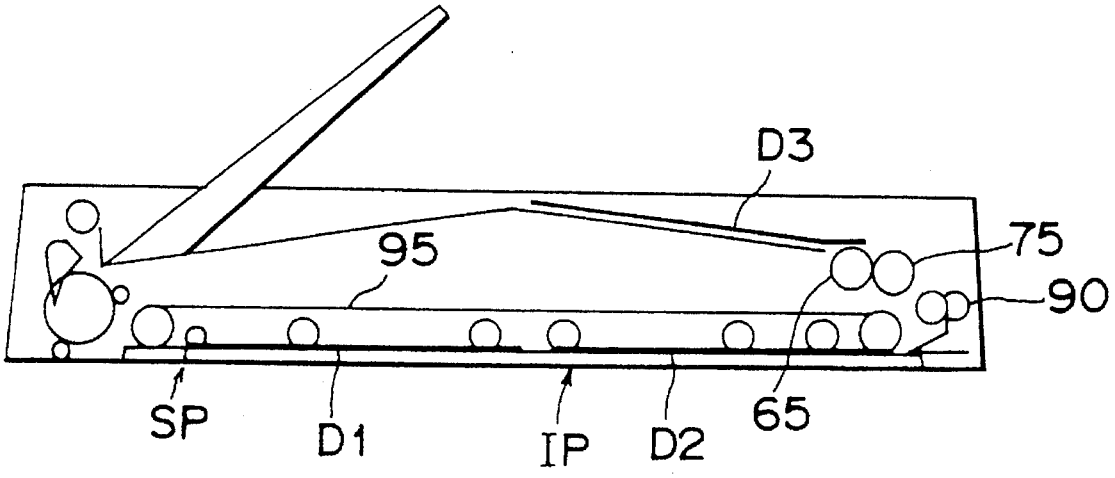
FIG. 31 is an explanatory view of document conveyance in the prestep mode subsequent to FIG. 30.
Figure 32:
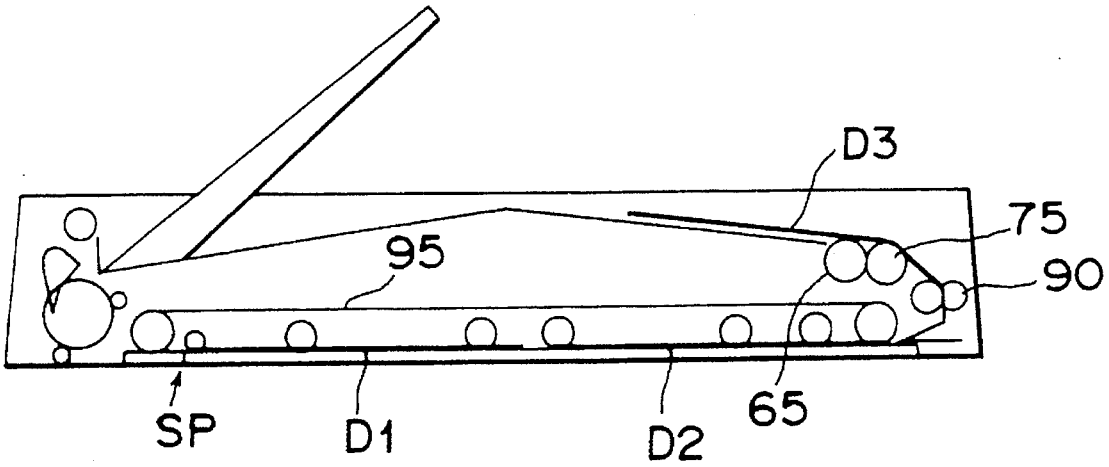
FIG. 32 is an explanatory view of document conveyance in the prestep mode subsequent to FIG. 31.
Figure 33:
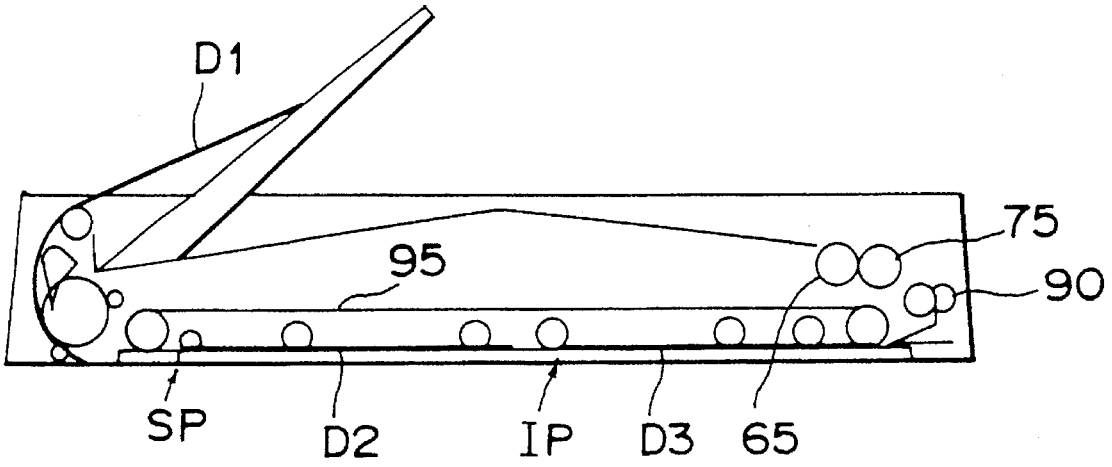
FIG. 33 is an explanatory view of document conveyance in the prestep mode subsequent to FIG. 32.
Figure 34:
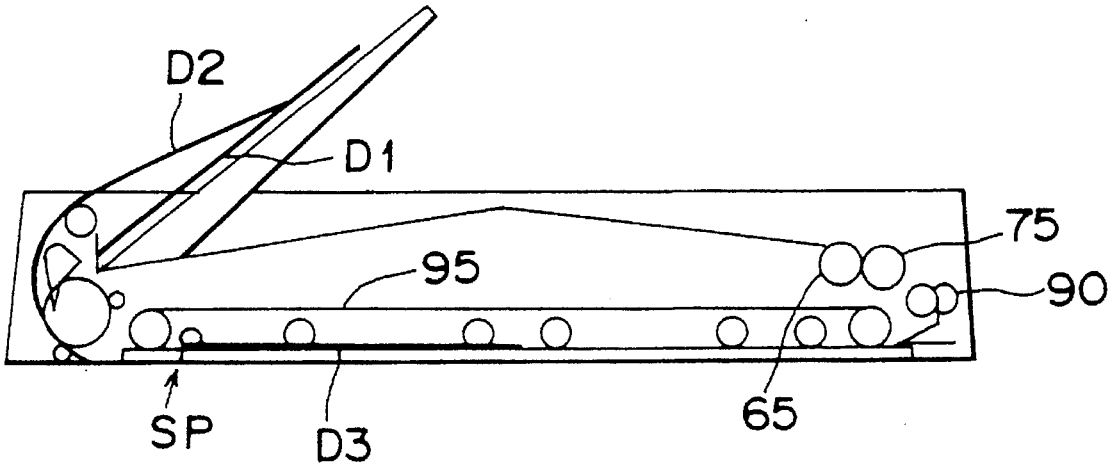
FIG. 34 is an explanatory view of document conveyance in the prestep mode subsequent to FIG. 33.
Figure 35:
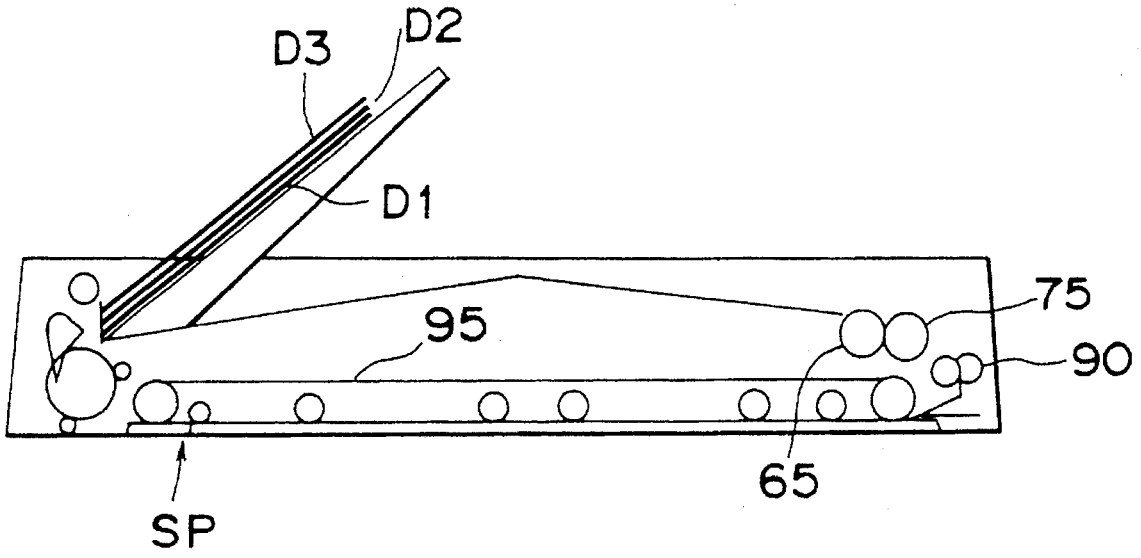
FIG. 35 is an explanatory view of document conveyance in the prestep mode subsequent to FIG. 34.

FIGS. 27 through 35 illustrate the document conveying state in the prestep mode. FIG. 27 shows a state that the document is set on the tray 61, where it is assumed that three sheets of small-size document D1, D2, and D3 are set. First, the front-end restricting plate 63 withdraws below, the pressing plate 70 moves downward, and the pickup roller 65 and the separating roller 75 are driven to rotate, whereby the first-sheet document D1 is fed, standing by with its front end in contact with the register roller 90 (see FIG. 28). Next, the main motor M3 is driven to rotate forward by an extent of pulse P02, so that the document D1 is conveyed up to the intermediate position IP (see FIG. 29). Next, the pickup roller 65 and the separating roller 75 are driven to rotate, so that the second-sheet document D2 comes to stand by at the register roller 90 (see FIG. 30). Further, the main motor M3 is driven to rotate forward by an extent of pulse P02, so that the first-sheet document D1 is conveyed to the exposure standard position SP while the document D2 is conveyed to the intermediate position IP (see FIG. 31). In this state, in the copying machine 1, the process of feeding copying paper and the process of exposure by the optical system 20 are performed in a number of times corresponding to a set copy number. During the exposure process, the third-sheet document D3 is first-out fed to the register roller 90 (see FIG. 32).

Upon completion of the exposure process on the document D1, the main motor M3 is driven to rotate to an extent of pulse P02, while the discharge motor M4 is driven so that the reverse roller 100 and the discharge roller 110 rotate. As a result, the document D1 is discharged onto the tray 115 while the document D2 is conveyed to the exposure standard position SP and the document D3 is conveyed to the intermediate position IP (see FIG. 33). In this state, the document D2 is subjected to exposure. Upon completion of the exposure, the main motor M3 is driven to rotate forward by an extent of pulse P02 so that the discharge motor M4 is also driven. Accordingly, the document D2 is discharged out onto the tray 115, and the document D3 is conveyed to the exposure standard position SP (see FIG. 34). After the exposure on the document D3, the main motor M3 and the discharge motor M4 are driven so that the document D3 is discharged onto the tray 115 (see FIG. 35).

In the present embodiment, when the first-out fed document is fed onto the platen glass 29 by the register roller 90 and the rear end of the document is detected by the register sensor SE2, the empty sensor SE1 is checked, where if the document remains on the tray 61, it is first-out feed, and if there is no document, the front-end restricting plate 63 is returned to the upward restricting position.

Now the positional relation among the register roller 90, the resin film 133, and the prestep position IP is explained with reference to FIG. 25. Whereas the conveyor belt 95 is driven by the driving roller 96, even if the driving roller 96 is stopped being driven and fixed by the brake, the subordinate roller 97 progresses further due to its inertia and a delay of transfer of the driving force of the conveyor belt 95 and then attempts to return to the original position where a relation between tense and loose sides that has occurred during the driving operation is balanced, thus causing the document on the glass platen 29 to be moved to a slight extent. In the copying machine of the present embodiment, the document moves on the glass platen 29 toward the upstream in the document conveying direction.

For this purpose, the ADF 60 of the present embodiment is provided with a resin film 133 at the belt conveying section. If the document length is dp and the distance from the nip of the register roller 90 to the front end of the resin film 133 is d1, then in the case where $L/2-d1 \approx dp$, the document to be stopped at the prestep position IP would interfere with the resin film 133 at the rear end. Also, if a small skew has taken place during the registered conveyance, only part of the rear end of the document would interfere with the resin film 133, further deteriorating the skew state. For this reason, the ADF 60 of the present embodiment is set to a relation that $L/2-d1<dp$, thus having resolved any possible disturbances in the document stopped state due to interference with the resin film 133. Further, if the return extent of the conveyor belt 95 is $\beta$, then the same functional effects can be obtained also by achieving a relation that $L/2-d1-\beta>dp$. Still, in the scale mode, the lengths involved may properly be set so as to meet the relations that $L/2-\alpha/2-d1<dp$ and that $L/2-\alpha/2-d1-\beta>dp$. In addition, although the nip position of the register roller 90 has been assumed to be the first-out position in the present embodiment, it may also be arranged that the document is positioned by a sensor or the like or restricted by a stopper gate.

As described above, in the prestep mode, the document is fed out in steps of (L/2), and therefore the document replacement time needs only to be such a short time that the document can be replaced with another within a time during which the optical system 20 returns to the home position upon the completion of exposure. Thus, the copy productivity is improved. Yet, the succeeding-sheet (third-sheet) document is first-out fed until its front end comes into contact with the register roller 90. This first-out paper feeding process is executed during the exposure of the preceding-sheet document, contributing to improvement in the copy productivity.

Also, as shown in FIG. 18, it has been arranged that the register roller 90 and the conveyor belt 95 are driven by the single main motor M3 without intervening a clutch, and that the main motor M3 is pulse-driven as a stepping motor. Thus, the document to be fed out from the register roller 90 can be accurately conveyed to or stopped at the standard position SP by controlling the number of pulses fed to the motor M3. In addition, even if the motor M3 is not a stepping motor, similar advantages can be obtained also by such an arrangement in which an encoder is attached to the rotating shaft and the motor M3 is controlled for its turning on and off with the number of its rotations converted into the number of pulses.

<Two-in-one Mode>

Figure 36:
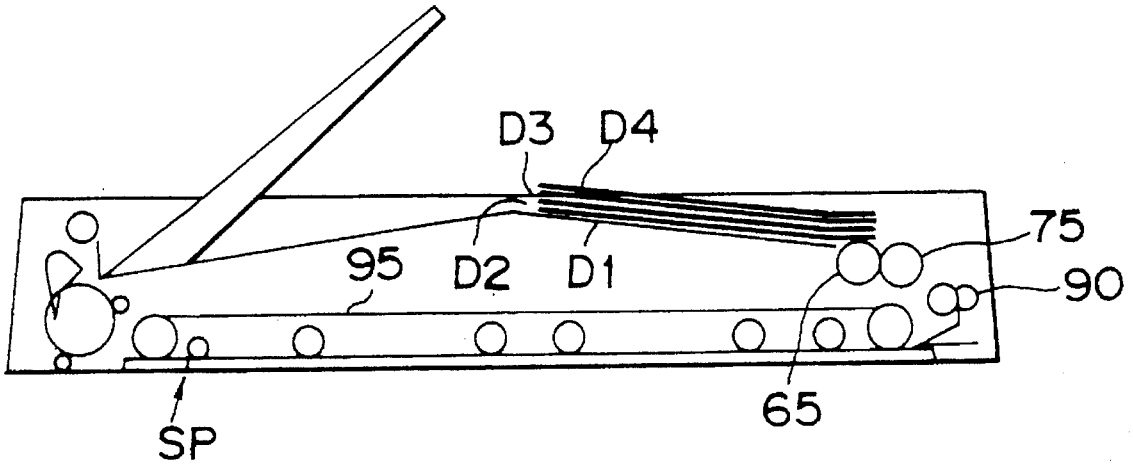
FIG. 36 is an explanatory view of document conveyance an the two-in-one mode.
Figure 37:
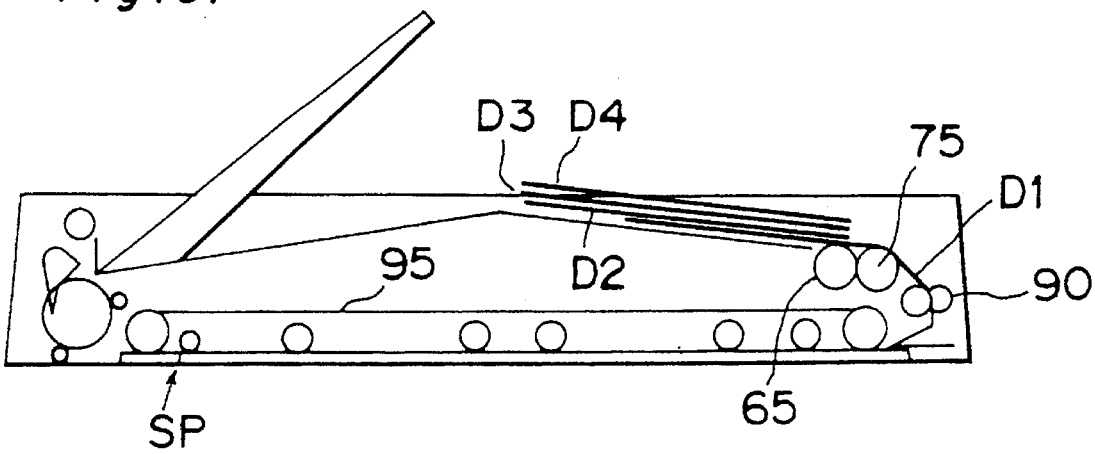
FIG. 37 is an explanatory view of document conveyance an the two-in-one mode subsequent to FIG. 36.
Figure 38:
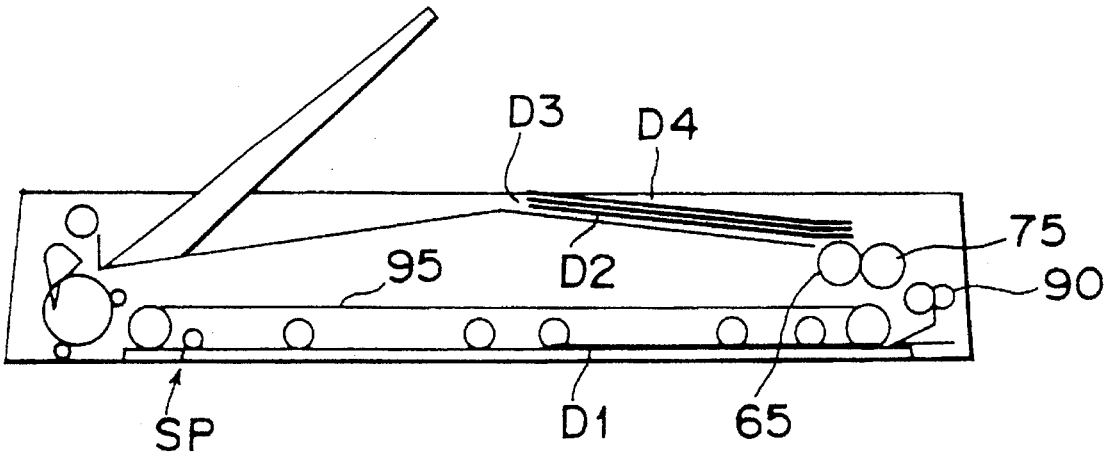
FIG. 38 is an explanatory view of document conveyance an the two-in-one mode subsequent to FIG. 37.
Figure 39:
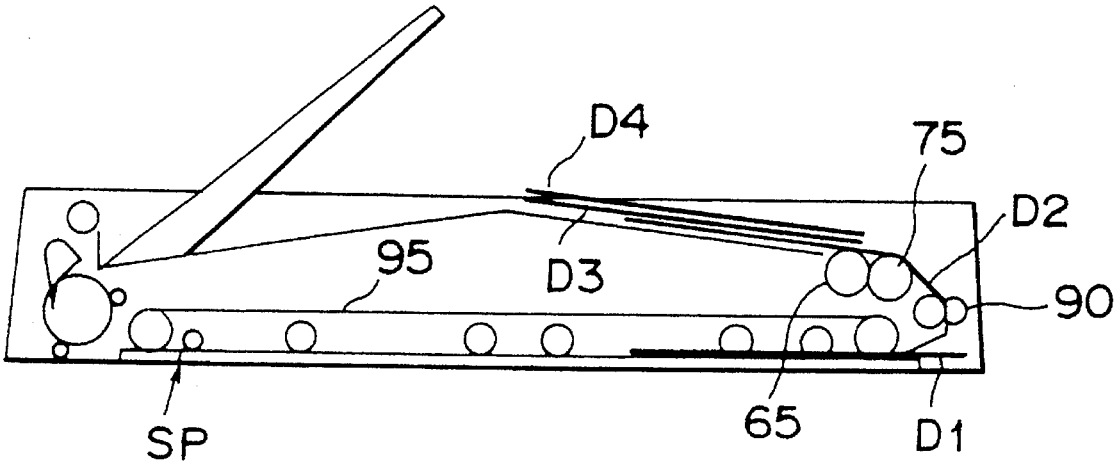
FIG. 39 is an explanatory view of document conveyance an the two-in-one mode subsequent to FIG. 38.
Figure 40:
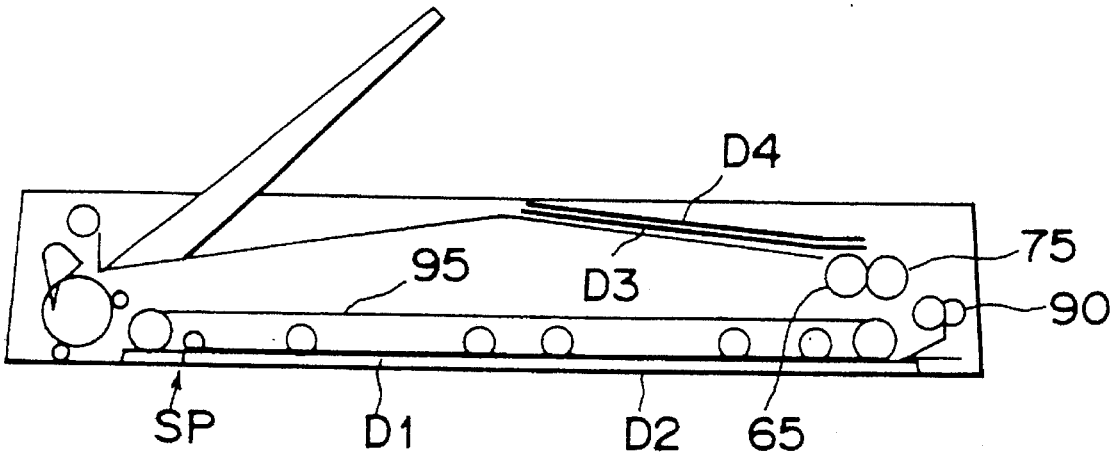
FIG. 40 is an explanatory view of document conveyance in the two-in-one mode subsequent to FIG. 39.
Figure 41:
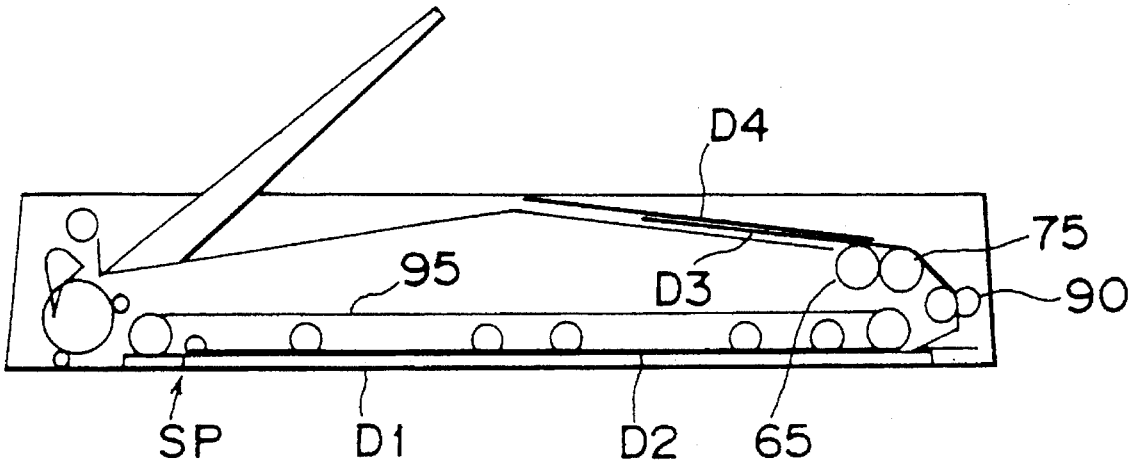
FIG. 41 is an explanatory view of document conveyance in the two-in-one mode subsequent to FIG. 40.
Figure 42:
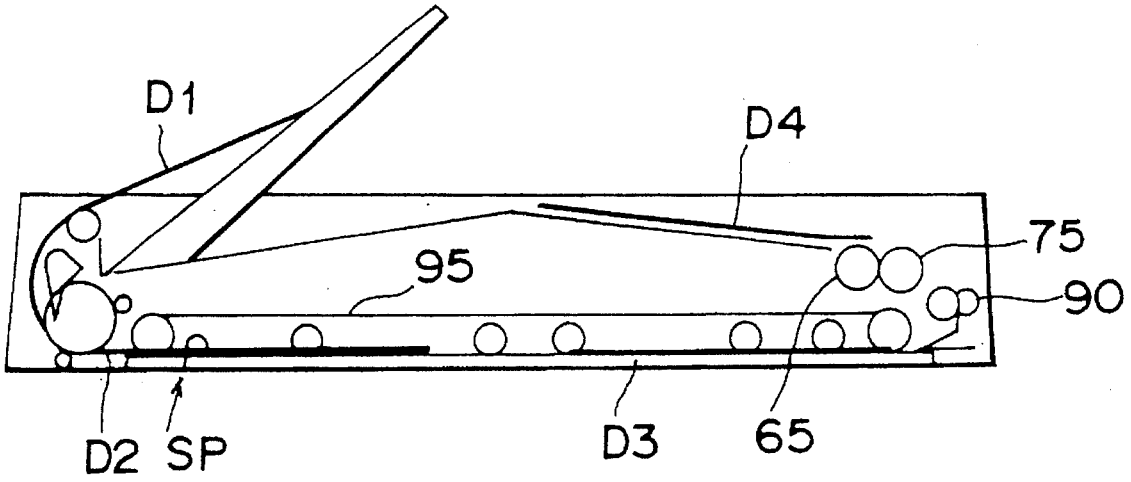
FIG. 42 is an explanatory view of document conveyance in the two-in-one mode subsequent to FIG. 41.
Figure 43:
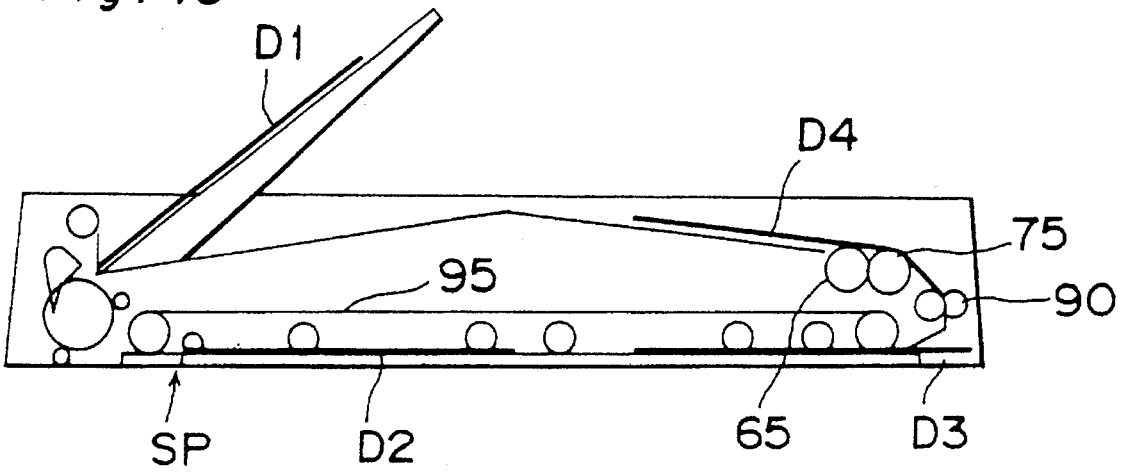
FIG. 43 is an explanatory view of document conveyance in the two-in-one mode subsequent to FIG. 42.
Figure 44:
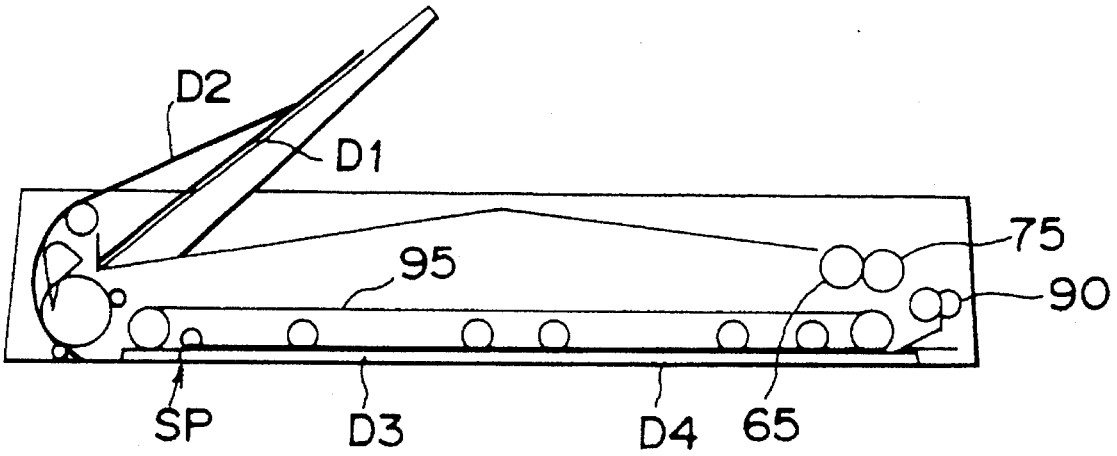
FIG. 44 is an explanatory view of document conveyance in the two-in-one mode subsequent to FIG. 43.
Figure 45:
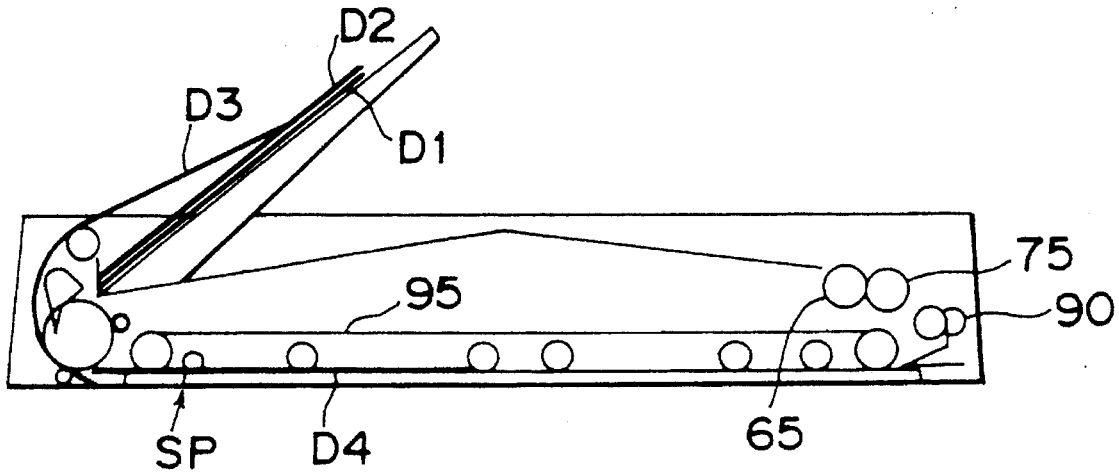
FIG. 45 is an explanatory view of document conveyance in the two-in-one mode subsequent to FIG. 44.
Figure 46:
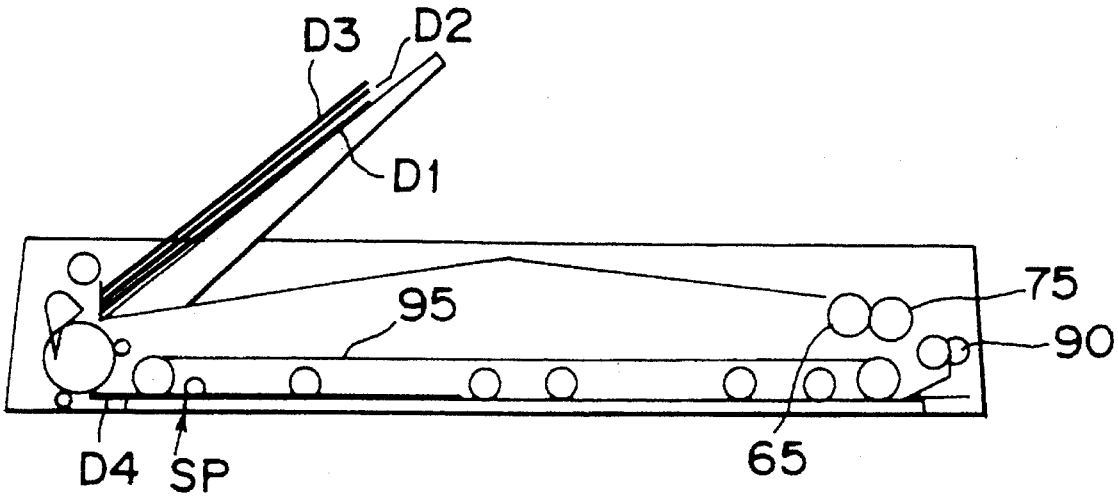
FIG. 46 is an explanatory view of document conveyance in the two-in-one mode subsequent to FIG. 45.
Figure 47:
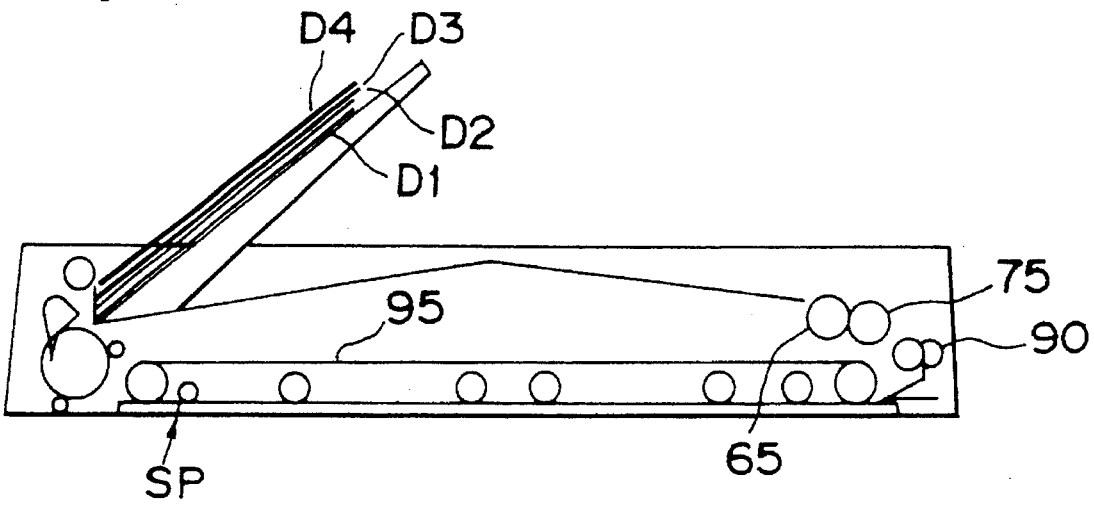
FIG. 47 is an explanatory view of document conveyance in the two-in-one mode subsequent to FIG. 46.

The two-in-one mode is here explained. The two-in-one mode is a mode in which two document sheets are arranged as one set and the document image is formed on one sheet of copying paper. FIGS. 36 through 47 illustrate the document conveying state in the two-in-one mode. FIG. 36 shows a state in which the document is set on a tray 61, where it is assumed that four sheets of small-size documents D1, D2, D3, and D4 are set up. First, the first-sheet document D1 is fed, standing by with its front end in contact with the register roller 90 (see FIG. 37). Next, the main motor M3 is driven to rotate forward, so that the document D1 is fed onto the platen glass 29. When the rear end of the document D1 has reached onto the platen glass 29 (see FIG. 38), the main motor M3 is switched to reverse rotation, where the document D1 is switched back to a direction opposite to that of arrow "d" As a result, the rear end of the document D1 goes under the guide plate 132 and the film 133 (see FIG. 39). The extent of the switchback corresponds to a length over which the rear end of the document reaches the nip portion of the register roller 90. It is noted that the document is guided by the resin film 133 so that the rear end portion of the document will not return to the register roller 90 side. The second-sheet document D2 is started to be fed in a specified elapse after the rear end of the first-sheet document D1 is detected by the register sensor SE2. Immediately after the document D1 has been finished being switched back, the document D2 is stopped with its front end in contact with the register roller 90 (see FIG. 39).

Next, the main motor M3 is driven to rotate forward so that the documents D1, D2 are conveyed on the platen glass 29. At a time point when the front end of the document D1 has reached the exposure standard position SP, the main motor M3 is turned off. Thus, the documents D1, D2 have been juxtaposed (see FIG. 40). The main motor M3 is reduced in rotating speed immediately before the document D1 reaches the exposure standard position SP. In synchronization with this speed-reduction timing, the third-sheet document D3 is started to be fed. Before the exposure is completed on the documents D1, D2, the front end of the document D3 is brought into contact with the register roller 90, where the first-out paper feed is completed (see FIG. 41).

Upon completion of the documents D1, D2, the main motor M3 is driven to rotate forward while the discharge motor M4 is driven. The document D1 is fed to the tray 115 by the reverse roller 100 and the discharge roller 110, the document D2 follows the document D1, and the third-sheet document D3 is fed onto the platen glass 29 (see FIG. 42). When the rear end of the document D3 has reached onto the platen glass 29, the main motor M3 is switched to reverse rotation, so that the document D3 is switched back as like the foregoing document D1. In this process, the document D1 is given a conveying force by the reverse roller 100, and discharged onto the tray 115 as it is. The document D2, whose front end has not yet reached the reverse roller 100 at the time of the start of the switchback, switches back together with the document D3 (see FIG. 43). Immediately after the switchback is completed, the fourth-sheet document D4 is first-out fed to the register roller 90.

The discharge motor M4 remains being driven as it is, and the main motor M3 is driven to rotate forward. The main motor M3 continues being driven until the front end of the document D3 reaches the exposure standard position SP, whereby the documents D3, D4 are juxtaposed on the platen glass 29 while the document D2 is discharged onto the tray 115 (see FIG. 44). The discharge motor M4 is turned off when the document D2 is discharged. In this way, the documents D1, D2 are spaced from each other by the succeeding document D3 being once switched back on the way of discharge. If two document sheets were pushed out onto the tray 115 without interval, the succeeding document would rush on the preceding document, disturbing the order on the tray 115, or the succeeding document would slip under the preceding document, disturbing the order of page number. However, since the present embodiment is so arranged that the two sheets of documents D1, D2 are spaced from each other at the time of discharge, the possibility of disturbance of the document on the tray 115 can be eliminated.

Upon completion of the exposure on the documents D3, D4, the main motor M3 is driven to rotate forward, while the discharge motor M4 is driven. Then, at a time point when the rear end of the document D3 has separated from the conveyor belt 95, the main motor M3 is once turned off (see FIG. 45). The time duration for which the main motor M3 is kept off corresponds to a time duration for which the interval between the documents D3 and D4 is opened to such an extent as not to cause any disturbance on the tray 115 (see FIG. 46). At this point, the main motor M3 is driven to rotate forward, whereby the document D4 is discharged onto the tray 115 (see FIG. 47).

The discharging process of the document that is over the exposure and the setting process of the succeeding document to the exposure position SP are conveyed out in the manner as described above. The reverse roller 100 and the discharge roller 110 are driven by the discharge motor M4, which is other than and independent of the main motor M3. Besides, the conveying force by the reverse roller 100 and the pinch roller 101 is set larger than that by the conveyor belt 95. These arrangements make it possible to discharge onto the tray 115 the document introduced to the discharge section, regardless of the operating state of the conveyor belt 95. The switchback point BP (see FIG. 26) is constant irrespectively of the length of the document.

However, with a document size of dp, if the distance from the nip portion of the register roller 90 to the front end of the resin film 133 is d1, the distance from the front end of the film 133 to the switchback point BP is d2, and if the distance from the pinch roller 101 to the exposure standard position SP is d3, then without a positional relation where $d3>d1+d2$ ($=d4$) (see FIG. 26), the second sheet of the preceding documents would reach the reverse roller 100 and the pinch roller 101 at a time point when the rear end of the succeeding document reaches the switchback point BP, so that the preceding second-sheet document would be discharged continuously without interval. In this discharging process, if a front end and a rear end of two documents overlap each other, the second-sheet document would slip under the document that is first discharged on the discharge tray 115, or would rush on the preceding document, disturbing the order of the document. Similar problems would be involved also when a preceding (especially the first-sheet) document is short size and a succeeding (especially the third-sheet) document is long size. However, if the difference in length of the document in such a case is expressed as Δdp (Δdp=dpmax−dpmin, where dpmax is the length in the document conveying direction of a document of a maximum length at which the two-in-one mode is feasible with the copying machine, and dpmin is the length in the document conveying direction of a document with a minimum length), then such a positional relation that d3>d4+Δdp (d4=d1+d2) is set. By so doing, two document sheets to be exposed at the same time are discharged from on the glass platen 29 with a sufficient interval therebetween, so that the arrangement order of these two document sheets will never be disturbed.

<Both-sides Mode>

Figure 48:
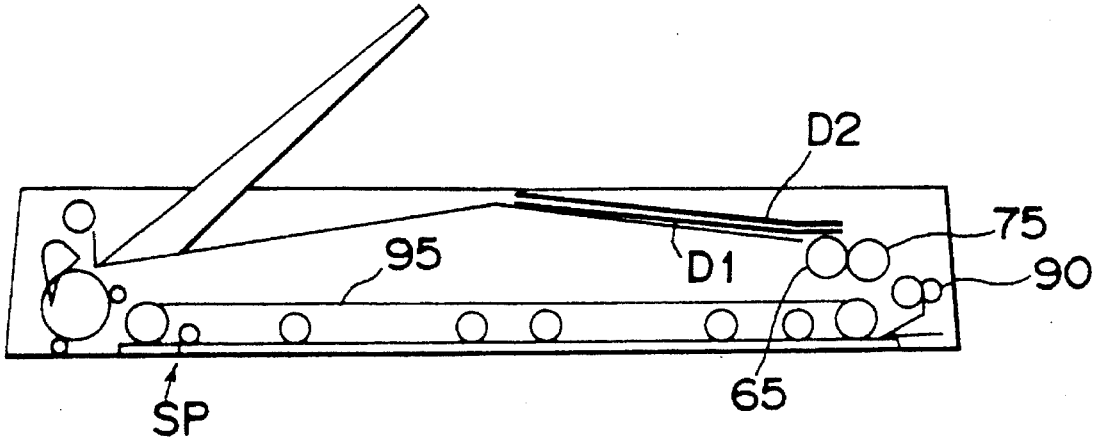
FIG. 48 is an explanatory view of document conveyance in the both-sides mode.
Figure 49:
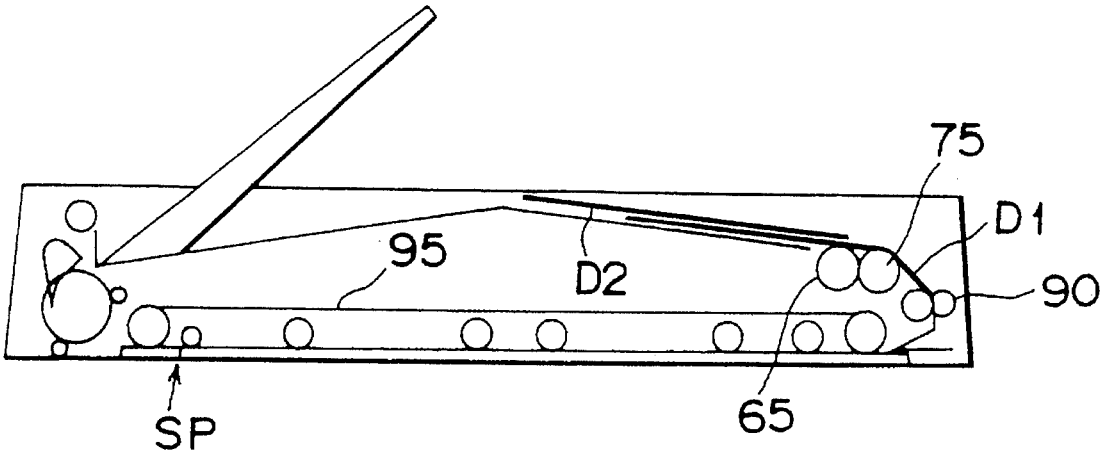
FIG. 49 is an explanatory view of document conveyance in the both-sides mode subsequent to FIG. 48.

The basic operation in the both-sides mode is explained. As shown in FIG. 48, when the copy start button of the copying machine main body 1 is turned on with the documents D1, D2 set up on the document tray 61, then the ADF 60 starts the document feed operation. During the document feed, the pressing plate 70 presses the front end of the document D1. Then, based on the rotation of the pickup roller 65 and the feed roller 75, the document D1 is fed to the position of the register roller 90, and the pickup roller 65 and the feed roller 75 stop rotating at a time point when the front end of the document has come into contact with the register roller 90 to form a loop (see FIG. 49). Also, the pressing plate 70 is released from pressing the document D1, thus completing the document feeding operation for the first sheet.

Figure 50:
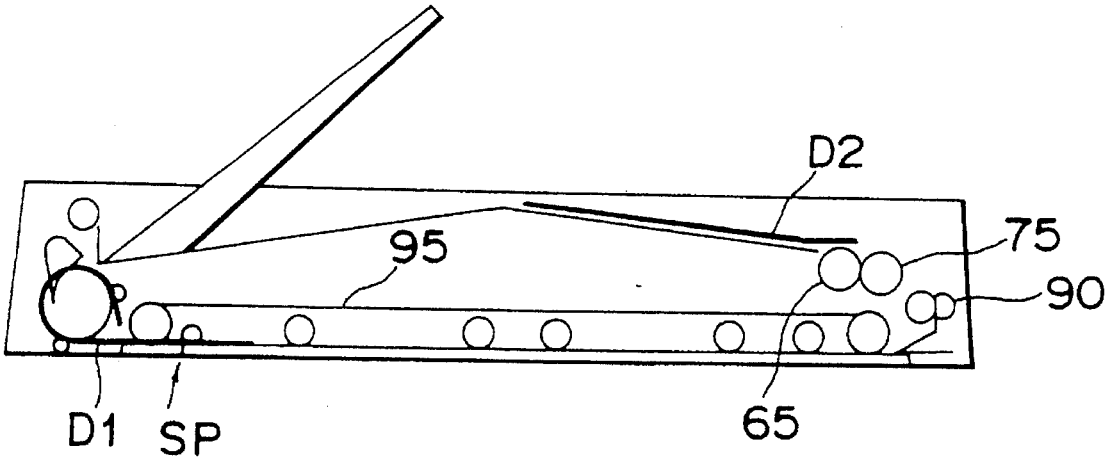
FIG. 50 is an explanatory view of document conveyance in the both-sides mode subsequent to FIG. 49.

Next, the register roller 90, the conveyor belt 95, and the reverse roller 100 rotate so that the document D1 is fed onto the glass platen 29. Meanwhile, the scale solenoid SL1 is turned so that the front end portion of the scale 120 is withdrawn to under the glass platen 29, where the switching claw 103 operates to cause the paper path in the document discharge section to be switched to the reversal path. Upon completion of exposure, the document D1 is sent to the reversal path in the discharge section. Then, the register roller 90, the conveyor belt 95, and the reverse roller 100 temporarily stop with the front end of the document held at a second subordinate roller 102 (see FIG. 50).

Figure 51:
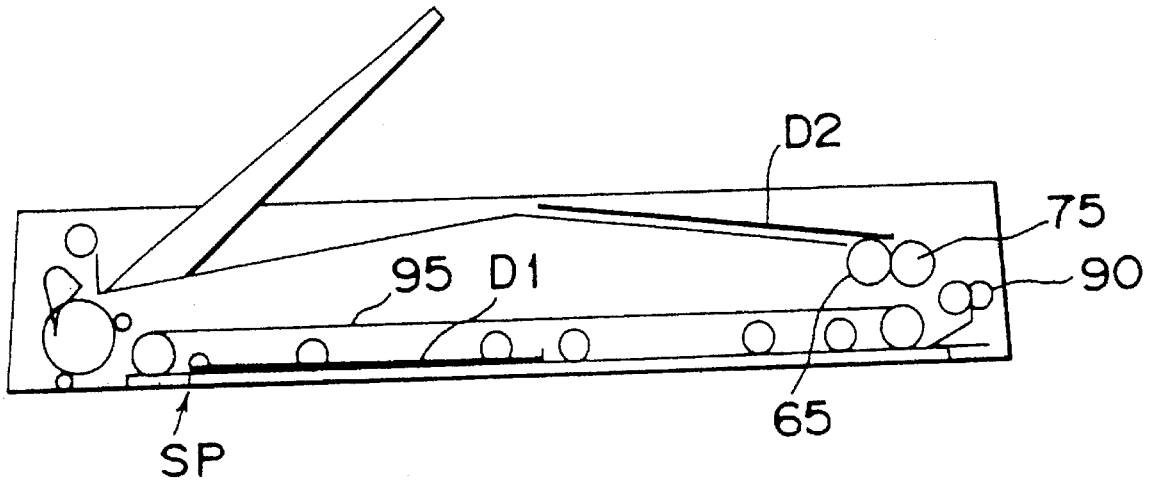
FIG. 51 is an explanatory view of document conveyance in the both-sides mode subsequent to FIG. 50.
Figure 52:
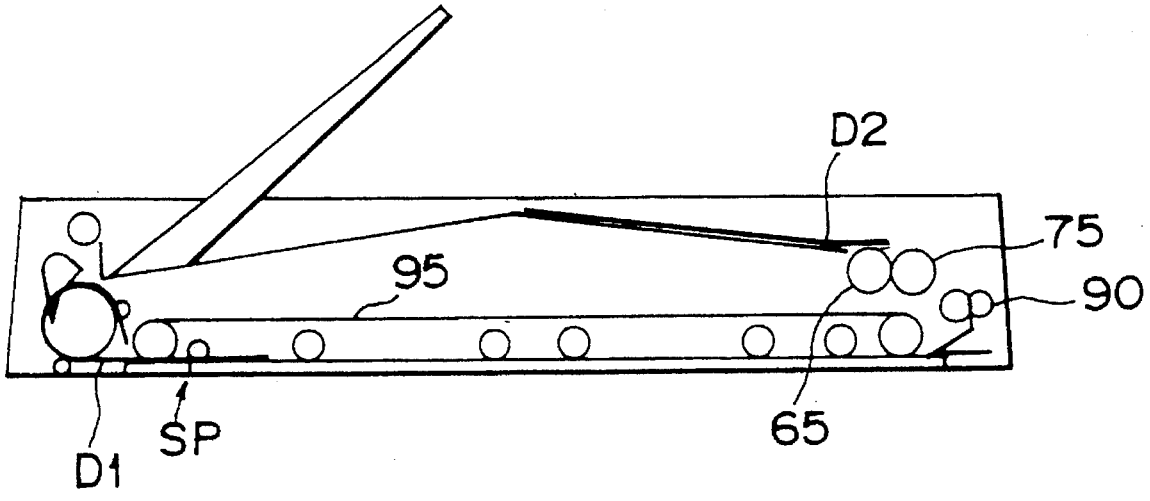
FIG. 52 is an explanatory view of document conveyance in the both-sides mode subsequent to FIG. 51.
Figure 53:
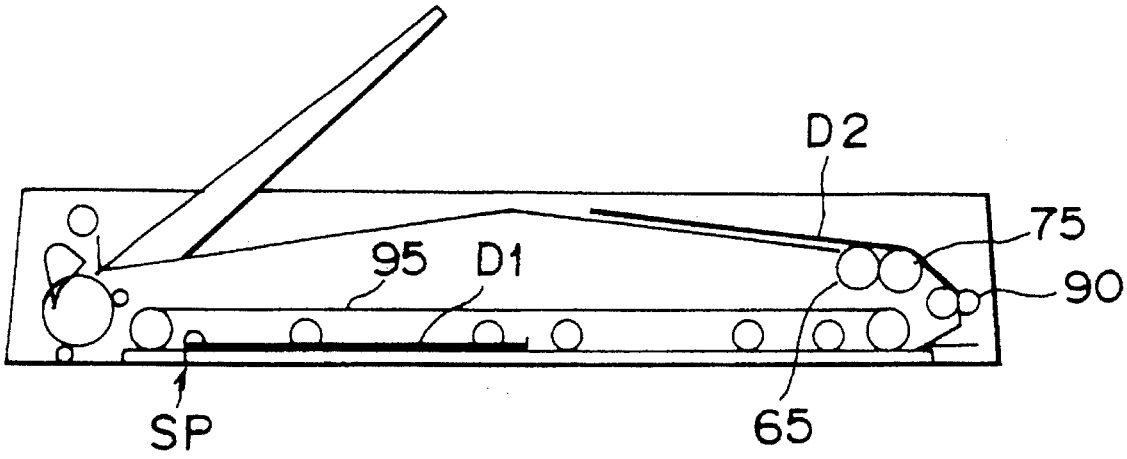
FIG. 53 is an explanatory view of document conveyance in the both-sides mode subsequent to FIG. 52.
Figure 54:
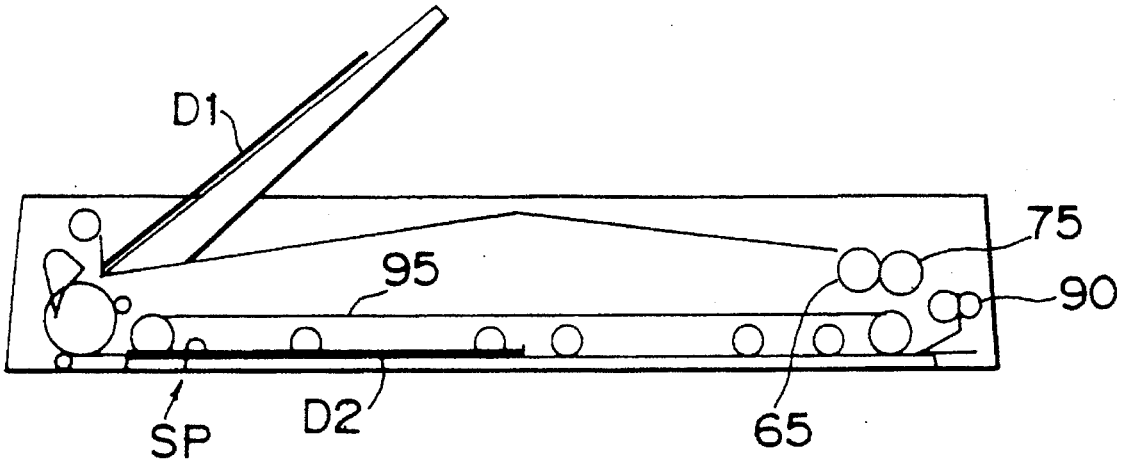
FIG. 54 is an explanatory view of document conveyance in the both-sides mode subsequent to FIG. 53.
Figure 55:
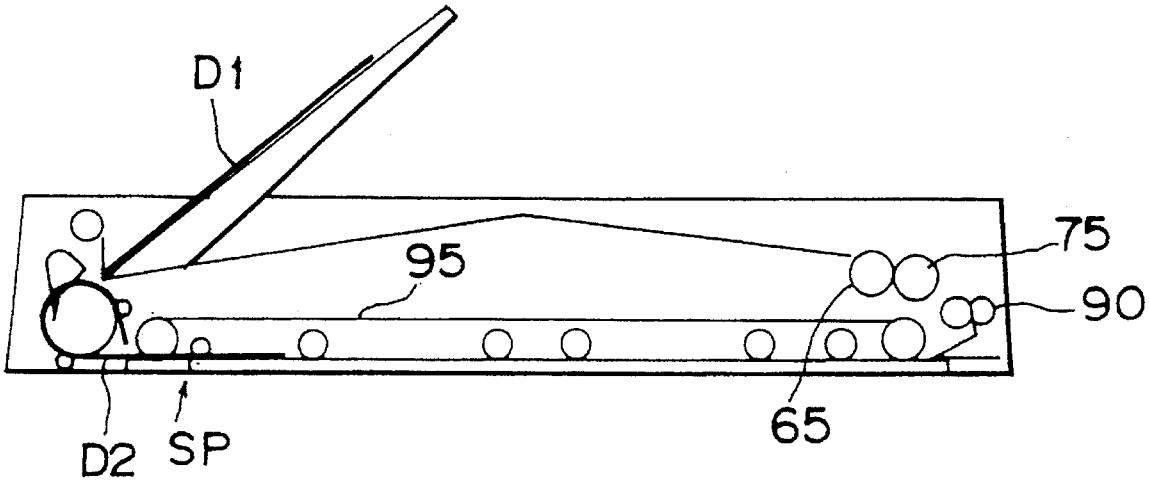
FIG. 55 is an explanatory view of document conveyance in the both-sides mode subsequent to FIG. 54.
Figure 56:
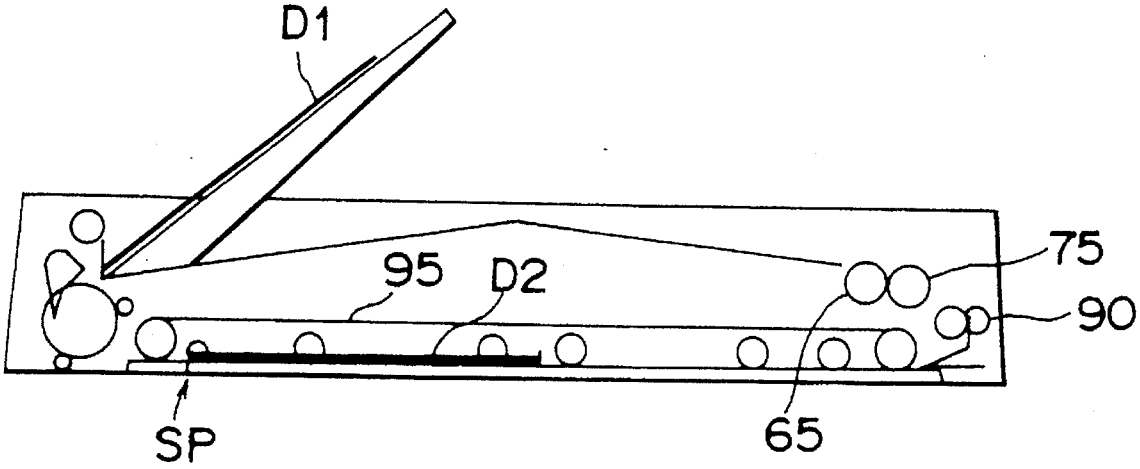
FIG. 56 is an explanatory view of document conveyance in the both-sides mode subsequent to FIG. 55.
Figure 57:
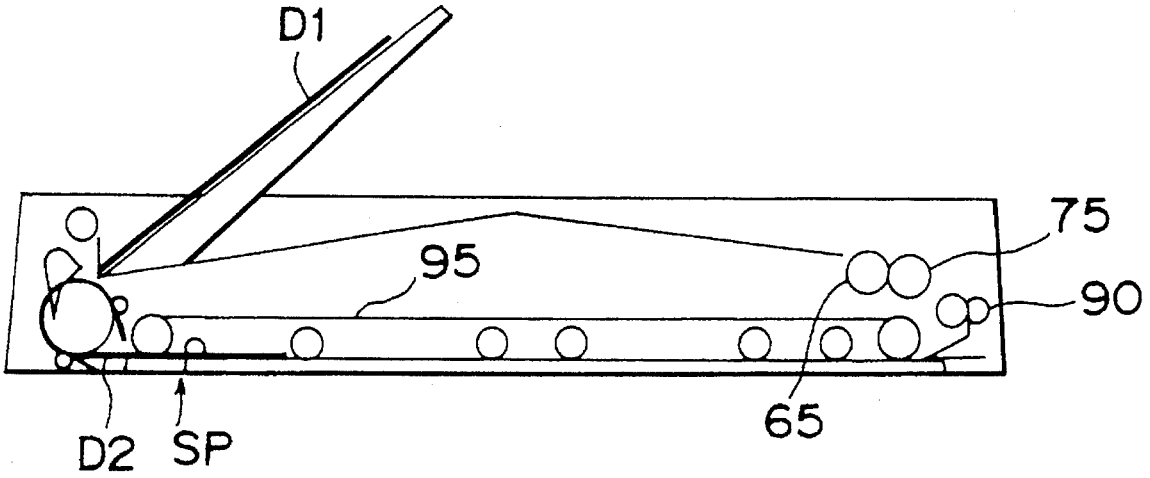
FIG. 57 is an explanatory view of document conveyance in the both-sides mode subsequent to FIG. 56.
Figure 58:
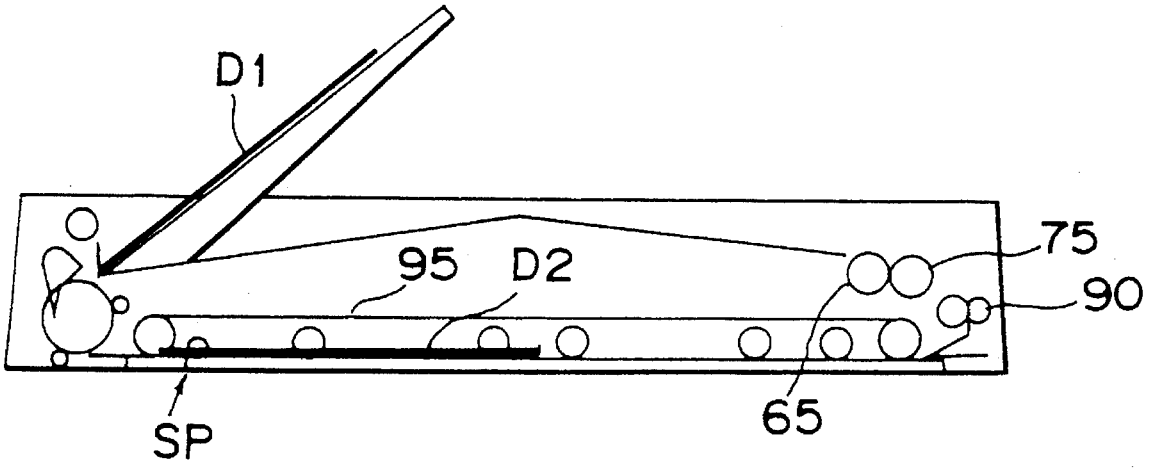
FIG. 58 is an explanatory view of document conveyance in the both-sides mode subsequent to FIG. 57.
Figure 59:
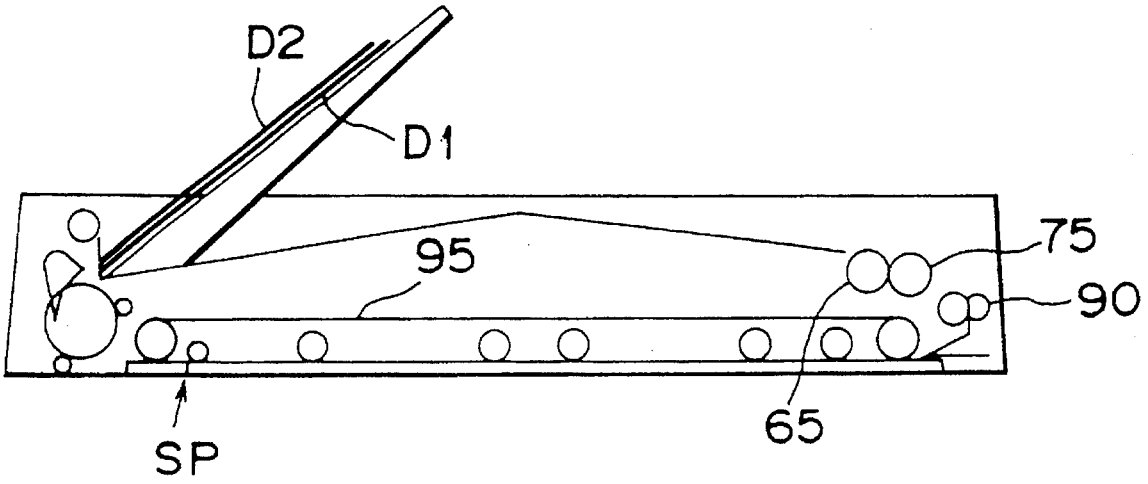
FIG. 59 is an explanatory view of document conveyance in the both-sides mode subsequent to FIG. 58.

In a specified elapse, the reverse roller 100 rotates again so that the conveyor belt 95 rotates reverse, whereby the conveying of the document D1 is resumed. Thus, the document D1, passing through the reversal path, is again fed onto the glass platen 29 so that the rear surface of the document is copied (see FIG. 51). After the rear surface of the document is finished being copied, the document D1 is again conveyed to the reversal path, so that the front surface of the document is copied (see FIGS. 52, 53). Upon completion of the exposure on the document surface, the register roller 90, the conveyor belt 95, and the reverse roller 100 rotate so that the switching claw 103 operates in the reverse direction, whereby the first-sheet document is discharged onto the discharge tray 115 (see FIG. 54). When the first-sheet document is discharged, the switching claw 103 operates again, switching the document conveying path to the reversal path to reverse the second-sheet document (see FIG. 55). The second-sheet document is conveyed to the position of the register roller 90 during the exposure of the surface of the first-sheet document (see FIG. 53). Then, immediately after the first-sheet document is discharged from the glass platen 29, the second-sheet document is fed to the exposure standard position SP on the glass platen 29 and processed in the same way as the first-sheet document (see FIGS. 56 to 59).

<Count Mode>

Now the count mode is explained. The count mode is a mode in which the number of document sheets are counted by making the document sheets circulate over one cycle without being accompanied by the copying operation before the copying operation is started with the use of the ADF 60. In the two-in-one mode, if the number of document sheets is an odd number, the ADF 60, which feeds the document sheets by starting with the final page, would encounter a trouble that the image of the first-page sheet is copied on a half of one copying sheet, which means that the cover page of the copied document has a blank half. Accordingly, by the ADF 60 previously counting the number of document sheets, if the count is an odd number, the final page sheet to be first fed is conveyed by one sheet alone onto the platen glass 29 and the following document sheets are conveyed in the aforementioned two-in-one mode. Also, since a similar trouble would occur even in the both-sides copy mode and the combined copy mode, it is necessary to previously count the number of document sheets in the count mode.

Since the count mode does not involve the copying operation, it is desirable to carry out the process as fast as possible (in as short a time as possible). However, the present ADF 60 adopts a system that the front end of the document is stopped at a standard position SP on the platen glass 29 downstream of in the conveying direction. As a result, if the document is stopped at the standard position SP also in the count mode, the interval between two document sheets would become too large, resulting in an increase in the idle feeding time.

Thus, in the count mode, it has been arranged that the document is temporarily stopped by referencing a time point when the rear end of the document has reached a stop reference position X on the platen glass 29 (see FIG. 25). With this arrangement, the interval between document sheets during the execution of the count mode is given by a length from the stop reference position X to the nip portion of the register roller 90, so that the processing time is largely reduced. That the rear end of the document has reached the reference position X can be detected by counting the number of pulses from when the rear end of the document is detected by the register sensor SE2 until when the main motor M3 is driven.

The reference position X in this case may be arbitrarily set without being limited to the position as shown in FIG. 25. The reference position X, only if upstream of the stop reference position SP for copying operation, contributes to reduction in the processing time in the count mode. Further, the reference position X does not need to be set on the glass platen 29, but needs only to be downstream of the nip portion of the register roller 90. The more the reference position X is close to the nip portion of the register roller 90, the more the processing time is reduced.

Preferably, the ADF 60 conveys the document in the count mode at a speed higher than it does in the copying operation. It is also preferable to accelerate the document conveying speed higher than the reference speed, in executing an operation of the ADF 60 that causes the copying operation to be delayed or that causes the copying productivity of 100% as described before to be lowered, as well as in effecting the count mode. The aforementioned operation that causes the copying operation to be delayed is involved in reversing a both-sides document by the reverse roller 100, conveying the first-fed document up to the exposure standard position SP, and discharging the last-fed document from the glass platen 29 to the tray 115.

2. Copying Machine with Sorter

Figure 60:
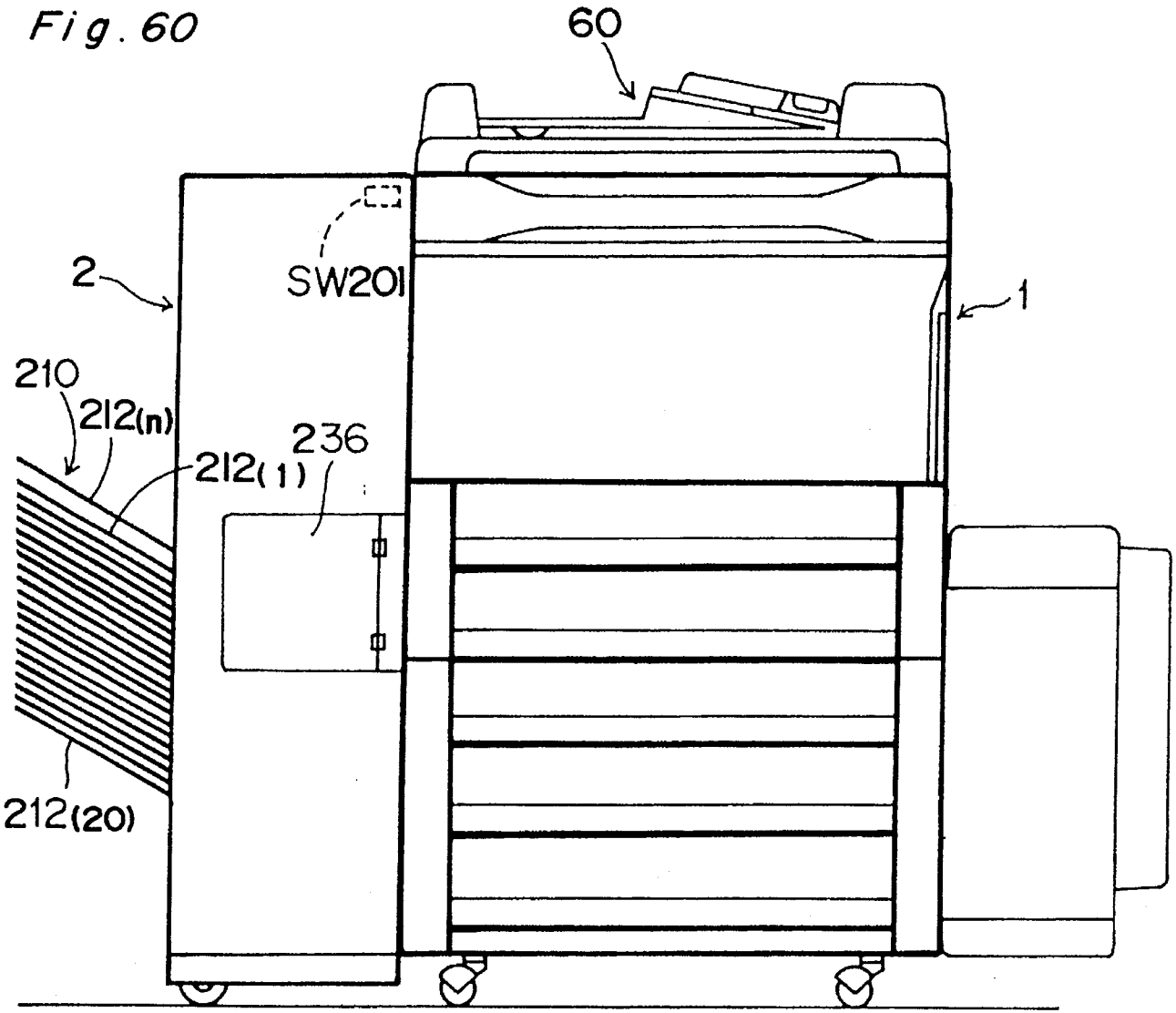
FIG. 60 is a front view of an copying machine provided with a sorter which is an embodiment of the present invention.

FIG. 60 shows a copying machine which comprises a copying machine body 1 and a sorter 2 having a stapler 300.

The copying machine body 1 is provided with the ADF 60 described above and is capable of performing a copying process in two-in-one mode.

The sorter 2 is provided in the left side of the machine body 1. The sorter 2 not only distributes sheets ejected from the machine body 1 to bins 212 but also punches the sheets and staples the sheets. The sorter 2 is detachable from the machine body 1 for maintenance and management of sheet jamming. The attachment and detachment of the sorter 2 is detected by a set switch SW201. Only while the set switch SW201 detects the sorter 2 being attached to the machine body 1, the sorter 2 is operational.

Figure 61:
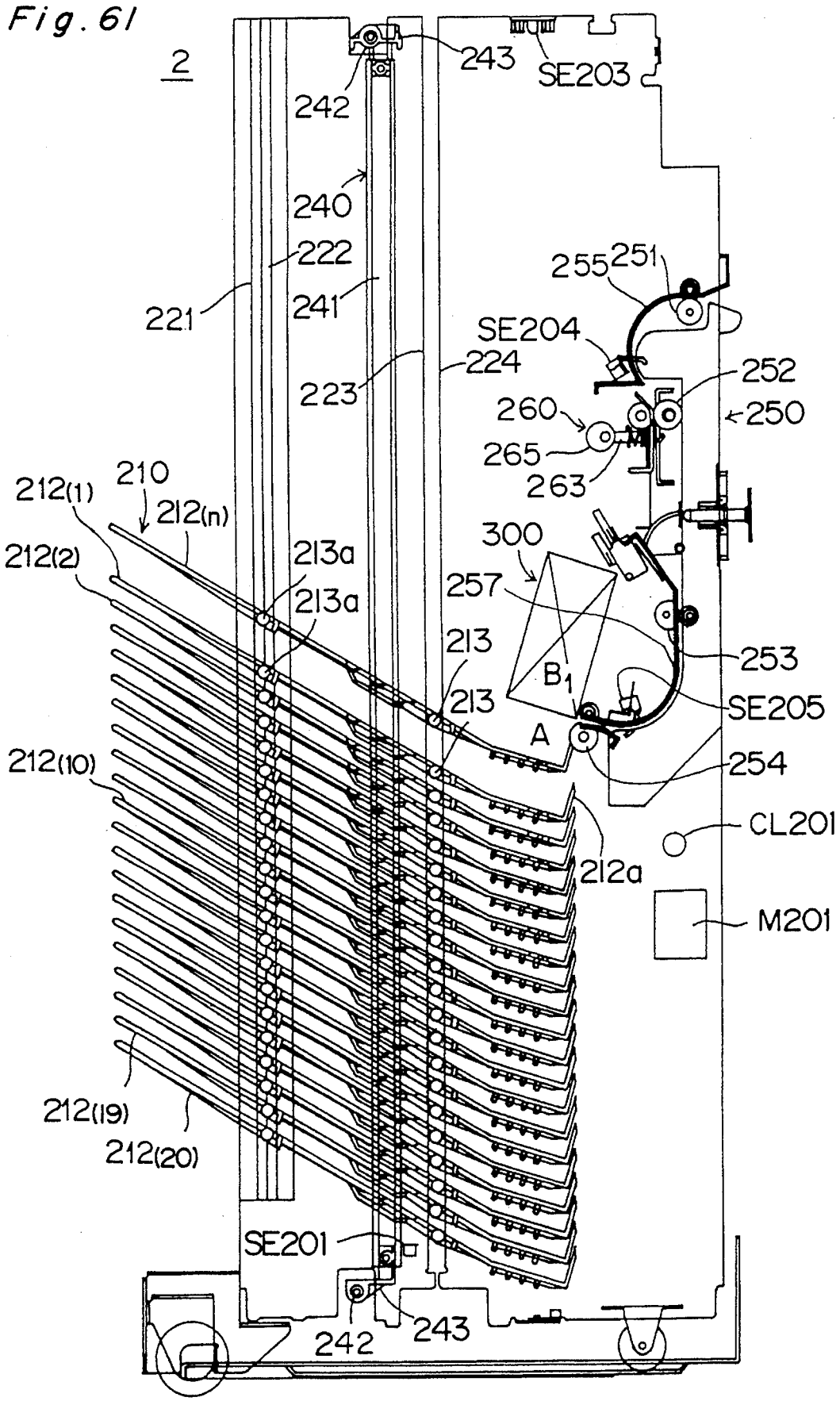
FIG. 61 is an elevational view of the sorter, showing the internal composition thereof.
Figure 62:
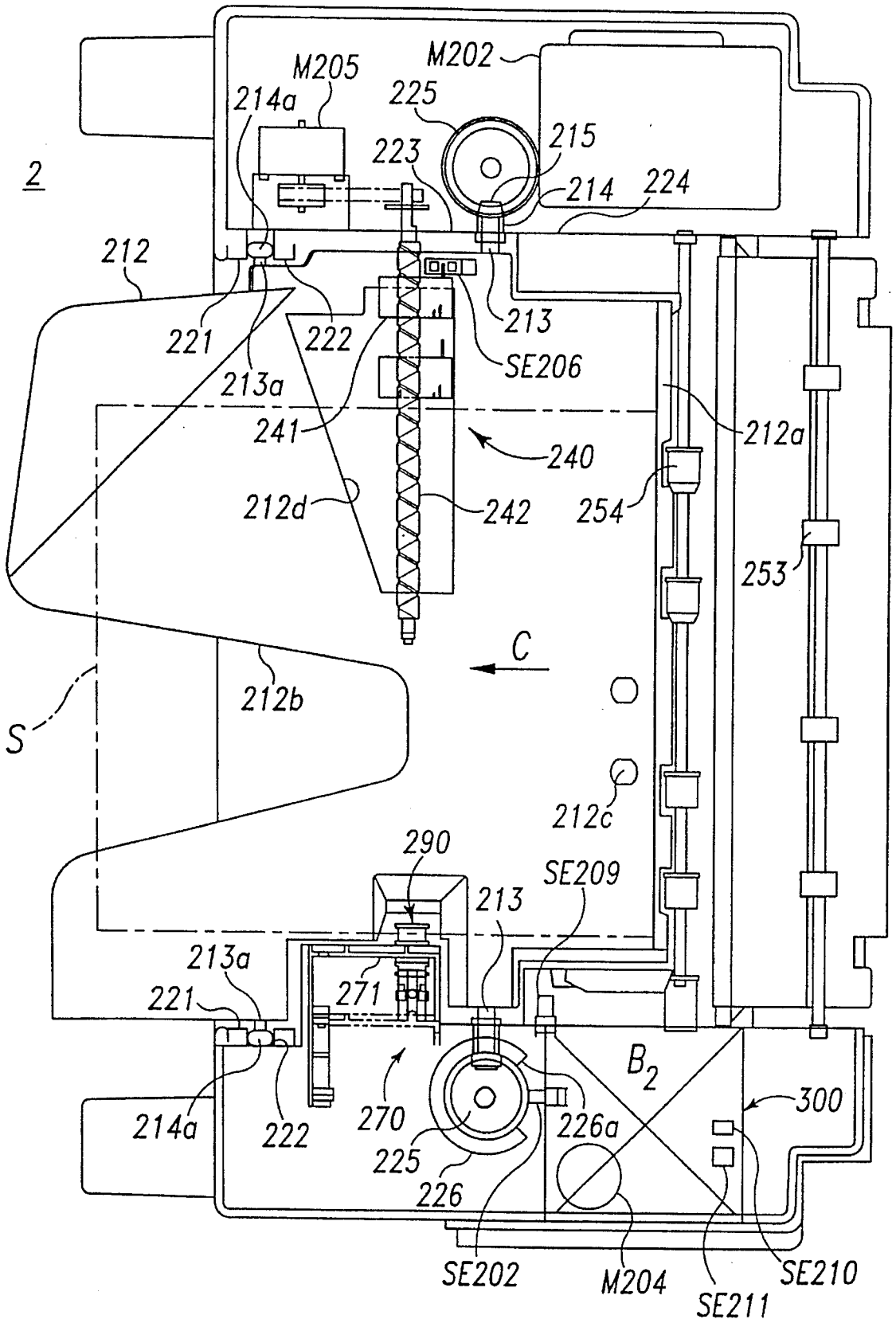
FIG. 62 is a plan view of the sorter, showing the internal composition thereof.

FIGS. 61 and 62 show the general structure of the sorter 2. The sorter 2 comprises a bin assembly 210, a sheet transporting mechanism 250, a punching mechanism 260, a sheet aligning mechanism 240, a sheet chucking mechanism 270 and a stapler 300.

<Bin Assembly>

In the bin assembly 210, bins 212 are arranged one upon another at uniform intervals. The bins 212 include a top bin $212_{(n)}$ used as a non-sort tray, and twenty bins $212_{(1)}$through $212_{(20)}$ used as sort trays. Sheets are handed into the bins 212 at a position A in FIG. 61. The bins 212 are movable up and down to receive sheets at the hand-out position A. Stapling operation is carried out at a level $B_1$ in FIG. 61 (horizontally, at a position $B_2$ in a plan view of FIG. 62) by a stapler 300. For the stapling operation, each bin 212 moves one step up to the stapling level B1 from the sheet hand-out position A.

<Sheet Transporting Mechanism>

Figure 63:
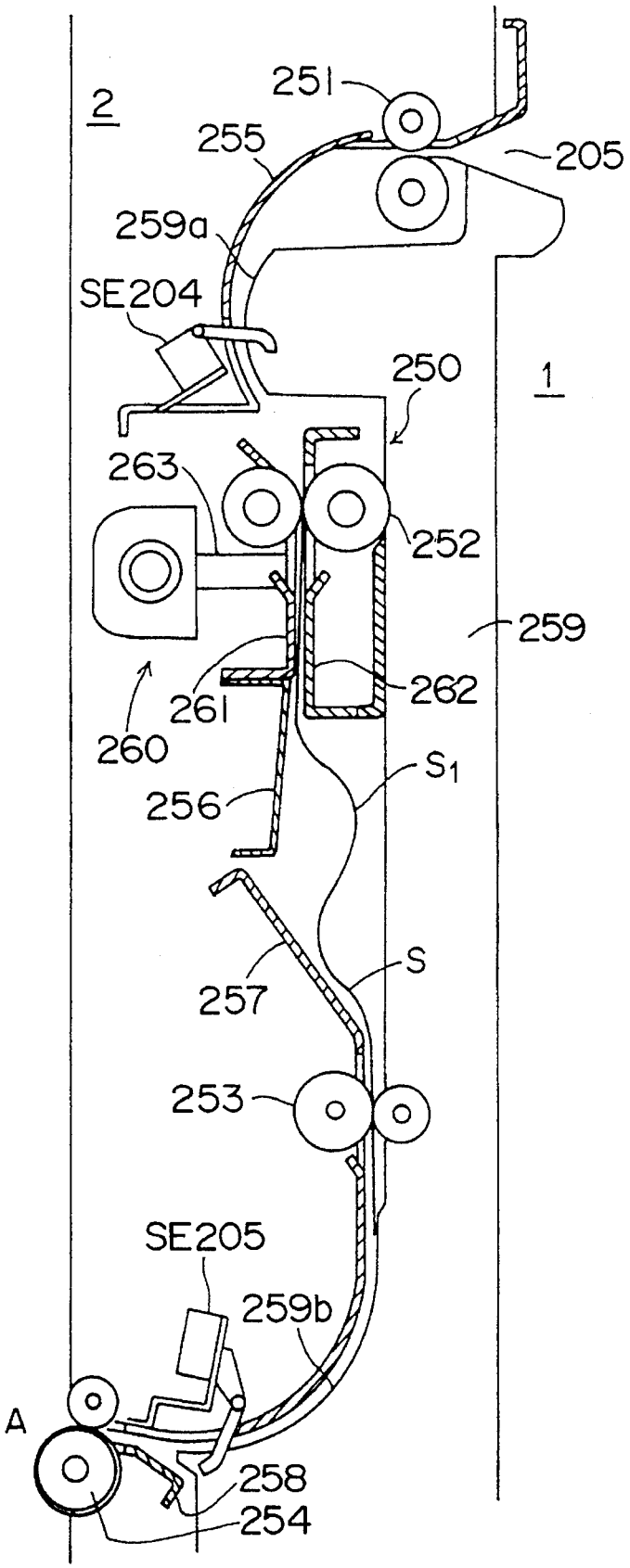
FIG. 63 is a sectional view of a sheet transporting mechanism.

The sheet transporting mechanism 250 is a sheet path from the machine body 1 to the bins 212. As shown in FIG. 63, the punching mechanism 260, and sheet sensors SE204 and SE205 are disposed in the sheet path. The sheet transporting mechanism 250 has a receiving roller pair 251, a register roller pair 252, a clutch roller pair 253 and a hand-out roller pair 254. These roller pairs are driven by a transport motor M201 (see FIG. 61) through a conventional transmission mechanism. The receiving roller pair 251 and the register roller pair 252 are connected to the transport motor M201 such that the power of the motor M201 is transmitted to these pairs 251 and 252 at all times. The power transmission to the clutch roller pair 253 and the hand-out roller pair 254 can be connected and disconnected by an electromagnetic clutch CL201.

A copied sheet which is ejected from the machine body 1 through an outlet 205 is received by the receiving roller pair 251. Next, the sheet is guided downward by a guide plate 255 and a guide surface 259*a* of a frame 259 and comes between a guide plate 261 and a guide portion 262*a* of a punch trash can 262 of the punching mechanism 260. Further, the sheet is guided downward by guide plates 256 and 257 and received by the clutch roller pair 253. Then, the sheet is guided to the left by a guide surface 259*b* of a frame 259 and a guide plate 258 to the hand-out roller pair 254 and is handed into a bin 212 which is in the hand-out position A.

Punching sticks 263 are driven to punch a sheet at the trailing portion. In order to punch every sheet at the same point, accurate positioning of a sheet is necessary. In the present embodiment, the accurate positioning of a sheet is intended to be achieved by temporarily making the speed of the register roller pair 252 different from the speed of the clutch roller pair 253 and the hand-out roller pair 254. More specifically, when a specified time has passed since the sensor SE204 detected the trailing edge of a sheet S (when the trailing edge of the sheet reaches a point about 10 mm upstream of the register roller pair 252), the electromagnetic clutch CL201 is turned on such that the power transmission from the motor M201 to the roller pairs 253 and 254 is disconnected. Thereby, the leading portion of the sheet S stops, while the trailing portion continues to be fed by the register rollers 252. Then, the sheet S curves between the roller pairs 252 and 253 as indicated by $S_1$ in FIG. 63. After the trailing edge of the sheet S passes through the nipping portion of the register roller pair 252, the trailing edge is pushed against the nipping portion of the roller pair 252 by the firmness of the sheet S and the elasticity generated by the curved portion $S_1$ of the sheet S. Thereby, a punching point of the sheet S is accurately settled, and the punching sticks 263 are driven to punch the sheet S. After the punching operation, the electromagnetic clutch CL201 is turned off, and the roller pairs 253 and 254 start to be driven again.

With the above-described structure and control, the trailing edge of a sheet is regulated by the register roller pair 252, and the punching point is accurately settled. Thus, the punching operation is completed simply and promptly without giving so heavy a burden to the sheet transporting mechanism 250 and without reducing the copying speed of the machine body 1.

<Punching Mechanism>

Figure 64:
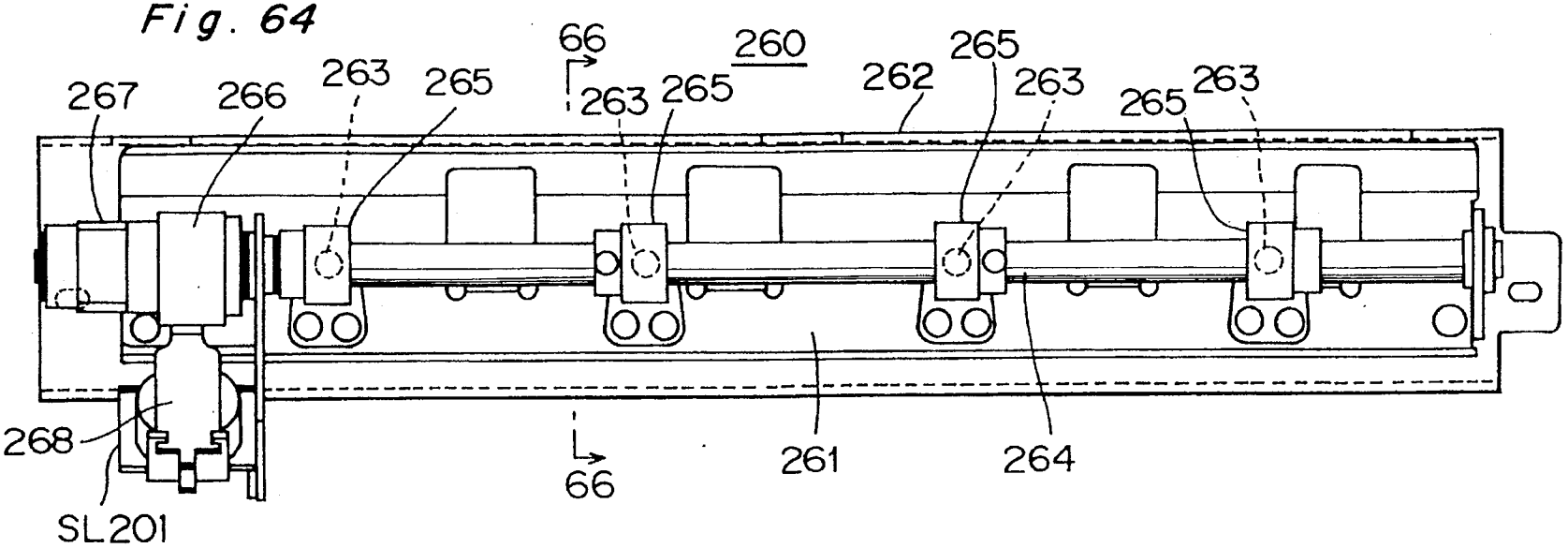
FIGS. 64, 65 and 66 show a punching mechanism, FIG. 64 being a front view, FIG. 65 being a left side view and FIG. 66 being a sectional view taken along the line 66—66 in FIG. 64.
Figure 66:
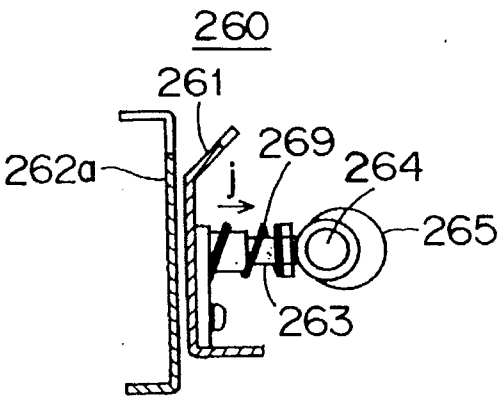

As shown in FIGS. 64, 65 and 66, the punching mechanism 260 comprises the guide plate 261, the punch trash can 262, the four punching sticks 263, a driving shaft 264, eccentric cams 265, a one-rotation clutch 266 and a flapper solenoid SL201. The punching sticks 263 are urged by coil springs 269 in a direction retreating from the guide plate 261 (in a direction indicated by arrow j in FIG. 66), and the rear ends thereof are pressed against the circumference of the eccentric cams 265 which are fixed on the driving shaft 264.

The one-rotation clutch 266 is to connect and disconnect the power transmission from the motor M201 to the driving shaft 264 via a gear 267. The clutch 266 has a kick spring (not shown) inside and has a step 266*a* on the circumference so as to engage with a pawl 268 of the flapper solenoid SL201. While the flapper solenoid SL201 is off, the pawl 268 keeps engaging with the step 266*a*, which keeps the clutch 266 off. In this state, clockwise (in the view of FIG. 65) rotation of the gear 267 is not transmitted to the driving shaft 264, and the rear ends of the punching sticks 263 are in contact with a small radial portion of the eccentric cam 265. Accordingly, the punching sticks 263 are in retreat from the surface of the guide plate 261. The flapper solenoid SL201 is turned on for an instance, and thereby, the clutch 266 and the driving shaft 264 rotate. Then, when the step 266*a* of the clutch 266 comes in engagement with the pawl 268, that is, when the clutch 266 and the driving shaft 264 have made one rotation, the rotation is stopped. With the rotation of the driving shaft 264, the eccentric cam 265 makes one rotation and reciprocates (protrudes from the guide plate 261 and returns) the punching sticks 263. Thus, a sheet stuck between the guide plate 261 and the guide portion 262*a* of the punch trash can 262 are punched.

<Bin Moving Mechanism>

As shown in FIG. 73, each bin 212 is shaped like a plate. Each bin 212 has a sheet reflow prevention wall 212*a* in its supported end and has a large cut-out 212*b* in its free end. The cut-out 212*b* helps an operator take sheets out of the bin 212. Two couples of pins 213 and 213*a* stand on both sides of each bin 212. Rollers 214 and 215 (see FIG. 68) are rotatably fitted to each of the pins 213, and a roller 214*a* is rotatably fitted to each of the pins 213*a*. Each roller 214*a* is disposed between guide plates 221 and 222 which extend vertically, and is movable up an down. Each roller 214 is disposed between guide plates 223 and 224 which extend vertically, and is movable up and down.

Figure 67:
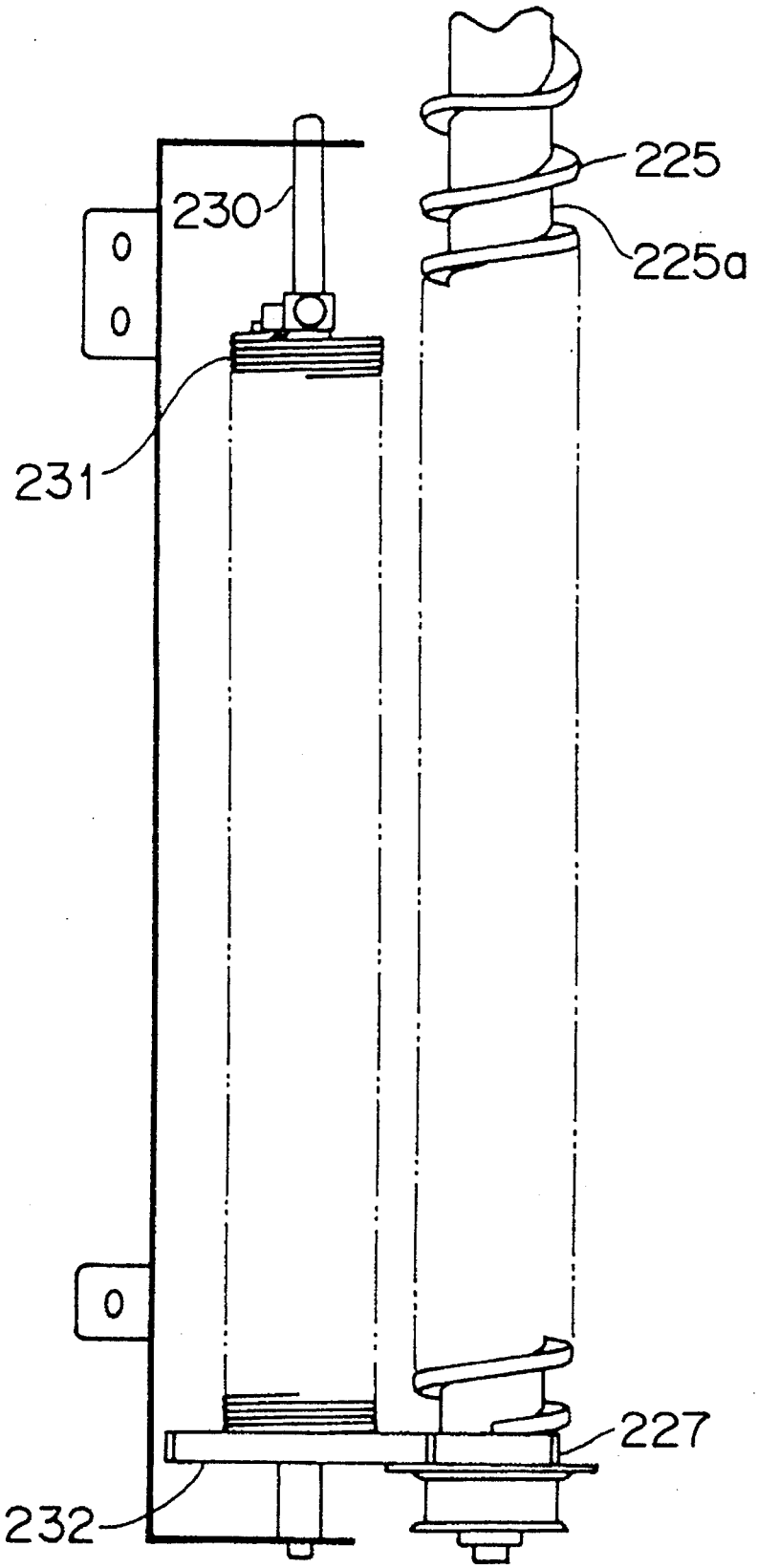
FIG. 67 is an elevational view of a bin moving mechanism.
Figure 68:
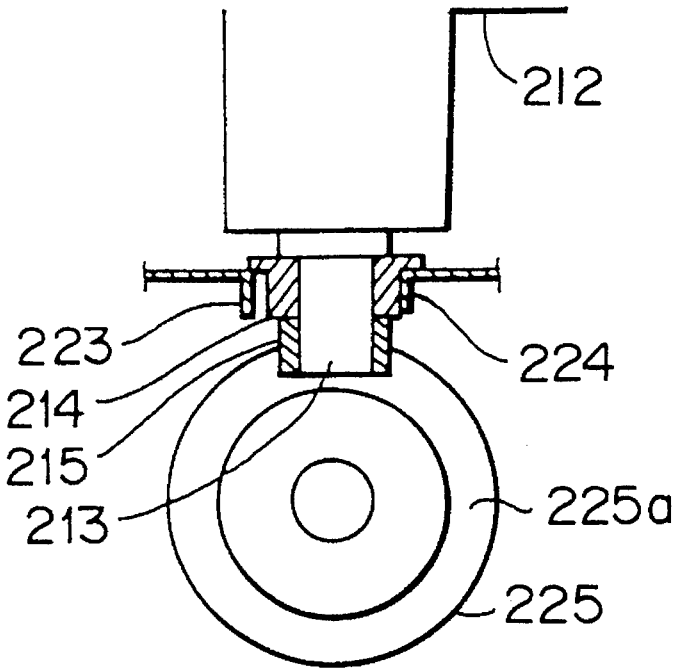
FIG. 68 is a horizontal sectional view of the bin moving mechanism, showing the engagement between a bin driving shaft and rollers.
Figure 69:
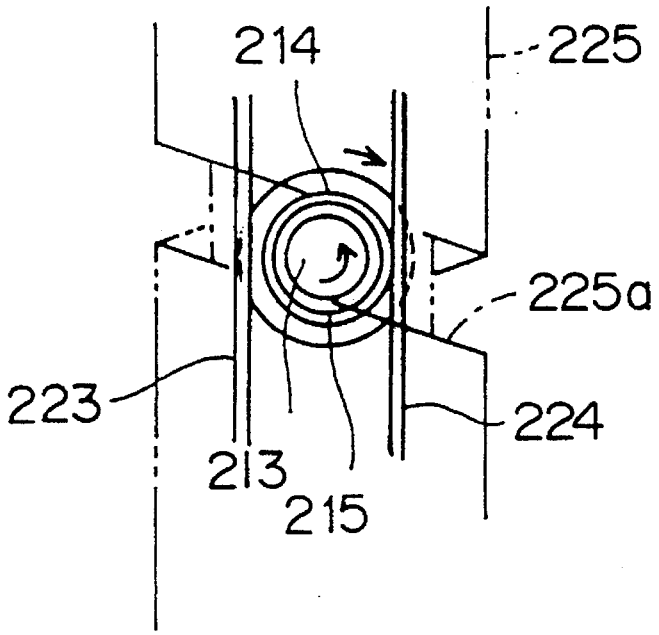
FIG. 69 is an elevational view of the bin moving mechanism, showing the engagement between the bin driving shaft and the rollers.

Driving shaft 225, which are to move the bins 212 wholly up and down, extend vertically at both sides of the bin assembly 210. As shown in FIGS. 67, 68 and 69, each of the driving shafts 225 and a spiral cam groove 225*a* on the circumference, and the roller 215 fitted to the corresponding pin 213 engages with the cam groove 225*a*. A reversible bin motor M202 is disposed in a rear side (upper side of FIG. 62) of the sorter 2, and the motor M202 is connected to the driving shaft 225 in the rear side. The other driving shaft 225 in a front side is connected to the rear side driving shaft 225 by a chain (not shown), and thereby, both the driving shafts 225 rotate synchronously. The driving shafts 225 hold the bins $212_{(1)}$ through $212_{(20)}$ and the non-sort bin $212_{(n)}$ by engagement of the respective rollers 215 with the cam grooves 225*a*. The intervals among the bins depends on the pitch of the cam grooves 225*a*. As is apparent from FIG. 61, the interval between a bin by the side of the hand-out roller pair 254 (in the hand-out position A) and the next bin is increased because the cam grooves 225*a*, in the position A, has a pitch double the other portions. FIG. 61 shows a state wherein the non-sort bin $212_{(n)}$ is in the hand-out position A. Then, when the driving shafts 225 make one rotation in a normal direction or in a reverse direction, the bin assembly 210 wholly moves up or down by one pitch. In sorting operation, the bins $212_{(1)}$ through $212_{(20)}$ are positioned in the hand-out position A one by in this way.

FIG. 61 shows the lowest position of the bin assembly 210, and this position is detected by a sensor SE201. A disk 226 with a cutout 226*a* is fitted to the front side driving shaft 225 (see FIG. 62), and positioning of each bin in the hand-out position A (hereinafter referred to as regular bin position) is detected by monitoring the rotation of the disk 226 with a sensor SE202. Further, a sensor SE203 which detects whether any bin 212 contains any sheet is provided in the sorter 2 (see FIG. 61). The sensor SE203 comprises a light emitting element and a light receiving element, and the optical axis thereof pierces vertically through holes 212*c* made in the bins 212.

<Sheet Aligning Mechanism>

Every time a sheet is received by a bin 212, the sheet aligning mechanism 240 aligns sheets in a regular position R in the bin 212 by using an aligning reference plate 271. Also, after stapling operation, the sheet aligning mechanism 240 puts the stapled sheets in the regular position R. Each bin 212 has an opening 212*d*, and an aligning rod 241 stands vertically so as to pierce through these openings 212*d* of all the bins 212. In the upper and lower portions of the sorter 2, spiral shafts 242 are provided so as to extend in a direction perpendicular to the direction C in which a sheet S is handed into the bin 212. The spiral shafts 242 are connected to an aligning motor M205 and is rotatable in the normal and reverse directions. Upper and lower ends of the aligning rod 241 are fixed on brackets 243 screwed to the respective spiral shafts 242 (see FIG. 61), and the aligning rod 241 moves to the front and rear together with the brackets 243 as the spiral shafts 242 are moving. In FIG. 62, the position of the aligning rod 241 indicated by the solid line is the home position. A sensor SE206 detects whether the aligning rod 241 is in the home position. The aligning motor M205 is a pulse motor. When the motor M205 is driven by a specified number of pulses, the aligning rod 241 moves to the front by a distance according to the number of pulses, which depends on the width of a sheet S to be received by the bin 212. Thus, the aligning rod 241 pushes the sheet S until the other side of the sheet comes into contact with the reference plate 271.

<Sheet Chucking Mechanism>

The sheet chucking mechanism 270 grabs sheets stored in the bins $212_{(1)}$ through $212_{(20)}$ and moves them to the stapling position $B_2$ (see FIG. 62), and after stapling operation, the sheet chucking mechanism 270 returns the sheets to the regular position S in the respective bins $212_{(1)}$ through $212_{(20)}$. This operation is carried out on the same level as the stapling operation level $B_1$ (see FIG. 61).

Figure 70:
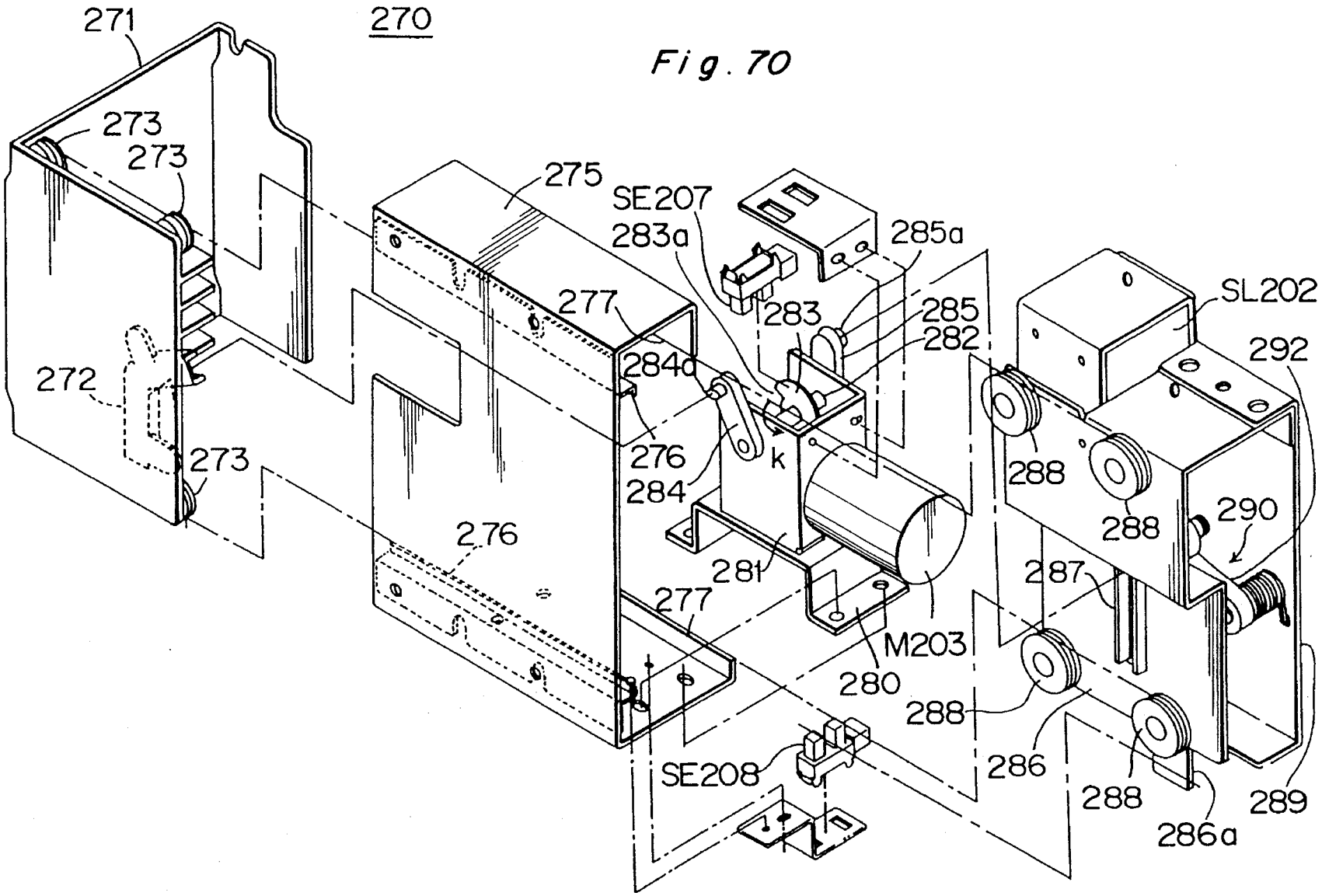
FIG. 70 is a perspective view of a sheet chucking mechanism.
Figure 71:
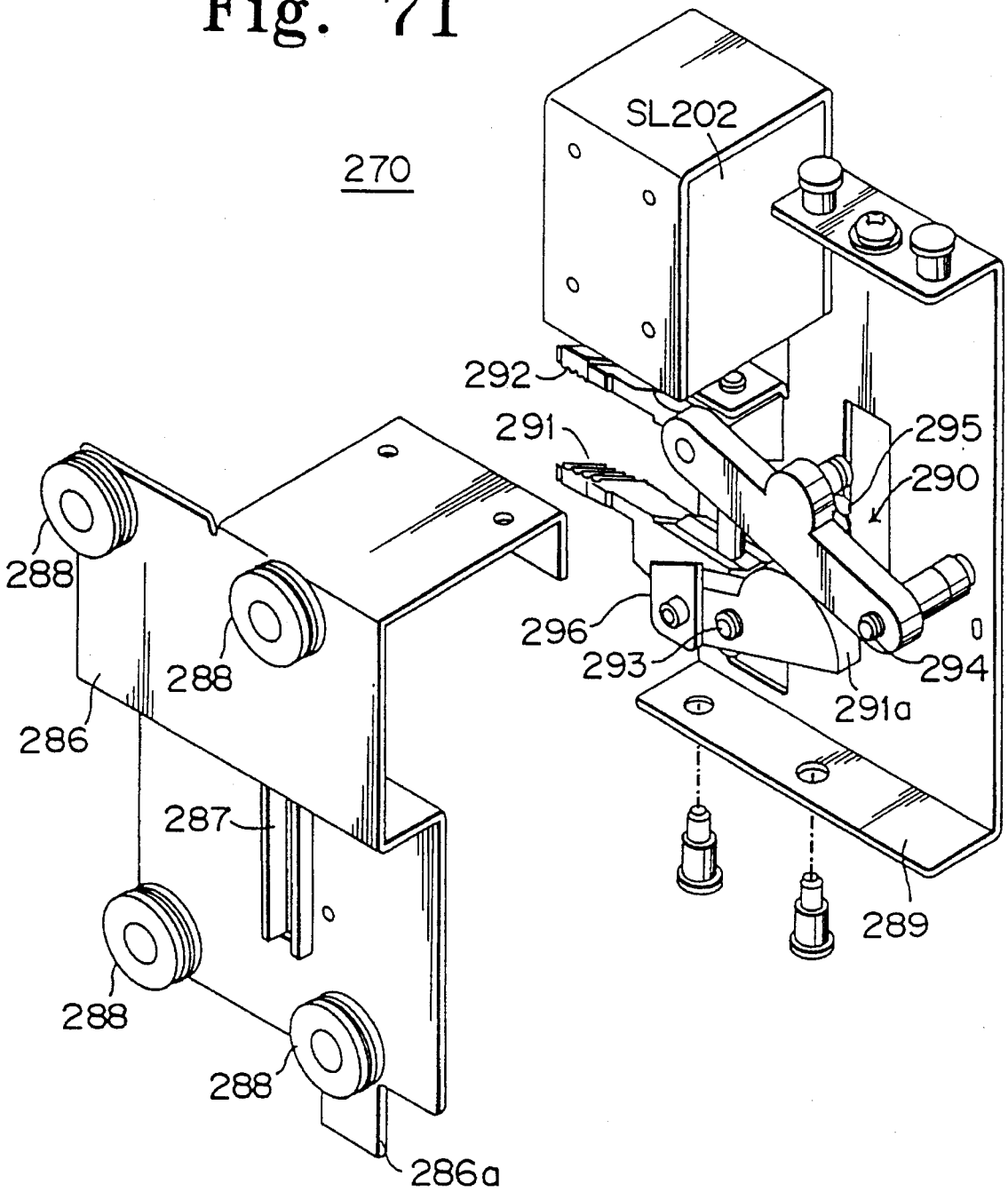
FIG. 71 is an exploded perspective view of a chucking.
Figure 72C:
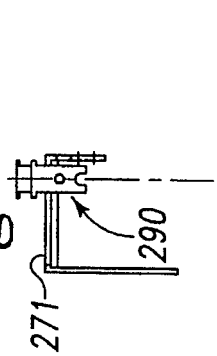
FIG. 72 is an illustration of action of the sheet chucking mechanism.
Figure 72B:
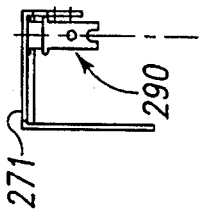
Figure 72A:
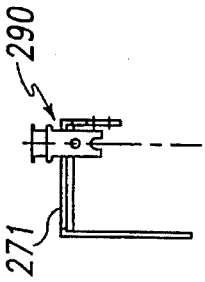
Figure 72D:
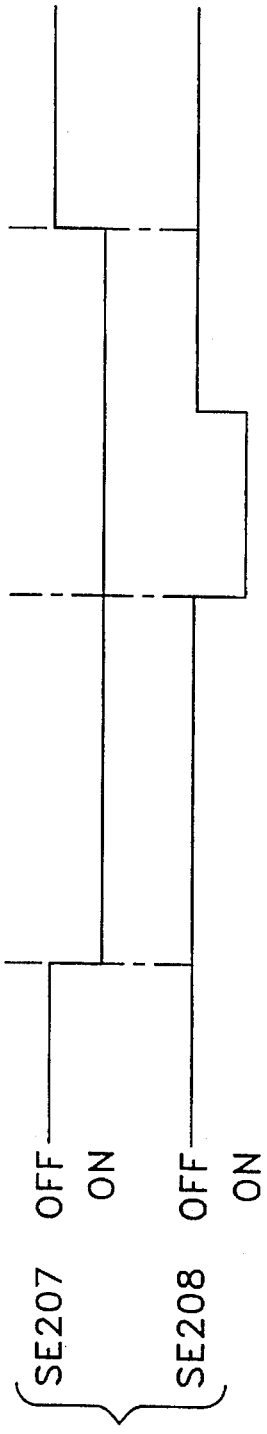
Figure 72G:
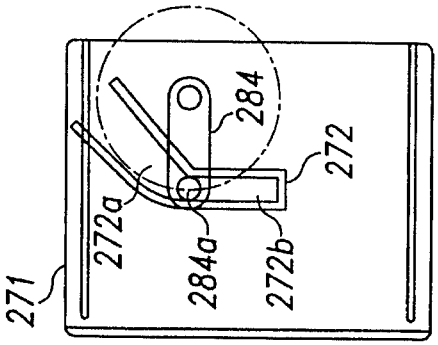
Figure 72F:
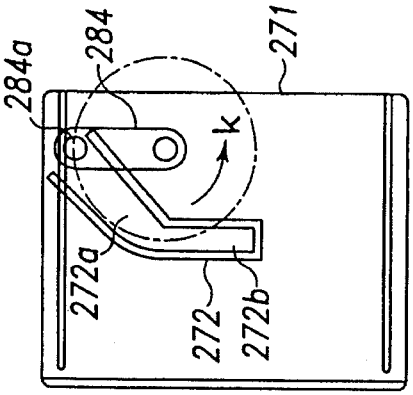
Figure 72E:
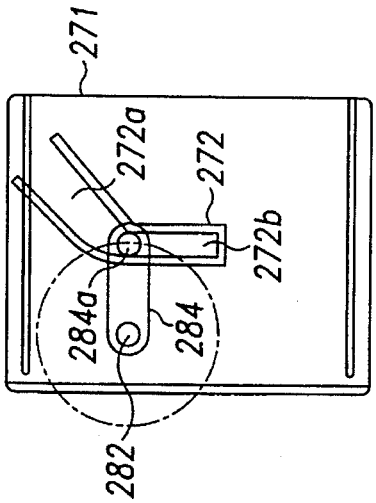

FIGS. 70 and 71 show the structure of the sheet chucking mechanism 270. The chucking mechanism 270 comprises the aligning reference plate 271, a fixed bracket 275, a chucking motor M203, a chucking 290, and movable brackets 286 and 289 which hold the chucking 290. The aligning reference plate 271 has guide rollers 273, and the guide rollers 273 engage with guide plates 276 of the fixed bracket 275. Therefore, the aligning reference plate 271 is slidable. The chucking motor M203 is fitted to the fixed bracket 275 via brackets 280 and 281. The bracket 281 holds a shaft 282, and the motor M203 rotates the shaft 282 in a direction indicated by the arrow k. A lever 284, which has a pin 284*a* at an end, is fitted to an end of the shaft 282, and the pin 284*a* engages with a guide member 272 fitted to the aligning reference plate 271. The guide member 272, as shown in FIG. 72, has an inclined guide groove 272*a* and a vertical guide groove 272*b*. While the lever 284 is turning, the pin 284*a* moves in the guide grooves 272*a* and 272*b*, and consequently, the reference plate 271 moves to the front and rear. The motion of the reference plate 271 is detected by a sensor SE207. The sensor SE207 actually monitors rotation of a disk 283 with a notch 283*a* which is fitted to the shaft 282.

The chucking 290, as shown in FIG. 71, comprises clippers 291 and 292 which are rotatably fitted to the movable bracket 289 via shaft 293 and 294. The lower clipper 291 is connected to an actuator 296 of a solenoid SL202. The clippers 291 and 292 are drawn to each other by a coil spring 295, and a cam surface 291*a* of the clipper 291 is in contact with a lower side of the clipper 292. While the solenoid SL202 is off, the actuator 296 is in a low position, and the ends of the clippers 291 and 292 are open. When the solenoid SL202 is turned on, the actuator 296 moves up, and thereby the lower clipper 291 turns upward on the shaft 293. Meanwhile, the lower side of the upper clipper 292 slides along the cam surface 291*a*, and the clipper 292 turns downward on the shaft 294. Thus, when the solenoid SL202 is turned on, the ends of the clippers 291 and 292 are closed to grab sheets.

The movable bracket 289 is integrated with the movable bracket 286 on which guide rollers 288 are fixed. The guide rollers 288 engage with a guide plate 277 of the fixed bracket 275, and the brackets 289 and 286 are slidable. A lever is fitted to the end of the shaft 282, which is driven by the motor M203, the end being opposite to the end provided with the lever 284. The lever 285 has a pin 285*a* at the end, and the pin 285*a* engages with a guide groove 287 provided on a side of the movable bracket 286. In this structure, the chucking 290 moves to the front and rear as the lever 285 is turning. The motion of the chucking 290 is detected by a sensor SE208. The sensor SE208 actually detects a tab 286*a* of the movable bracket 286.

In stapling one set of sheets, the motor M203 drives the levers 284 and 285 to make one rotation. At the start of drive of the motor M203, the levers 284 and 285 are in upright postures. In this state, the pin 284*a* faces the upper end of the guide groove 272*a*, and the pin 285*a* is in the upper end of the guide groove 287. In this state, the aligning reference plate 271 and the chucking 290 are in the home positions (see FIG. 72), and the aligning reference plate 271 in the position regulates a side of a sheet S shown in FIG. 62. When the motor M203 is turned on, the pin 284*a* moves into the guide groove 272*a*. The aligning reference plate 271 keeps in the home position and the sensor SE207 keeps on until the lever 284 turns in the direction of arrow k by 90 degrees. Meanwhile, by the engagement of the pin 285*a* with the guide groove 287, the chucking 290 moves to the rear toward the sheets in the regular position R. The sensor SE208 is turned on when the motor M203 is turned on. When the lever 285 turns by 90 degrees, the chucking 290 comes to the rear most. At the time, the sensor SE207 is turned off, and the solenoid SL202 is turned on to make the clippers 291 and 292 grab the sheets. The sensor SE208 is turned off while the chucking 290 is moving to the rear. While the levers 284 and 285 are turning from 90 degrees to 270 degrees, both the aligning reference plate 271 and the chucking 290 move to the front and draw the sheets to the stapling position $B_2$. When the rotation of the levers 284 and 285 becomes 270 degrees, the sensor SE207 is turned on, and the stapler 300 is driven to staple the sheets. After the stapling, the solenoid SL202 is turned off, and the sheets are relieved from the clippers 291 and 292.

Thereafter, while the levers 284 and 285 turning from 270 degrees to 360 degrees, the aligning reference plate 271 and the chucking 290 moves to the rear to the home positions. Thereby, the stapled set of sheets are pushed back in the regular position S in the bin 212.

Further, a sensor SE209 (see FIG. 62) is provided to detect whether the chucking 290 brings the sheets to the stapling position $B_2$.

<Stapler>

The stapler 300 is a conventional electric type. A motor M204 drives a tap (not shown) to hit a staple in sheets. A lot of straight staples are stuck together by adhesive to be in the shape of a sheet, and a cartridge contains a number of such staple sheets. The staple cartridge is loaded in the stapler 300 through s small door 236 shown in FIG. 60.

The stapler 300 has a sensor SE210 which detects whether the tap is in the home position and a sensor SE211 which detects whether there are staples.

Next, operation modes of the sorter 2 are described.

<Non-Sorting Mode>

A non-sorting mode is a mode of transporting sheets ejected from the machine body 1 to one or more bins 212.

The operator sets the non-sorting mode by use of a key on an operation panel (not shown). The non-sorting mode is an initial mode.

In response to the setting of the non-sorting mode, the bin assembly 210 is set in the lowest position, which is detected by the sensor SE201. Then, the sensor SE202 detects that the non-sort bin $\mathbf{212}_{(n)}$ is in the hand-out position A.

A sheet which has received an image in the machine body 1 passes through the transporting mechanism 250 and is received on the non-sort bin $\mathbf{212}_{(n)}$ through the hand-out roller pair 254. Imaged sheets are transported to the non-sort bin $\mathbf{212}_{(n)}$ in this way one after another and piled thereon. When the non-sort bin $\mathbf{212}_{(n)}$ receives a specified number of sheets, the bin assembly 210 moves up by one step, and then, the first sort bin $\mathbf{212}_{(1)}$ starts receiving sheets. In this way, each time a bin 212 is filled with sheets, the bin assembly 210 moves up by one step such that the next bin 212 can receive successive sheets.

<Sorting Mode>

A sorting mode is a mode of sorting sheets ejected from the machine body 1 by use of the sort bins $\mathbf{212}_{(1)}$ through $\mathbf{212}_{(20)}$.

The operator sets the sorting mode by use of a key on the operation panel. In response to the setting of the sorting mode, the bin driving shafts 225 make one rotation in the normal direction so as to lift the bin assembly 210 by one step from the home position of FIG. 60. Thereby, the first sort bin $\mathbf{212}_{(1)}$ comes to the hand-out position A, and this position of the bin assembly 210 is hereinafter referred to as sorting initial position.

A sheet which has received an image in the machine body 1 passes through the transporting mechanism 250 and is received on the sort bin $\mathbf{212}_{(1)}$ through the hand-out roller pair 254. As shown in FIG. 73A, a specified time (for example, 50 milliseconds) after the trailing edge of the sheet is detected by the hand-out sensor SE205, the bin motor M202 is driven in the normal direction so as to lift the bin assembly 210 by one step. Subsequently, the aligning motor M205 is driven in the normal direction so as to move the aligning rod 241 to the front. Thereby, the received sheet is regulated between the aligning rod 241 and the aligning reference plate 271. The moving distance of the aligning rod 241 depends on the sheet size. The aligning motor M205 is driven in the normal direction by a number of pulses which is determined in accordance with sheet size data transmitted from a control section of the machine body 1 to a control section of the sorter 2. The aligning motor M205 is driven in the reverse direction by the same number of pulses immediately after the normal rotation. Thereby, the aligning rod 241 is returned to the home position. In the meantime, the next sheet is received on the next bin $\mathbf{212}_{(2)}$. Thereafter, sheets are received on the bins $\mathbf{212}_{(3)}$ through $\mathbf{212}_{(20)}$ one by one in the same manner.

The sorter 2 makes reciprocating distribution. Sheets of an odd page are distributed among the bins while the bin assembly 210 is moving upward step by step, and sheets of an even page are distributed while the bin assembly 210 is moving downward step by step. When the bin assembly 210 changes from the upward motion to the downward motion or from the downward motion to the upward motion, the uppermost of the used bins or the lowermost of the used bins receives two consecutive sheets which are the last sheet of a page and the first sheet of the next page. While the uppermost or the lowermost of the used bins is receiving two consecutive sheets, the bin assembly 210 does not move, and the sheet aligning operation is carried out earlier then usual. The aligning operation in this case is shown by FIG. 73B. After the hand-out sensor SE205 detects the trailing edge of the last sheet of a page, the aligning motor M205 is driven at the timing of driving the bin motor M202 in a usual case. At that time, the sheet which has passed through the hand-out roller pair 254 is still in the air before falling into the bin 212.

Since the aligning motor M205 is started while the sheet is still in the air, the aligning operation is more effective. If the aligning operation is carried out after the newly-fed sheet falls into the bin 212 and completely sticks to sheets stored in the bin 212, there is a possibility that the friction between the newly-fed sheet and the sheets stored in the bin 212 is so large that the aligning operation is not effective. However, as described, the aligning operation is carried our effectively at an earliest timing.

<Sorting/Stapling Mode>

A sorting/stapling mode is a mode of sorting sheets ejected from the machine body 1 and stapling the sheets stored in the sort bins $\mathbf{212}_{(1)}$ through $\mathbf{212}_{(20)}$.

The operating sets the sorting mode and the stapling mode by use of keys on the operating panel.

First, sheets which have received images in the machine body 1 are sorted while the sorter 2 is operating as described above.

The stapling operation is carried out after the sorting operation. In the stapling operation, bins stored with the sheets are moved to the stapling level $B_1$ one by one. The movement to the stapling level $B_1$ starts with a bin which has received the last sheet in the sorting operation. For example, when ten copy sets are made from an odd number of documents, the tenth sort bin $\mathbf{212}_{(10)}$ is in the hand-out position A at the time of completing the sorting operation. Then, the bin assembly 210 moves one step up to set the tenth sort bin $\mathbf{212}_{(10)}$ to the stapling level $B_1$. After stapling of sheets in the bin $\mathbf{212}_{(10)}$, the bin assembly 210 moves one step down to set the ninth sort bin $\mathbf{212}_{(9)}$ to the stapling level $B_1$. Thereafter, the bin assembly 210 moves downward step by step to subject the sort bins $\mathbf{212}_{(8)}$ through $\mathbf{212}_{(1)}$ to the stapling operation in order. On the other hand, when ten copy sets are made from an even number of documents, the first sort bin $\mathbf{212}_{(1)}$ is in the hand-out position A at the time of completing the sorting operation. Then, the bin assembly 210 moves one step up to set the first sort bin $\mathbf{212}_{(1)}$ to the stapling level $B_1$, and sheets in the bin $\mathbf{212}_{(1)}$ are stapled. Thereafter, the bin assembly 210 moves upward step by step to subject the sort bins $\mathbf{212}_{(2)}$ through $\mathbf{212}_{(10)}$ to the stapling operation in order.

When a sort bin is set to the stapling level $B_1$, the chucking motor M203 is turned on. While the shaft 282 is rotating by 90 degrees, the aligning reference plate 271 stays in the home position shown in FIG. 72, and the chucking 290 moves to the rear from the home position. When the rotation of the shaft 282 becomes 90 degrees, the sensor SE207 is turned off. Simultaneously, the solenoid SL202 is turned on to make the clippers 291 and 292 grab sheets in the bin.

Subsequently, while the rotation of the shaft 282 is from 90 degrees to 270 degrees, the chucking 290 moves to the front holding the sheets. The aligning reference plate 271 moves to the front in synchronization with the chucking 290. When the rotation of the shaft 282 becomes 270 degrees, the sensor SE207 is turned on. In this moment, on confirmation that the sensor SE209 detects sheets, the stapler 300 is driven to staple the sheets.

After the stapling, the solenoid SL202 is turned off, whereby the stapled set of sheets are relieved from the clippers 291 and 292.

Then, while the shaft 282 continues rotating to 360 degrees, the aligning reference plate 271 returns to the home position pushing the stapled set of sheets back in the regular position R in the bin. Simultaneously, the chucking 290 returns to the home position.

After one cycle of stapling operation described above, the bin assembly 210 moves up or down by one step, so as to subject sheets stored in the next bin to the stapling operation.

The document set and feed direction, the copied paper discharge direction, and staple position in normal document mode and two-in-one mode will be clear from the following description.

Normal Document Mode

Figure 74:
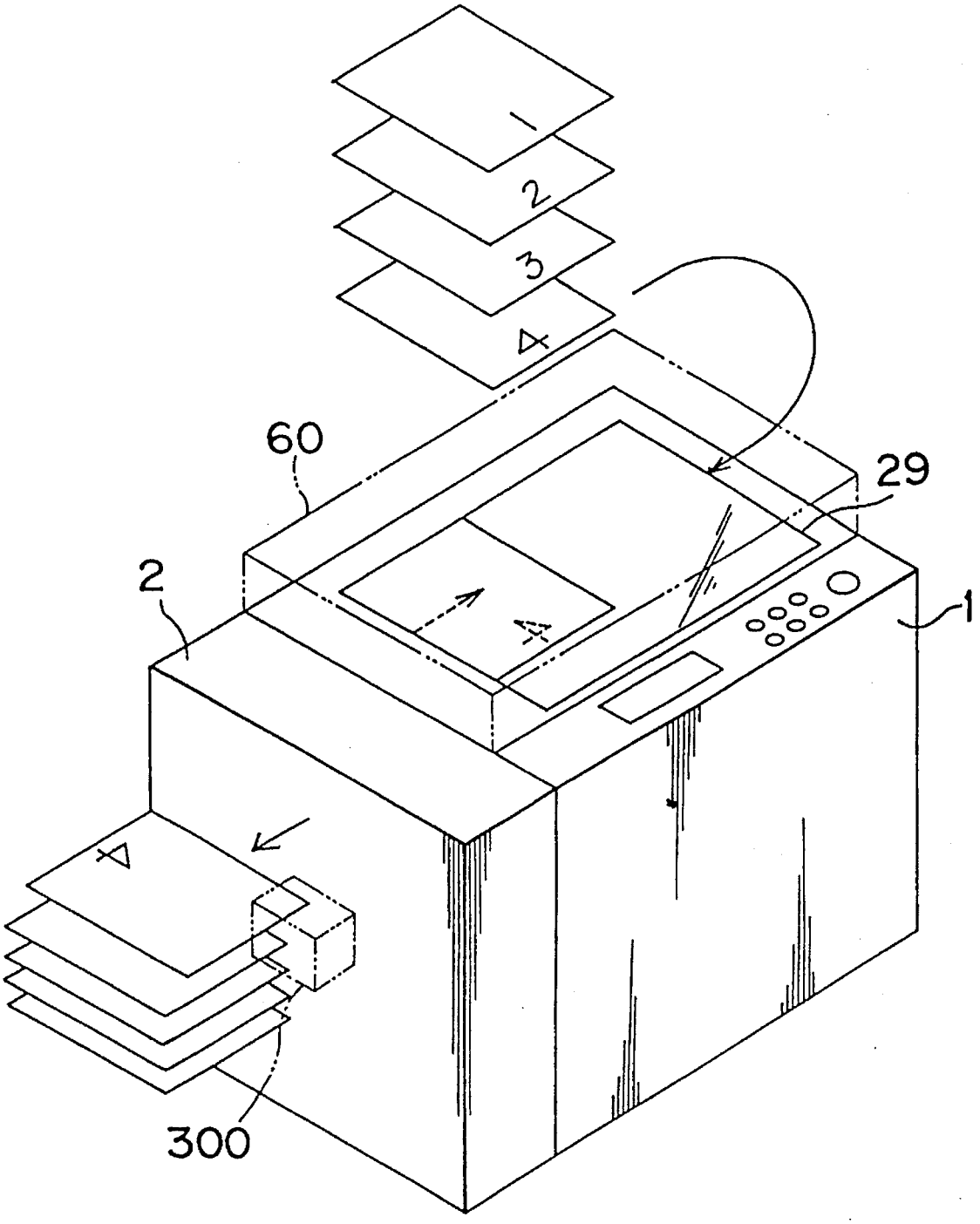
FIG. 74 is a perspective view of the copying machine of FIG. 60, showing a document set direction, a document feed direction, and a copied paper discharge direction etc. in a normal document mode.

In the normal document mode, as shown in FIG. 74, the document is set on the document tray 61 of the ADF 60 such that the upper surface of the document may face upward and such that the lower edge of the document may be directed to the operating side of the copying machine body 1. In the example of FIG. 74, page 1 of the document is uppermost and the page 4 of the document is lowermost. The last page of the document is turned over and fed on the document glass 29 of the copying machine body 1 from the right side of the copying machine body 1. The document on the document glass 29 is scanned in the direction from the left side to the right side to make necessary copies (5 copies in the embodiment). Then, the copied paper are discharged to the bin (not shown) of the sorter 2 from the left side of the copying machine body 1 such that the upper surface of the document may face upward and such that the lower edge of the document may be directed to the opposite side of the operating side of the copying machine body 1. After the copy of all document is completed, the copied paper are stapled by the stapler 300 of the sorter 2. The stapler 300 is provided firstly in the rear edge side of the copied paper, that is, in the upstream side of the discharge direction; and secondary in the operational side of the copying machine, that is, in the left side looking at the discharge direction. By this stapler 300, therefore, the copied paper discharged in an upside down are stapled on a proper position, namely, on a left shoulder position.

Two-in-one Mode

Figure 75:
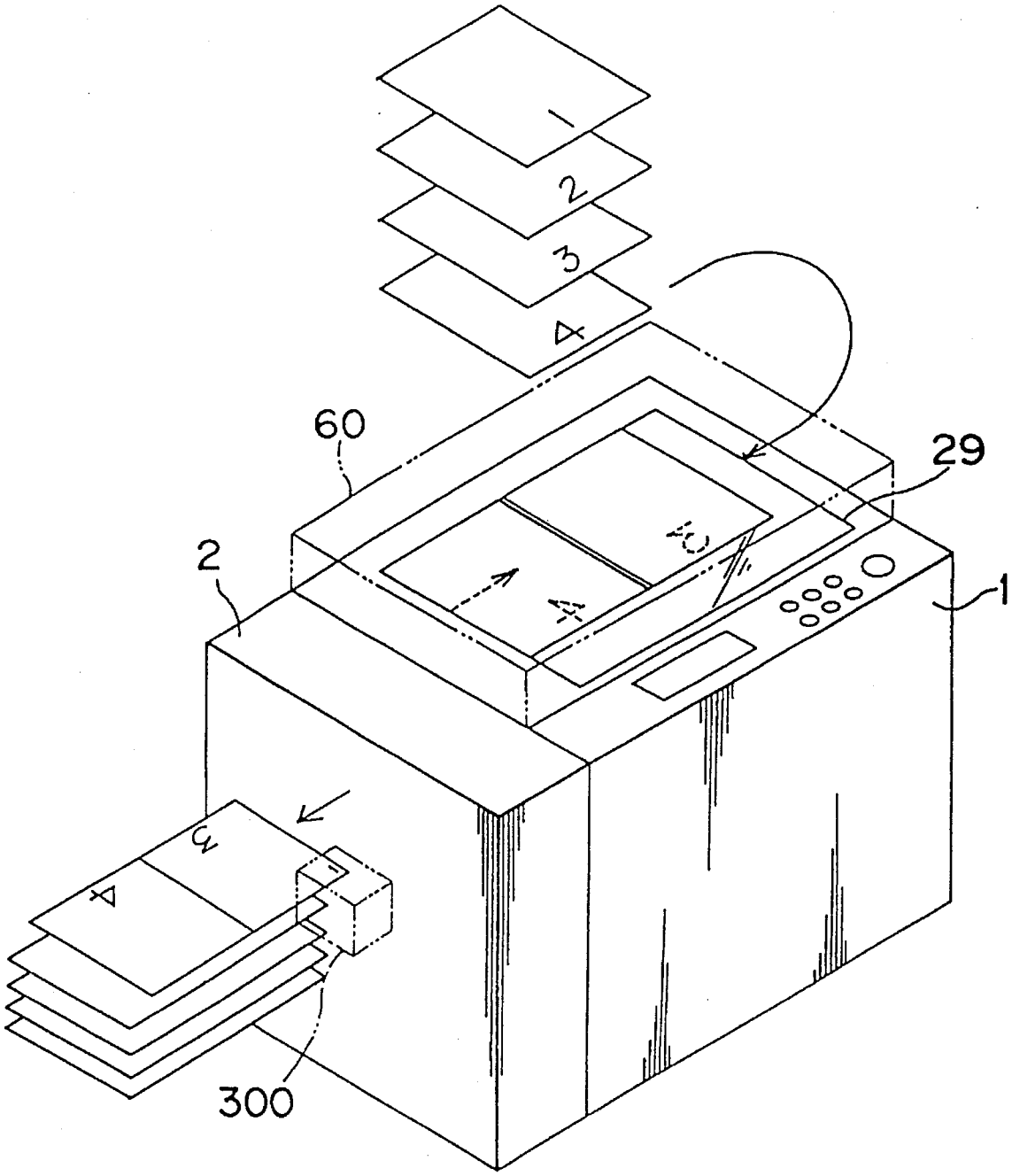
FIG. 75 is a perspective view of the copying machine in the same manner as that of FIG. 74, showing a document set direction, a document feed direction, and a copied paper discharge direction etc. in a two-in one document mode.

In the two-in-one document mode, as shown in FIG. 75, the document is set on the document tray 61 of the ADF 60 in the same manner as the normal document mode as shown in FIG. 74. The last page (page 4) of the document is turned over and fed on the document glass 29 of the copying machine body 1 from the right side of the copying machine body 1, and then the previous page (page 3) is fed in the same manner. The document on the document glass 29 are scanned in the direction from the left side to the right side to make necessary copies (5 copies in the embodiment). Then, the copied paper are discharged to the bin (not shown) of the sorter 2 from the left side of the copying machine body 1 such that the upper surface of the document may face upward and such that the lower edge of the document may be directed to the opposite side of the operating side of the copying machine body 1. After the copy of all document is completed, the copied paper are stapled by the stapler 300 of the sorter 2 on a proper position, namely, on a left shoulder position.

As described above, in the two-in-one document mode, it is possible to set the document on the document tray of the ADF 60 without changing the document set direction and to staple the copied paper on a suitable position by the stapler.

<Punching Mode>

A punching mode is a mode of punching sheets ejected from the machine body 1. In most cases, the punching mode is combined with the sorting mode and/or the stapling mode. The sorting operation and the stapling operation are carried out as described above.

The operator sets the punching mode by use of a key on the operation panel. A sheet ejected from the machine body 1 is transported into the transporting mechanism 250 of the sorter 2. Then, a specified time after the register sensor SE204 detects the trailing edge of the sheet, for example, when the trailing edge of the sheet reaches a point 10 mm upstream of the nipping portion of the register roller pair 252, the electromagnetic clutch CL201 is turned on, and thereby, the clutch roller pair 253 and the hand-out roller pair 254 are stopped. The register roller pair 252 still continues rotating, and only the trailing portion of the sheet is fed. Accordingly, the sheet curves between the roller pairs 252 and 253, and as soon as the trailing edge of the sheet has passed through the nipping portion of the register roller pair 252, the trailing edge is regulated by the nipping portion. In this moment, the flapper solenoid SL201 is turned on so as to move the punching sticks 263, and the sheet is punched at the trailing portion supported between the guide plate 261 and the guide portion 262*a* of the punch trash can 262. Then, the electromagnetic solenoid SL201 is turned off so as to restart rotating the roller pairs 253 and 254, and thereby, the sheet starts to be transported again.

Although the present invention has been fully described by way of the examples with reference to the accompanying drawing, it is to be noted here that various changes and modifications will be apparent to those skilled in the art. Therefore, unless such changes and modifications otherwise depart from the spirit and scope of the present invention, they should be construed as being included therein.

What is claimed is:

1. A copying machine having a two-in-one copying mode in which two document sheets are fed on a glass platen in series with respect to a document conveying direction and copied onto one copy sheet by one-time exposure scanning, the copying machine comprising:

a document feeder means for feeding document sheets toward the glass platen one by one to stop the document sheets at a first-out position which is situated on an upstream side of the document conveying direction;

a first conveying means for conveying the document sheets fed by the document feeder means onto the glass platen;

a second conveying means for conveying the document sheets conveyed by the first conveying means along the glass platen until the rear end of the document sheets reach a predetermined switch-back position, conveying the document sheets in the opposite direction to retreat a predetermined distance, conveying a first of the document sheets as well as a succeeding second document sheet stopped at the first-out position such that the front end of the first document sheet situated on a downstream side of the document conveying direction may be aligned with an exposure reference, and discharging the first and second document sheets to the downstream side of the document conveying direction after exposure; and a third conveying means for conveying the document sheets discharged by the second conveying means from the glass platen to a discharge section;

whereby the document conveying length (d3) from the exposure reference to the third conveying means is longer than the sum (d4+Δdp) of the document conveying length (d4) from the first-out position to the switch-back position and the difference length (Δdp) of the document conveying direction between a document sheet having a longest length and a document sheet having a shortest length among document sheets to be handled in the two-in-one mode.

2. A copying machine of claim 1, wherein the second conveying means includes a conveyor belt situated above the glass platen, the document feeder means includes a pickup roller and a separating roller provided on the upstream side of the second conveying means with respect to the document conveying direction, the first conveying means includes a register roller provided between the document feeder means and the second conveying means, and the third conveying means includes a pinch roller and a discharge roller provided on the downstream side of the second conveying means with respect to the document conveying direction.

3. A copying machine of claim 2, wherein the first-out position is defined by a nip position of the register roller of the first conveying means.

4. A copying machine of claim 3, wherein a switch-back amount of the document sheets by the second conveying means corresponds to a length over which the rear end of the document sheets reach the nip portion of the register roller.

5. A copying machine of claim 2, wherein the document sheets are guided by guide means so that the rear end portion of the document sheets do not return to the register roller side.

6. A copying machine of claim 5, wherein the guide means comprises a resin film.

7. A copying machine of claim 1, wherein the second conveying means is reduced in speed immediately before the document sheet reaches the exposure reference.

8. A copying machine of claim 1, wherein the second conveying means makes a space between the first document sheet and the second document sheet exposed at the same time by once switching back the second document sheet as well as a succeeding, third document sheet after the first document sheet has discharged and before the second document sheet has reached the discharge section.

9. A copying machine of claim 1, wherein the second conveying means makes a space between the first document sheet and the second document sheet exposed at the same time by turning off the second conveying means when the rear end of the first document sheet has separated from the second conveying means.

10. A copying machine having a two-in-one copying mode in which mode two document sheets are fed on a glass platen in series with respect to a document conveying direction and copied onto one copy sheet by one-time exposure scanning, the copying machine comprising:

a document tray on which document sheets are set such that a lower end of the document sheets is directed to an operational side of the copying machine;

a document conveying means for conveying the document sheets in mm from a last sheet onto the glass platen from the fight side of the copying machine as viewed from the operational side thereof;

a discharge means for discharging a copy sheet from the left side of the copying machine as viewed from the operational side thereof, the upper surface of the copy sheet being faced upward, the lower end of the copy sheet being directed to a back side of the copying machine; and a stapler means for stapling the copy sheet discharged by the discharge means on the rear end of the copy sheet and on the operational side.

11. A copying machine of claim 10, wherein the document tray is provided above the glass platen and wherein the document sheets are set such that the lower end of the document sheets is directed to the operational side of the copying machine and an upper surface of the document sheets is faced upward.

12. A copying machine of claim 10, wherein the document tray is provided on the right side of the glass platen as viewed from the operational side of the copying machine and wherein the document sheets are set such that the lower end of the document sheets is directed to the operational side of the copying machine and an upper surface of the document sheets is faced downward.

* * * * *

UNITED STATES PATENT AND TRADEMARK OFFICE

CERTIFICATE OF CORRECTION

PATENT NO. : 5,587,782

DATED : December 24, 1996

INVENTOR(S) : Johdai et al

It is certified that error appears in the above-indentified patent and that said Letters Patent is hereby corrected as shown below:

Column 36, line 41, line 10 of patent claim 10), delete "in mm" and insert --in turn--.

Column 36, line 42,(line 11 of patent claim 10), delete "fight" and insert --right--.

Signed and Sealed this

Seventh Day of October, 1997

*Attest:*

Bruce Lehman

BRUCE LEHMAN

*Attesting Officer*

*Commissioner of Patents and Trademarks*